US005931229A

United States Patent [19]

Lehr et al.

[11] Patent Number: 5,931,229

[45] Date of Patent: Aug. 3, 1999

[54] THROUGH TUBING GRAVEL PACK SYSTEM AND METHOD OF GRAVEL PACKING

[75] Inventors: Douglas J. Lehr, Woodlands, Tex.; James T. Matte, Broussard, La.

[73] Assignee: BJ Services Company, Houston, Tex.

[21] Appl. No.: 08/854,933

[22] Filed: May 13, 1997

[51] Int. Cl.[6] ..... E21B 43/04

[52] U.S. Cl. ..... 166/278; 166/51

[58] Field of Search ..... 166/278, 328, 166/384, 281, 196, 51, 297

[56] References Cited

U.S. PATENT DOCUMENTS

| | | | |
|---|---|---|---|
| 4,253,522 | 3/1981 | Setterberg | 166/278 |
| 4,541,486 | 9/1985 | Wetzel et al. | 166/297 |
| 5,219,025 | 6/1993 | Berger et al. | 166/278 |
| 5,370,180 | 12/1994 | Barbee | 166/178 |
| 5,377,749 | 1/1995 | Barbee | 166/120 |
| 5,443,117 | 8/1995 | Ross | 166/278 X |
| 5,620,050 | 4/1997 | Barbee | 166/278 |

OTHER PUBLICATIONS

"Retrievable Hydraulic Packers for Coiled Tubing", Groundwater Protection Systems (undated).

Dorman et al., "Single–Trip Gravel Pack System Used Effectively on a Highly Deviated Well", Mar., 1994, Second International Conference on Coiled Tubing Operations.

*Primary Examiner*—David J. Bagnell
*Assistant Examiner*—Abdel G. Elkassed
*Attorney, Agent, or Firm*—Arnold White & Durkee

[57] ABSTRACT

A through tubing gravel pack assembly which is capable of being run on a coiled tubing string inside existing tubing for repairing a preexisting gravel pack. The through tubing gravel pack system comprises a hydraulically releasable running tool and service assembly, a hydraulically set through tubing packer assembly and a crossover sleeve and sliding sleeve valve assembly. The gravel pack assembly is adapted to be shiftable between a circulating mode and a squeeze mode for conducting a circulating gravel pack and/or a squeeze gravel pack without the necessity of having to trip the assembly out of the borehole.

43 Claims, 47 Drawing Sheets

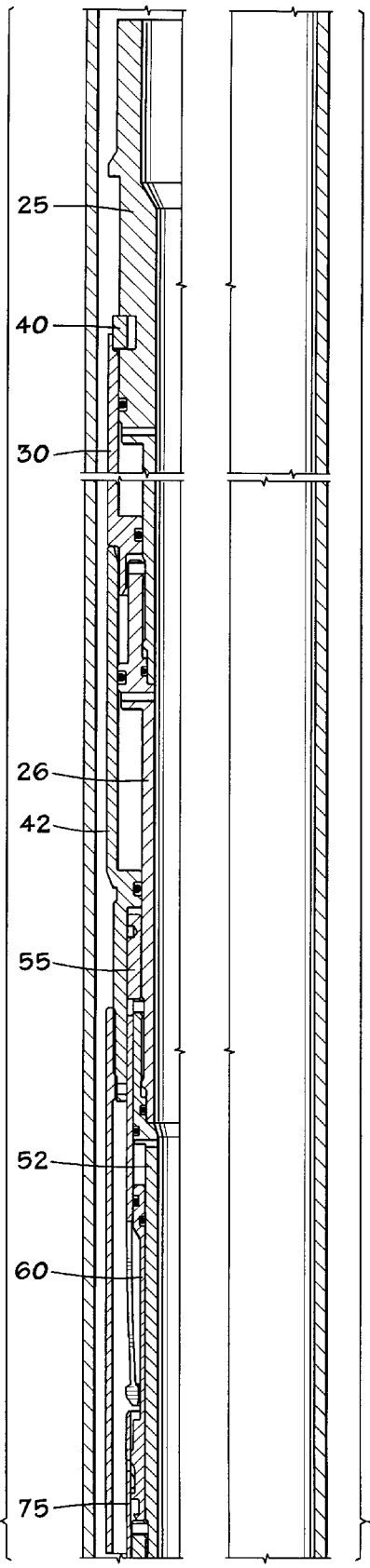
FIG. 2A
FIG. 2A'
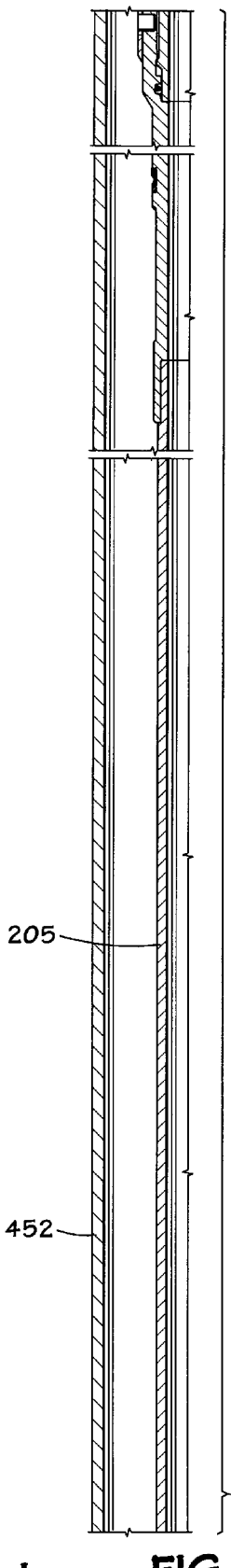
FIG. 2B
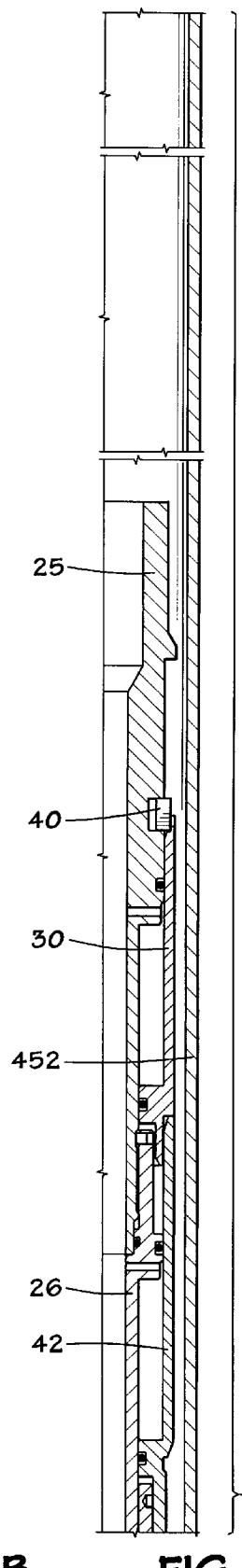
FIG. 2B'

FIG. 4
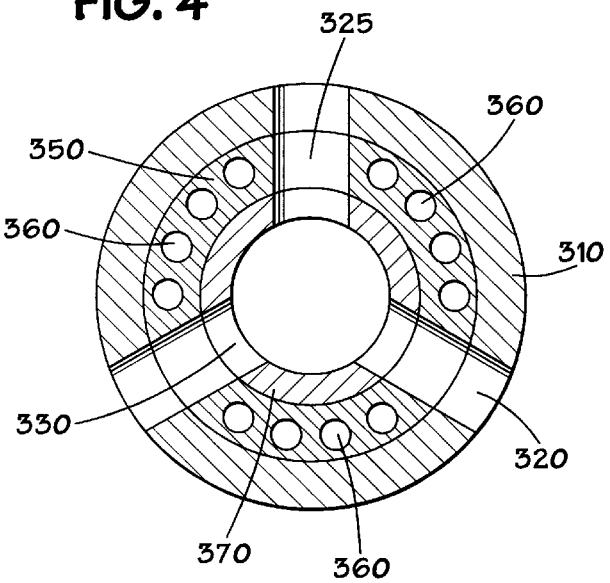
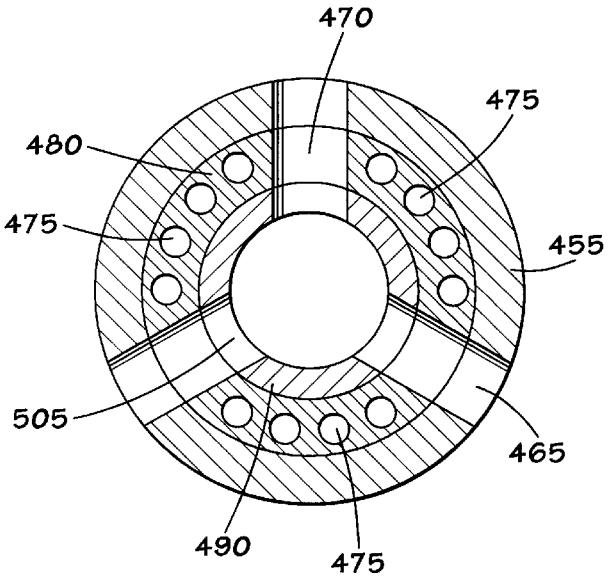
FIG. 13
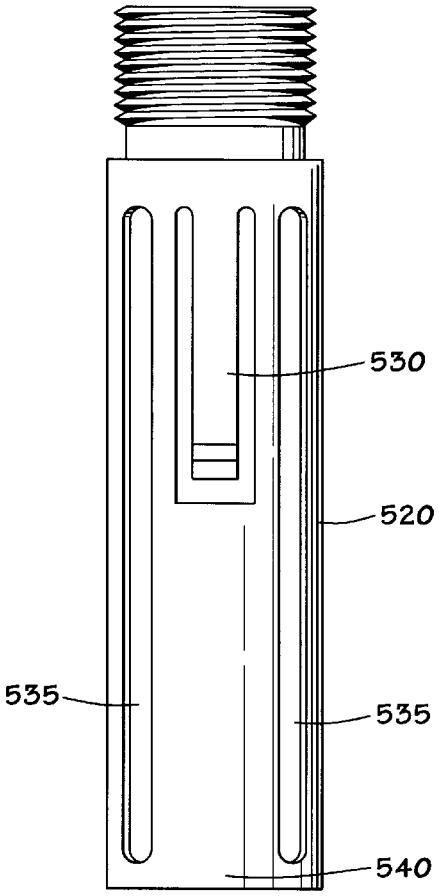
FIG. 14

577
575

580
570
585

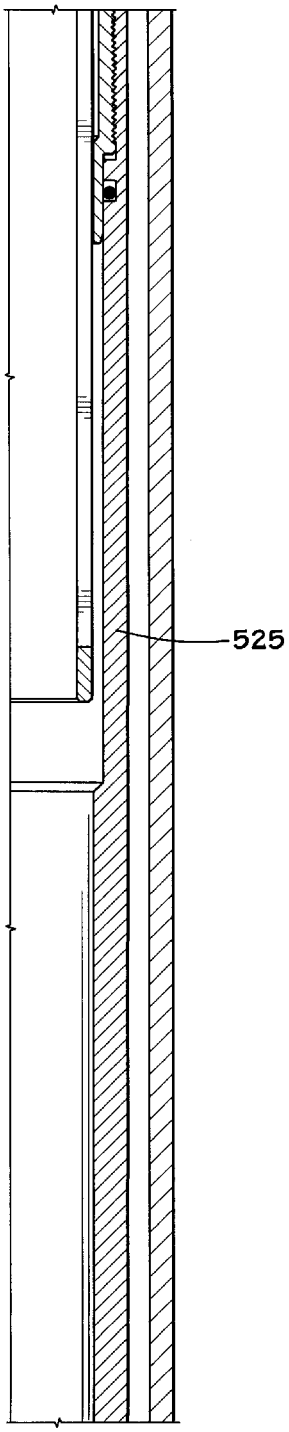
FIG. 12G
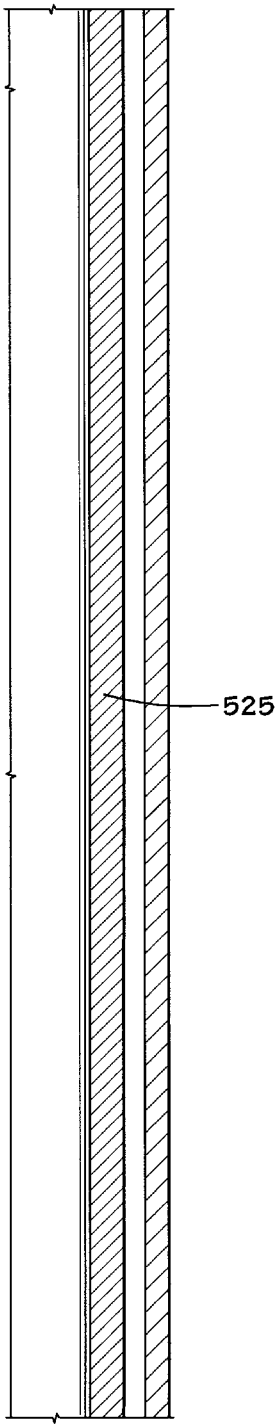
FIG. 12H
FIG. 12I
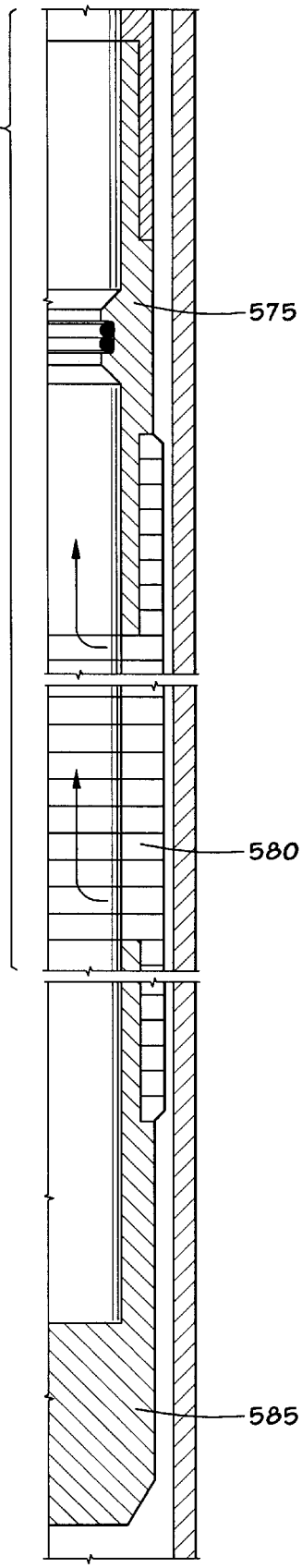
FIG. 12J

THROUGH TUBING GRAVEL PACK SYSTEM AND METHOD OF GRAVEL PACKING

FIELD OF THE INVENTION

The present invention relates to a through tubing gravel pack system for oil and gas wells. More particularly, the present invention relates to a through tubing gravel pack system which is preferably run on a coiled tubing string inside an existing production tubing in a wellbore.

BACKGROUND OF THE INVENTION

Gravel packing a well reduces the amount of formation sand that is produced with the production fluid. Due to its abrasive nature, formation sand in the production fluid is detrimental to downhole completion equipment and surface production equipment. Gravel packing comprises packing the annulus between the perforated wellbore and slotted screens positioned opposite the perforations on the end of the production tubing with sand or gravel to form a filter for reducing the flow of formation sand into the wellbore.

The predominant methods of conventional gravel packing are the circulating pack and squeeze pack methods. In a circulating gravel pack, the gravel pack slurry is displaced down the tubing string and through the gravel pack assembly to deposit sand or gravel in the perforations and between the perforations in the wellbore and a slotted screen attached to the bottom of the gravel pack assembly. After depositing the gravel pack sand, the carrier fluid of the slurry passes through the slotted screen and is circulated out of the borehole. Circulating gravel packs generally offer the highest chances for success in gravel packing.

The squeeze gravel pack method also deposits the gravel pack sand or gravel in the perforations and between the perforations and the slotted screen but does not provide a means for circulating the carrier fluid out of the wellbore. Instead, the carrier fluid is displaced, or squeezed into the formation through the perforations after the sand or gravel is deposited in the annulus between the perforations and the screen. Ideally, the carrier fluid is removed from the formation after the gravel pack job is completed and the well is returned to production.

Over time, older gravel packs tend to fail or reach a state where repairs are necessary. Corrosion and sand cutting are typical examples of how gravel packs reach a deteriorated state. Ideally, an operator could repair a deteriorated gravel pack instead of replacing the gravel pack. This is especially important in wells where it is economically not feasible to replace the existing gravel pack. The present invention is well-suited for remedial repairs of pre-existing gravel pack completions.

The present invention is designed to allow through-tubing circulating and squeeze packs using a through-tubing gravel pack assembly and surface manipulation of the coiled tubing string. With the present invention, an operator can change "on-the-fly" from circulating to squeeze mode, and vice versa, as many times as necessary as well conditions change. The present invention is directed to a single-trip tool which can perform both circulating and squeeze gravel packs without the necessity of tripping out of the hole for changes to the gravel pack assembly. Thus, the gravel pack assembly is capable of being reciprocated between circulating and squeeze positions while in the hole. A squeeze pack can be performed without having to use the blow-out preventers to close the annulus at the surface. In one embodiment of the invention, a fluid control check valve is utilized in a circulating squeeze which eliminates fluid loss to the formation when the carrier fluid is reversed out of the hole. The invention does not depend upon the presence of seating nipples in the existing tubing string for anchoring the assembly in the well. Furthermore, since the gravel pack assembly of the present invention can be run on coiled tubing string, a gravel pack can be conducted without the necessity of an expensive drilling or completion rig.

SUMMARY OF THE INVENTION

The present invention, in one aspect, is directed to a through tubing gravel pack assembly which is capable of being run on a coiled tubing string inside an existing tubing string for repairing a pre-existing gravel pack. The through tubing gravel pack system comprises a hydraulically releasable running tool and service assembly, a hydraulically set through tubing packer assembly and a crossover sleeve and sliding sleeve valve assembly. The gravel pack assembly is designed to be shiftable between a circulating mode and a squeeze mode for conducting a circulating gravel pack and/or a squeeze gravel pack without having to trip the assembly out of the borehole or utilizing the blow-out preventers to accomplish a squeeze pack. In a preferred embodiment of the invention, the running tool and service assembly includes a fluid control check valve. After completing the gravel pack, the check valve prevents fluids from falling back on the formation when excess slurry is reversed out of the running tool and service assembly.

The present invention, in another aspect, is directed to a method of gravel packing a wellbore which permits an operator to cycle back and forth between a circulating gravel pack and a squeeze pack as hole conditions dictate without having to trip out of the hole to change the gravel pack assembly or utilize blow-out preventers to accomplish a squeeze pack. More particularly, the present invention includes a method of gravel packing a wellbore through a production tubing string comprising the steps of running a through tubing gravel pack assembly inside the production tubing to a desired depth, the gravel pack assembly comprising a packer assembly, a crossover sleeve and sliding sleeve valve assembly connected to and extending beneath the packer, and a running tool and service assembly releasably connected to the packer assembly, setting the packer at the desired depth, releasing the running tool and service assembly from the packer assembly, reciprocating the running tool and service assembly relative to the packer assembly and crossover sleeve and sliding sleeve valve assembly in one longitudinal direction to a circulating position, displacing a gravel pack slurry to the gravel pack assembly and through slots in the sliding sleeve valve assembly to a slotted screen attached to the end of the gravel pack assembly, packing sand against the slotted screen, circulating the carrier fluid of an initial portion of the slurry through the slotted screen and up through the crossover sleeve, reciprocating the running tool and service assembly relative to the packer in another longitudinal direction to a squeeze position, squeezing the carrier fluid of a subsequent portion of the slurry into the formation, closing the slots in the sliding sleeve valve assembly, and retrieving the running tool and service assembly from the gravel pack assembly. In a preferred embodiment of the invention, the method includes reversing out excess slurry out of the running tool and service assembly whereby a fluid control check valve in the running tool and service assembly prevents excess slurry fluids from falling back on the formation.

BRIEF DESCRIPTION OF THE DRAWINGS

Other aspects and advantages of the invention will become apparent upon reading the following detailed description and upon reference to the drawings in which:

FIGS. 2A–G illustrate successive portions, in vertical sections, of the through tubing gravel pack system in the circulating position while FIGS. 2A'–G' illustrate successive portions, in vertical sections, of the through tubing gravel pack system in the squeeze position.

FIG. 4 is a cross section of a through tubing gravel pack assembly taken along line A-A' of FIG. 1D through slots 320, 325, 330 and passageways 360.

FIGS. 12A–J illustrate successive portions, in vertical sections, of the through tubing gravel pack system in the producing position.

FIG. 13 is a cross section of the through tubing gravel pack assembly taking along a line B-B' of FIG. 8F through slots 465, 470, 505, and passageways 475 of the assembly.

FIG. 14 illustrates a plan view of the lockout collet of the through tubing gravel pack assembly of FIGS. 6H–J.

Figure 1A:
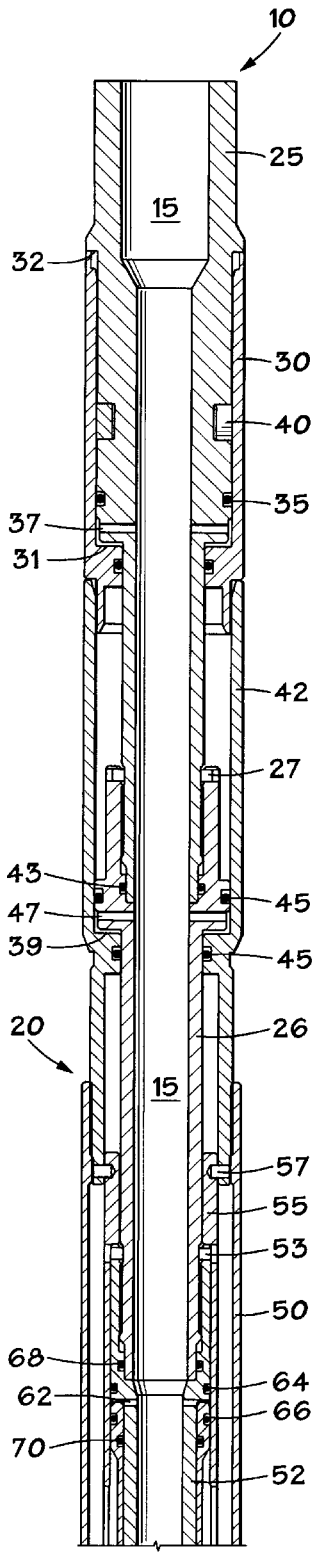
FIGS. 1A–F illustrate successive portions, in vertical sections, of a through tubing gravel pack system in the running position.

While the invention is susceptible to various modifications and alternative forms, specific embodiments thereof have been shown by way of example in the drawings and will herein be described in detail. It should be understood, however, that the specification is not intended to limit the invention to the particular forms disclosed herein, but on the contrary, the invention is to cover all modifications, equivalencies, and alternatives falling within the spirit and scope of the invention, as described by the appended claims.

DETAILED DESCRIPTION OF THE INVENTION

Referring to the drawings, and in particular, to FIGS. 1A–F, inclusive, there is shown one embodiment of a through tubing gravel pack system 10, which is of substantial length necessitating that it be shown in six longitudinally broken sectional views, viz. FIGS. 1A through 1F. Each of the views is shown in longitudinal sections extending from the center line (represented by a dashed line) of the through tubing gravel pack system 10 to the outer periphery thereof. The through tubing gravel pack assembly 10 consists of running tool and service assembly 20, packer assembly 100, and crossover sleeve and sliding sleeve valve assembly 300.

Gravel pack assembly 10 has passageway 15 extending longitudinally therethrough. As shown in FIGS. 1A–F, running tool and service assembly 20 includes, among other components, top sub 25, intermediate sub 26, mandrel 52, bottom sub 80, spacer tube 205, gravel pack sleeve 370, ball seat 371, lock sleeve 395, wash pipe (not shown), upper piston 30, lower piston 42, adapter 50, running collet 55, support sub 60, and retainer 75. Top sub 25 is adapted at its upper end to be connected to a coiled tubing string. Top sub 25 is threadedly connected to the top end of intermediate sub 26. A plurality of set screws 27 rotationally secure the connection between top sub 25 and intermediate sub 26. Upper piston 30 is coaxially arranged for longitudinal movement about top sub 25. The upper end of upper piston 30 abuts shoulder 32 of top sub 25 when gravel pack assembly 10 is in the running position. A plurality of pressure ports 37 extend radially through top sub 25. Passageway 15 is therefore in communication with upper piston 30 through pressure ports 37. Top sub 25 and upper piston 30 include recesses for seals 35, which seal the area above and below pressure ports 37 along the top sub and upper piston. Seals 35 are preferably elastomeric O-ring seals.

Spring loaded snap ring 40 is located in an annular recess in the outer diameter of top sub 25. Upper piston 30, as illustrated in FIG. 1A, maintains snap ring 40 in its closed position while the gravel pack assembly is in the running position.

Lower piston 42 abuts the lower end of upper piston 30. Lower piston 42 is coaxially arranged for longitudinal movement about the lower end of top sub 25 and intermediate sub 26. Seal 43 is located in an annular recess in the inner diameter of intermediate sub 26 and provides a seal in the connection between intermediate sub 26 and top sub 25. A plurality of pressure ports 47 extend radially through intermediate sub 26. Pressure ports 47 provides communication between passageway 15 and lower piston 42. Intermediate sub 26 and lower piston 42 include recesses for seals 45, which seal the area above and below pressure ports 47 along the intermediate sub and lower piston. Seals 43 and 45 are preferably elastomeric O-ring seals.

Adapter 50 is fixedly attached to the outer diameter of the lower end of lower piston 42 for longitudinal movement with lower piston 42. Mandrel 52 is threadably attached to the lower end of intermediate sub 26. A plurality of set screws 53 prevent mandrel 52 from unscrewing from intermediate sub 26. Running collet 55 is connected to the internal surface of the lower end of piston 42 by a plurality of shear screws 57. Running collet 55 is coaxially arranged about the lower end of intermediate sub 26 and the upper portion of mandrel 52. Running collet 55 includes a plurality of longitudinally extending, flexible arm members which terminate at radially extending fingers 59. In the running position, illustrated in FIG. 1B, the inner diameter of fingers 59 is supported by shoulder 61 of support sub 60. Support sub 60 is coaxially arranged for longitudinal movement between the intermediate portion of mandrel 52 and running collet 55. Mandrel 52 includes a plurality of radially extending pressure ports 62 which communicate with passageway 15. Seal 64 is located in an annular recess in the outer diameter of mandrel 52 above pressure ports 62, and provides a seal between mandrel 52 and running collet 55. Seal 68 is located in an annular recess in the inner diameter of mandrel 52 above pressure ports 62 and provides a seal between mandrel 52 and intermediate sub 26. The upper piston portion of support sub 60 includes annular recesses for seals 66 and 70. Seal 66 provides a seal between the inner diameter of running collet 55 and support sub 60. Seal 70 provides a seal between mandrel 52 and support sub 60. Preferably, seals 64, 66, 68, and 70 are elastomeric O-ring seals.

Figure 1B:
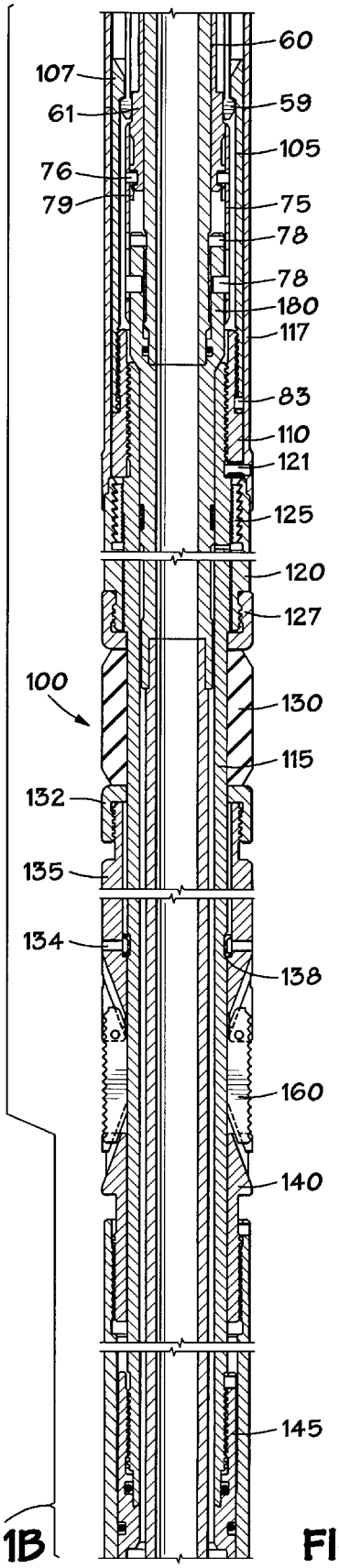

The lower end of support sub 60 is attached to retainer 75 by a plurality of shear screws 76 as illustrated in FIG. 1B. Retainer 75 is fixedly attached at its lower end by a plurality of set screws 78 to the upper portion of bottom sub 80. As illustrated in FIG. 1B, the upper end of bottom sub 80 is longitudinally spaced from the lower end of support sub 60, with retainer 75 bridging the gap between the two longitudinally extending members.

Figure 1C:
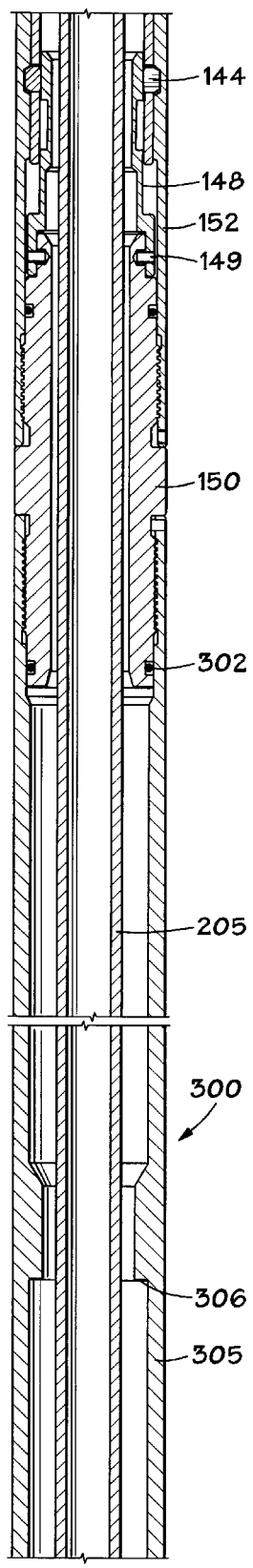
Figure 1D:
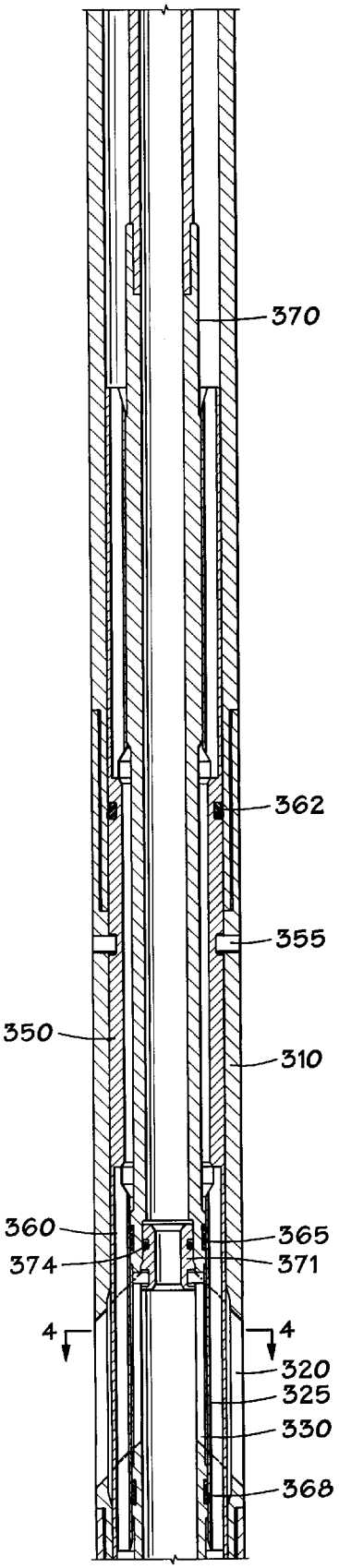

As shown in FIGS. 1B–C, packer assembly 100 includes, among other components, top sub 105, packer setting sleeve 117, bushing 110, lock ring 125, lock ring housing 120, gage rings 127 and 132, packing element 130, mandrel 115, upper cone 135, slips 160, lower cone 140, lock sub 145, locking dogs 147, release sleeve 152, spacer 152 and bottom sub 150. Packer assembly 100 is connected to running tool and service assembly 20 by top sub 105. Top sub 105 includes at its upper end an internal fishing neck 107 which engages radially extending fingers 59 of running collet 55 of the running tool, thereby releasably securing the packer to the running tool. Top sub 105 is threadedly connected at its lower end to bushing 110. The internal diameter of bushing 110 is, in turn, threadedly connected to the upper end of packer mandrel 115. Packer setting sleeve 117 is coaxially arranged for longitudinal movement about top sub 105 and bushing 110. The upper end of packer setting sleeve 117 abuts against the lower end of adapter 50 of the running tool and service assembly. The lower end of setting sleeve 117 is attached to bushing 110 by one or more shear screws 121. The internal diameter of the upper end of lock ring housing 120 has teeth cut into it which interact with mating teeth on the outer diameter of lock ring 125. The internal diameter of lock ring 125 is threaded. The threads on lock ring 125 are compatible with the threads on the outer diameter of packer mandrel 115, located intermediate to the upper threaded end of mandrel 115 and upper gauge ring 127. Alternatively, the internal diameter of lock ring 125 may be serrated and compatible with mating serrations on the outer diameter of packer mandrel 115.

An elastomeric packing element 130 surrounds mandrel 115 and is confined between gauge rings 127 and 132. Gauge ring 127 is threadedly connected to the lower end of lock ring housing 120. Gauge ring 132 is threadedly connected to the upper end of upper cone 135. Gauge rings 127 and 132 have outer diameters substantially the same or greater than the diameter of packing element 130 when packing element 130 is in its unenergized condition. The lower end of upper cone 135 includes a downwardly and outwardly facing tapered surface. Upper cone 135 is attached to packer mandrel 115 by a plurality of shear screws 137. Pickup rings 138 are located inwardly about the head of shear screws 137 and prevent the accidental resetting of packer 100 in the event that the packer is ever released and pulled out of the hole.

Packer mandrel 115 is threadedly connected on its lower end to lock sub 145. Lock sub 145 includes locking dogs 147 which extend radially beyond the outer diameter of lock sub 145. Release sleeve 148 is fixedly attached by a plurality of shear screws 149 to the upper end of bottom sub 150 of the packer assembly. The upper portion of release sleeve 148 supports locking dogs 147 in their radially extending position. In the event that packer assembly 100 needs to be retrieved after it has been set, release sleeve 148 is moved longitudinally with respect to lock sub 145 until the external recess in release sleeve 148 is positioned opposite locking dogs 147, thereby allowing the locking dogs to retract from their radially extending position. Spacer 152 is threadedly attached to the upper portion of bottom sub 150 and extends coaxially about locking sub 145 and the lower end of mandrel 115. The upper end of spacer 152 is threadedly attached to lower cone 140. The upper end of lower cone 140 has an upwardly and outwardly facing tapered surface. Slips 160 extend circumferentially about packer mandrel 115 between the tapered surfaces of upper cone 135 and lower cone 140.

Spacer tube 205 is connected at its upper end to the lower end of bottom sub 80 of running tool and service assembly 20. Spacer tube 205 extends through the bore of packer 100 and into the crossover sleeve and sliding sleeve valve assembly 300. The crossover sleeve and sliding sleeve valve assembly of FIGS. 1C–F includes, among other components, spacer joint 305, completion sleeve 310, crossover sleeve 350, closing sleeve 385, lower extension 340 and gravel pack screens (not shown). Spacer joint 305 is threadedly connected to the lower portion of bottom sub 150 of packer 100. An annular recess is cut in the outer diameter of the lower portion of bottom sub 150 which holds seal 302. Seal 302, preferably an elastomeric O-ring seal, provides a seal between the spacer joint 305 and bottom sub 150. Completion sleeve 310 is threadedly attached to the lower end of spacer joint 305. Completion sleeve 310 includes a plurality of longitudinally extending slots 320 spaced circumferentially about the sleeve. Slots 320 provide passageways through the wall of completion sleeve 310. Attached to the lower end of completion sleeve 310 is lower extension 340. Gravel pack screens, as commonly known in the industry, are attached to the lower end of lower extension 340 (not shown).

Crossover sleeve 350 is coaxially arranged with and attached by a plurality of shear screws 355 to the inner diameter of completion sleeve 310. Crossover sleeve 350 includes a plurality of slots 325, which are spaced circumferentially about the crossover sleeve. Slots 325 provide passageways radially through the wall of crossover sleeve 350 and preferably are aligned with slots 320 of completion sleeve 310. Crossover sleeve 350 also includes a plurality of passageways 360 which extend longitudinally through substantially the entire length of crossover sleeve. Passageways 360 are spaced circumferentially about the crossover sleeve and are positioned between slots 325 as shown in FIG. 4. Seal 362, located in an external groove in crossover sleeve 350, provides a seal between the crossover sleeve 350 and spacer joint 305. Seal 362 is preferably an elastomeric seal.

Gravel pack sleeve 370 is threaded onto the bottom of spacer tube 205. Gravel pack sleeve 370 is coaxially arranged for telescoping longitudinal movement within crossover sleeve 350. Gravel pack sleeve 370 extends through crossover sleeve 350 and into closing sleeve 385. Gravel pack sleeve 370 includes a plurality of upper slots 330 spaced about the circumference of the intermediate portion of the sleeve. Slots 330 provide passages radially through the gravel pack sleeve and preferably are aligned with slots 325 and 320 when the gravel pack assembly is in the running and squeeze positions. Seals 365 and 368 are located in external grooves in the outer diameter of sleeve 370 and provide a seal between sleeve 370 and crossover sleeve 350 above and below slots 330, respectively.

Preferably, seals 365 and 368 are elastomeric seals. Ball seat 371 is connected by a plurality of shear pins 372 to the internal diameter of gravel pack sleeve 370 above slots 330. Ball seat 371 provides a seating surface for receiving a ball to seal passageway 15. Seal 374, preferably an elastomeric O-ring seal, seals the surface between ball seat 371 and the internal diameter of gravel pack sleeve 370 adjacent thereto.

Figure 1E:
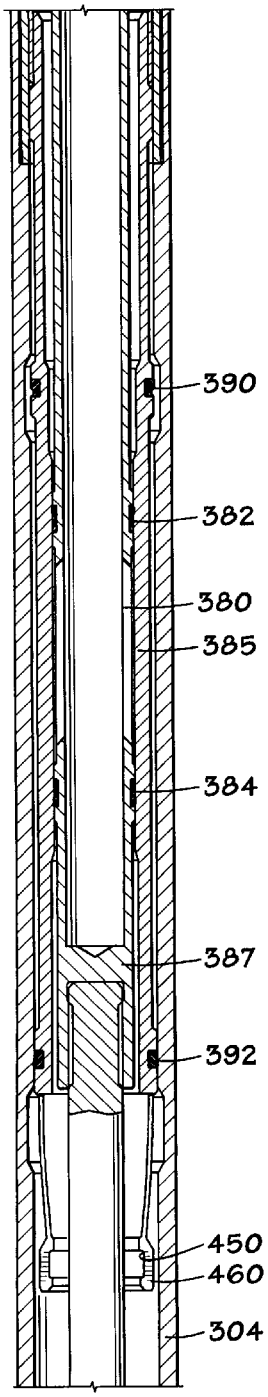
Figure 1F:
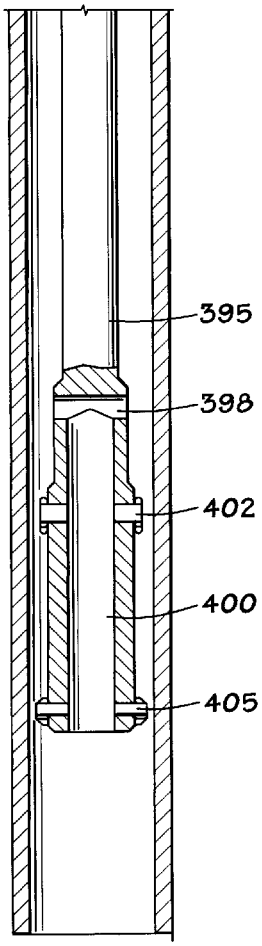

Gravel pack sleeve 370 includes a lower set of longitudinally extending slots 380 which extend circumferentially about and through the gravel pack sleeve. Slots 380 provide passages radially through the gravel pack sleeve. Slots 380 are preferably aligned with slots 325 and 320 when the gravel pack assembly is in the circulating position. Seals 382 and 384 are located in external grooves in the gravel pack sleeve and provide a seal between the gravel pack sleeve and closing sleeve 385 above and below slots 380, respectively. Seals 382 and 384 are preferably elastomeric seals. Gravel pack sleeve 370 includes solid plug 387 located approximate its lower end. Closing sleeve 385 is coaxially arranged for telescoping longitudinal movement within lower extension 340 and completion sleeve 310. Closing sleeve 385 surrounds the lower portion of gravel pack sleeve 370 when the gravel pack assembly is in the running position. Closing sleeve 385 is attached at its upper end to the lower end of crossover sleeve 350. Seals 390 and 392 are located in recesses in the outer diameter of closing sleeve 385. Seals 390 and 392 are preferably elastomeric seals. As illustrated in FIG. 1E, seal 392 seals the annular space between lower extension 340 and closing sleeve 385.

Attached to the lower end of gravel pack sleeve 370 is lock sleeve 395. Lock sleeve 395 includes a plurality of radially extending ports 398 which are connected to a central passageway 400 extending longitudinally through the lower end of lock sleeve 395. Although not illustrated, wash pipe is preferably connected to the end of lock sleeve 395 and extends inside lower extension 340 to the gravel pack screen. The wash pipe provides a means for conveying the carrier fluid, or return fluid, in a circulating gravel pack back to the service assembly, where it is conveyed on to the annulus above the packer.

Gravel pack assembly 10 is preferably adapted to be run on coiled tubing. As a result, gravel pack assembly 10 is well-suited for remedial repairs of pre-existing gravel pack completions. To repair an existing gravel pack, the assembly is run on a coiled tubing string inside the existing production tubing of the well until the gravel pack screens are positioned in close proximity to the existing gravel pack screens. While the gravel pack assembly is well-suited for remedial repairs of pre-existing gravel pack completions, the assembly may also be utilized in wells that have not previously been gravel packed. Because the invention is designed to be run on coiled tubing from a coiled tubing unit, the well can be gravel packed without having to remove the existing production tubing from the well. Therefore, an operator can re-gravel pack a well or gravel pack a well for the first time without having to employ a drilling or work over rig. This results in significant cost savings to the operator and allows the operator to gravel pack marginal wells that previously would have been economically unfeasible.

Figure 2C:
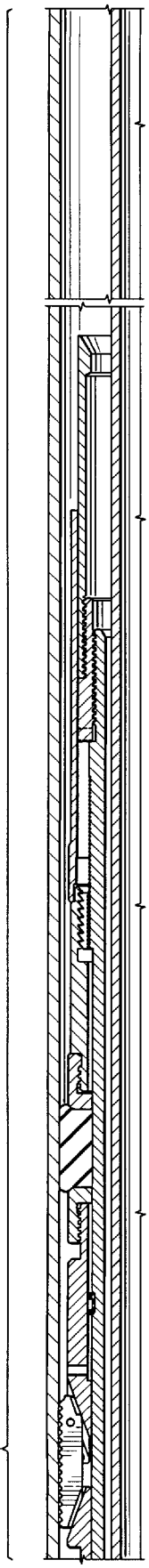
Figure 2C:
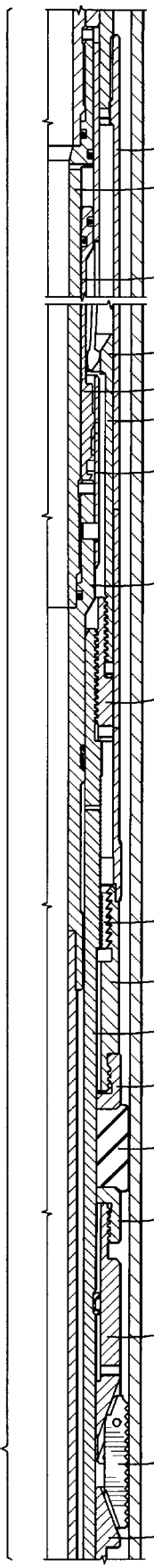
Figure 2D:
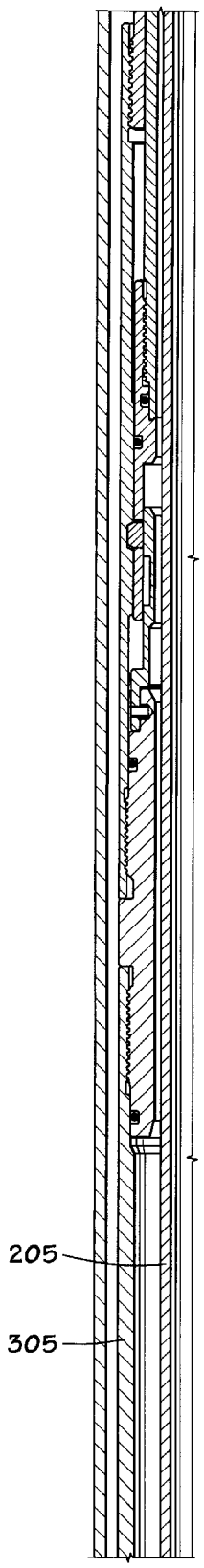
Figure 2D:
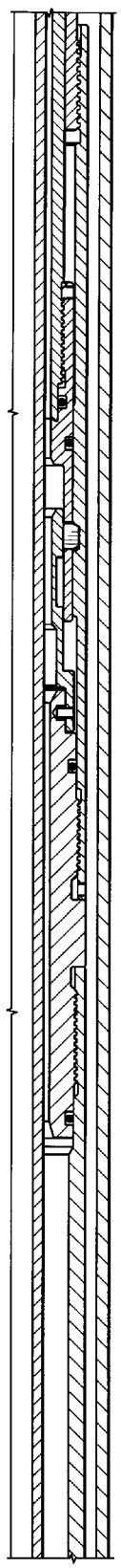

In a preferred method of gravel packing a well, gravel pack assembly 10 is run on a coiled tubing string into the wellbore through the existing production tubing to the desired depth. At the desired depth, the packer 100 is hydraulically set by dropping or displacing a ball from the surface through the coiled tubing and into passageway 15 of gravel pack assembly 10 until the ball lands on ball seat 371. After the ball has seated and sealed passageway 15 of the gravel pack assembly, pressure is applied to the coiled tubing and passageway 15. The internal pressure communicates through pressure ports 37 and 47 and exerts a force on piston surfaces 31 and 39 of upper piston 30 and lower piston 42, respectively. Pressure is increased until the combined force acting on the upper and lower pistons exceeds the strength of shear screws 57. After shear screws 57 are sheared, the force exerted by the upper and lower pistons is transferred through adapter 50, packer setting sleeve 117, lock ring housing 120, the upper and lower gauge rings, and upper cone 135 until the force exceeds the strength of shear screws 137. After shear screws 137 are sheared, the upper and lower pistons travel longitudinally downward along top sub 25 and intermediate sub 26. This downward movement is transferred through adapter 50 to packer setting sleeve 117. The downward movement of packer setting sleeve 117 in turn moves lock ring housing 120 relative to packer mandrel 115. This movement causes the inward facing surfaces of slips 160 to ride up the outward facing surfaces of upper cone 135 and lower cone 140 causing the slips to radially extend and engage production tubing 452, as illustrated in FIG. 2C. In the set position, slips 160 will support the weight of the packer assembly, the crossover sleeve and sliding sleeve valve assembly and gravel pack screens.

Increasing the internal pressure in the coiled tubing string and gravel pack assembly causes lock ring housing 120 to continue its downward movement relative to mandrel 115 until packing element 130 is compressed and energized. When fully energized, the packing element will radially extend to the internal diameter of tubing 452, thereby packing off or sealing the annulus between tubing 452 and the gravel pack assembly. The threads on the internal diameter of lock ring 125 engaged the threads on the outer diameter of mandrel 115 to maintain packing element 130 in the energized state and to prevent setting sleeve 117 from moving upwards after pressure is released from the upper and lower pistons. Thus, lock ring 125 maintains the packer in the set position. Furthermore, when upper piston 30 moves down past snap ring 40, the spring loaded snap ring extends radially outward against the upper end of the upper piston as illustrated in FIG. 2A. In this position, snap ring 40 prevents upper piston 30 from moving back to its original position.

As described below, running tool and service assembly 20 is hydraulically released from packer 100 after the packer is set in the production tubing. Pressure applied to passageway 15 also communicates through pressure ports 62 in mandrel 52 and is exerted against the upper piston portion of support sub 60. Continuing to increase the internal pressure will increase the force exerted on the upper piston portion of support sub 60 until shear screws 76 are eventually sheared. After shear screws 76 are sheared, support sub 60 moves downward relative to running collet 55 towards bottom sub 80. As support sub 60 is displaced downward towards bottom sub 80, shoulder 61 moves beyond fingers 59 of running collet 55 allowing fingers 59 to move radially inward away from fishing neck 107 on top sub 105 of the packer. The mating surfaces of fingers 59 and fishing neck 107 are preferably tapered to facilitate the release of running collet 55 from top sub 105 when shoulder 61 is displaced beyond fingers 59. When support sub 60 moves toward bottom sub 80, collet 79 of retainer 75 engages the annular groove in the lower portion of support sub 60. As a result, retainer 75 retains support sub 60 in this downward position thereby preventing fingers 59 of running collet 55 from re-engaging with fishing neck 107 of the top sub of the packer. Once this occurs, the running tool and service assembly is no longer secured to packer assembly 100. As a result, the running tool and service assembly 20 can be manipulated longitudinally within the packer assembly and the crossover sleeve and sliding sleeve valve assembly without re-engaging the running tool and service assembly to the packer.

Once the packer is set and the running tool and service assembly is disengaged from the packer assembly, an operator can cycle the gravel pack assembly between a circulating position and a squeeze position as many times as desired by picking up or slacking off on the coiled tubing string. The longitudinal movement of the coiled tubing causes the running tool and service assembly to move longitudinally relative to the crossover sleeve and sliding sleeve valve assembly, from the circulating position to the squeeze position. The ability to cycle between the circulating mode and the squeeze mode provides the operator with greater flexibility during a gravel pack job and allows the operator to immediately shift between circulating and squeeze position, or vice versa, as well conditions dictate.

Operationally, FIGS. 2A–G illustrate the circulating position of gravel pack assembly 10. FIGS. 2A'–G' illustrate the gravel pack assembly in the squeeze position. To perform a circulating gravel pack, the coiled tubing string is raised at the surface which causes running tool and service assembly 20 to move upward relative to the packer assembly and the crossover sleeve and sliding sleeve valve assembly. The upward movement of the running tool and service assembly 20 moves gravel pack sleeve 370 and lock sleeve 395 upwards until shear ring 402 abuts against the shoulder 410 on closing sleeve 385. When shear ring 402 contacts shoulder 410, lower slots 380 of gravel pack sleeve 370 will be positioned adjacent slots 325 and 320 of crossover sleeve 350 and completion sleeve 310, respectively. Seals 382 and 384 seal the annular space above and below slots 380 between gravel pack sleeve 370 and crossover sleeve 350. Seals 365 and 368 seal the annular space between gravel pack sleeve 370 and crossover sleeve 350 above and below slots 330 when gravel pack assembly 10 is in the circulation position.

Once in the circulating position, the gravel pack slurry is displaced down the coiled tubing string, through passageway 15 of the gravel pack assembly and into the bore of gravel pack sleeve 370. From there the slurry passes through slots 380 of gravel pack sleeve 370, through slots 325 of crossover sleeve 350, through slots 320 of completion sleeve 310 and down the annular space 311 between the internal diameter of production tubing 452 and the outer diameter of the gravel pack assembly as shown in FIG. 2F. The slurry continues down the annular space past the lower extension 340 to the gravel pack screens (not shown). As the slurry reaches the screens, the sand or gravel carried by the gravel pack slurry will be deposited about the screens and the carrier fluid of the slurry will pass through the screens and will return up the internal passageway of the wash pipe (not shown), into passageway 400 and out ports 398 of lock sleeve 395 as shown by the arrows in FIG. 2F.

Figure 2E:
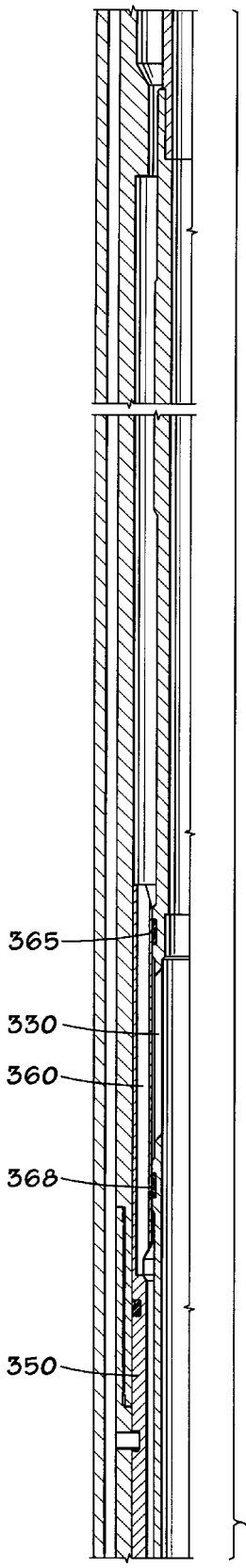
Figure 2E:
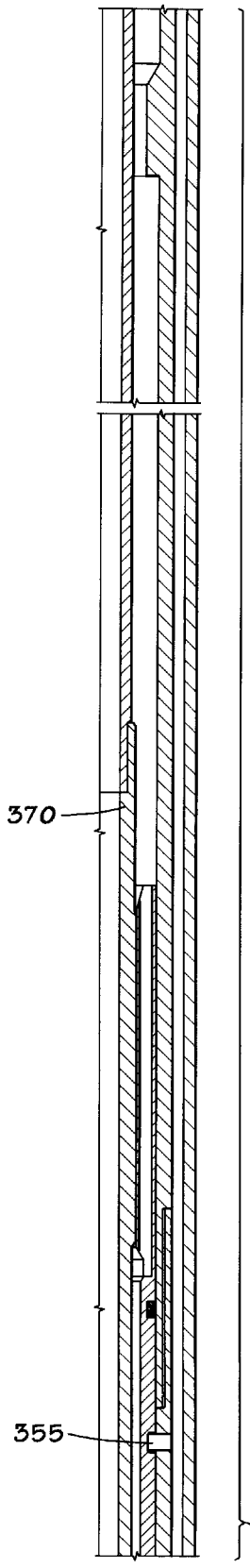
Figure 2F:
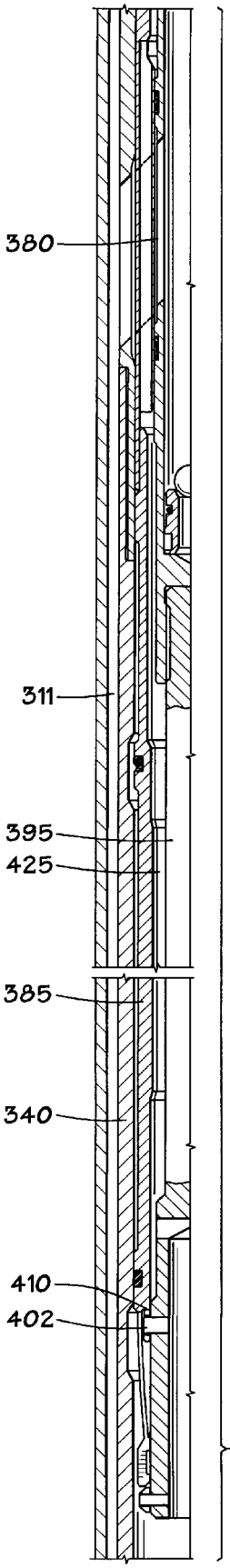
Figure 2F:
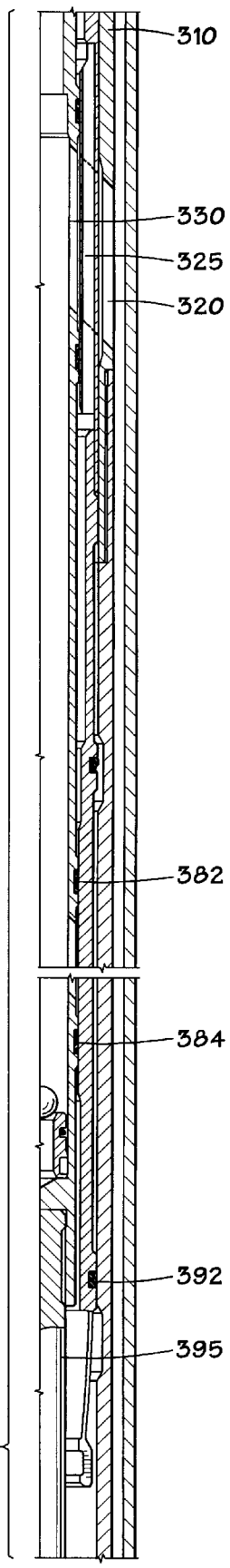
Figure 2G:
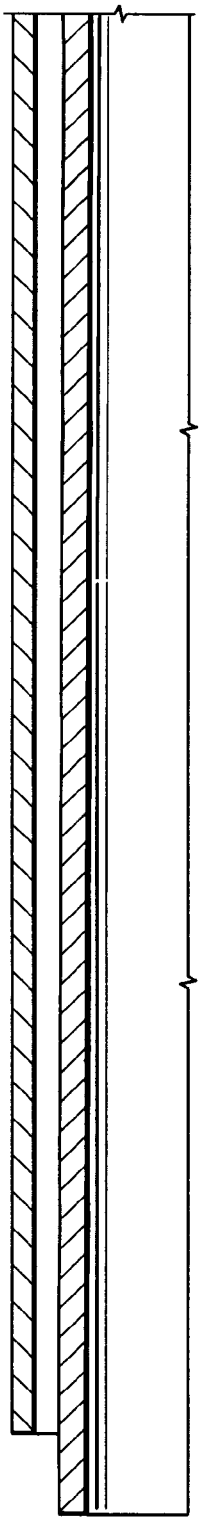
Figure 2G:
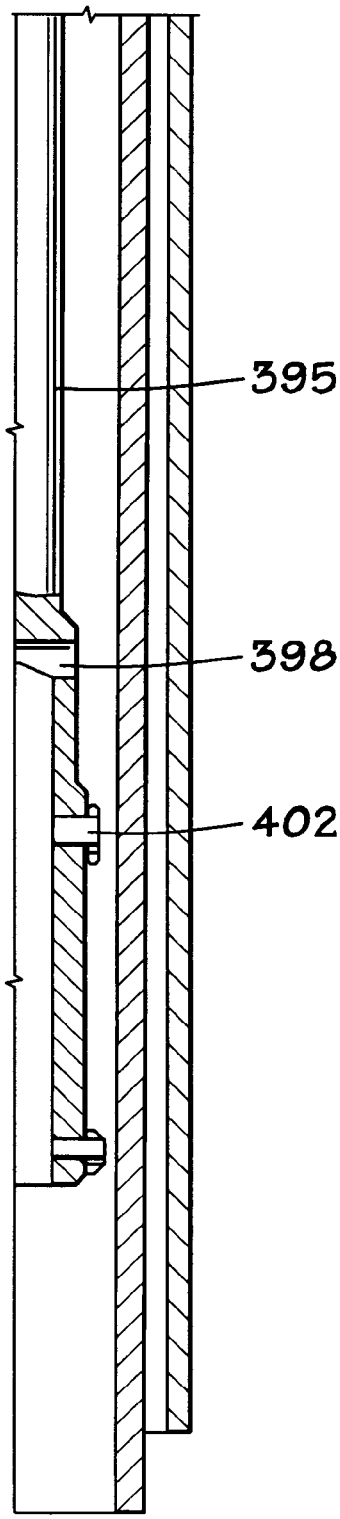

Carrier fluid will continue through the passageway 425 between locking sleeve 395 and closing sleeve 385 and will enter into and pass through the longitudinal passageways 360 of crossover sleeve 350, as illustrated in FIGS. 2E and F. After passing through the longitudinal passageways of the crossover sleeve, the carrier fluid will travel up the annular passageway between spacer tube 205 and spacer joint 305 and continue through the annular passageway between spacer tube 205 and the internal diameter of packer mandrel 115. Packer mandrel 115 thus serves as a conduit for the return flow of the carrier fluid. Once it clears the packer, the carrier fluid will return up the annular space between the running tool/coiled tubing and production tubing 452 until it reaches the surface.

If during the gravel pack job, the operator wishes to perform a squeeze pack, the operator will lower the coiled tubing string at the surface, thereby lowering the running tool and service assembly 20 into the squeeze position, as shown in FIGS. 2A'–G'. Lowering the running tool and service assembly to the squeeze position will shift gravel pack sleeve 370 downward so that upper slots 330 are adjacent slots 325 and 320 of crossover sleeve 350 and completion sleeve 310, respectively. The gravel pack slurry is displaced down the coiled tubing string, through passageway 15 and into the bore of gravel pack sleeve 370. The slurry will pass through slots 330 of the gravel pack sleeve 370, through slots 325 of crossover sleeve 350, through slots 320 of completion sleeve 310, and will continue down the annular space between tubing 452 and lower extension 340 until it reaches the gravel pack screens. As the slurry reaches the gravel pack screens, the sand or gravel of the slurry is deposited about the screens. However, since seals 382 and 384 on gravel pack sleeve 370 are in sealing contact with the internal seal surface of closing sleeve 385, the carrier fluid does not have a passageway back up through the gravel pack assembly. Accordingly, the carrier fluid is displaced through the perforations and into the formation after the sand or gravel is deposited about the slotted screens. The squeeze pack is continued until the operator cycles the running tool and service assembly back to the circulating position or the displacement or squeeze pressure reaches a predetermined upper limit. As can be readily understood, the present invention allows the operator to cycle between a circulating gravel pack and a squeeze gravel pack as many times as the well conditions require by simply reciprocating the coiled tubing string at the surface.

Figures 3A, 3B, 3C:
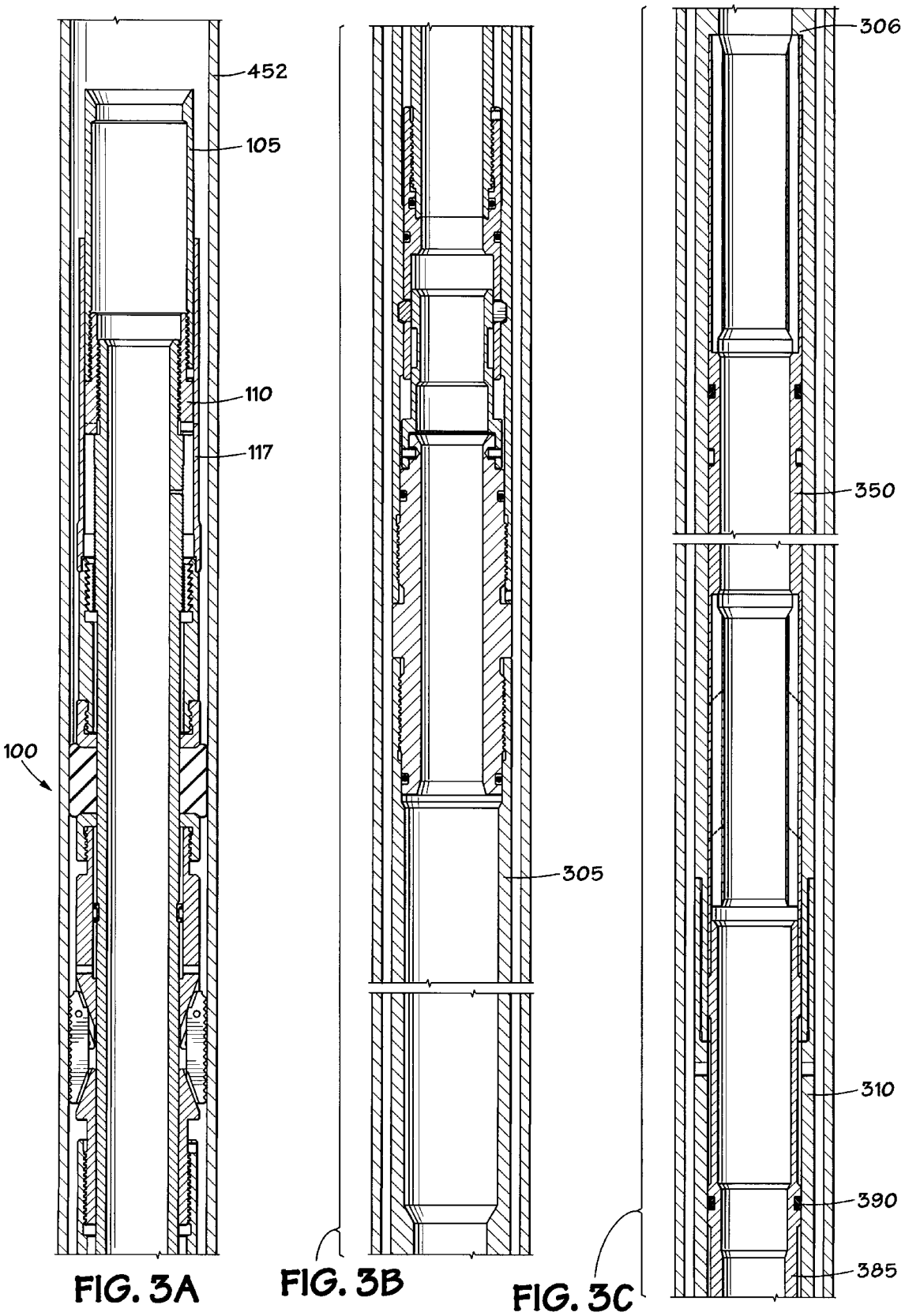
FIGS. 3A–E illustrate successive portions, in vertical sections, of the through tubing gravel pack system in the producing position.
Figure 3D:
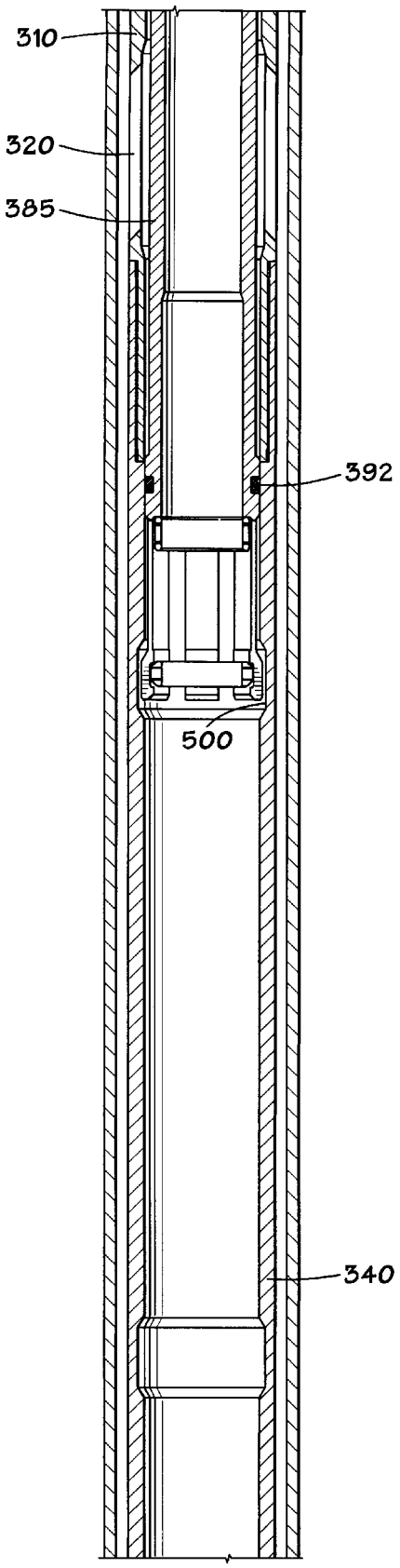
Figure 3E:
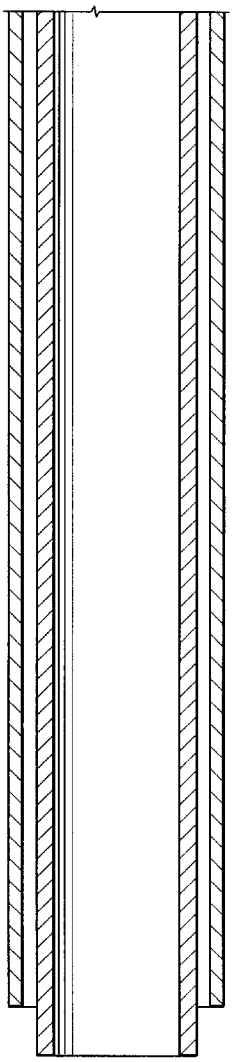

Upon completion of the gravel pack job, the running tool and service assembly 20 is removed from the borehole. This accomplished by the following steps. The coiled tubing string is lifted until shear ring 402 abuts shoulder 410 of closing sleeve 385. Additional upward force on the coiled tubing shear screws 355, shifting closing sleeve 385 and crossover sleeve 350 up across slots 320 in completion sleeve 310, until crossover sleeve 350 abuts shoulder 306 in spacer joint 305. This aligns fingers 460 of the lower end of closing sleeve 385 with groove 500 in lower extension 340 and snap ring 405 will expand finger 460 into groove 500. Snap ring 405 is shear pinned to the end of lock sleeve 395. Accordingly, an additional upward force on the running tool and service assembly will shear the shear pins and leave snap ring 405 in groove 450, thereby permanently locking closing sleeve 385 in the closed position as illustrated in FIGS. 3C–D. Seals 392 and 390 of closing sleeve 385 seal slot 320 in completion sleeve 310 from production fluids.

At this point, the operator can remove the running tool and service assembly from the wellbore, leaving behind the packer assembly and crossover sleeve and sliding sleeve valve assembly in the wellbore. Wellbore fluids can then be produced through the new gravel pack, through the bore of the crossover sleeve and sliding sleeve valve assembly 300 and packer assembly 100, and through the remaining portion of production tubing 452 as illustrated in FIG. 5.

Figure 5:
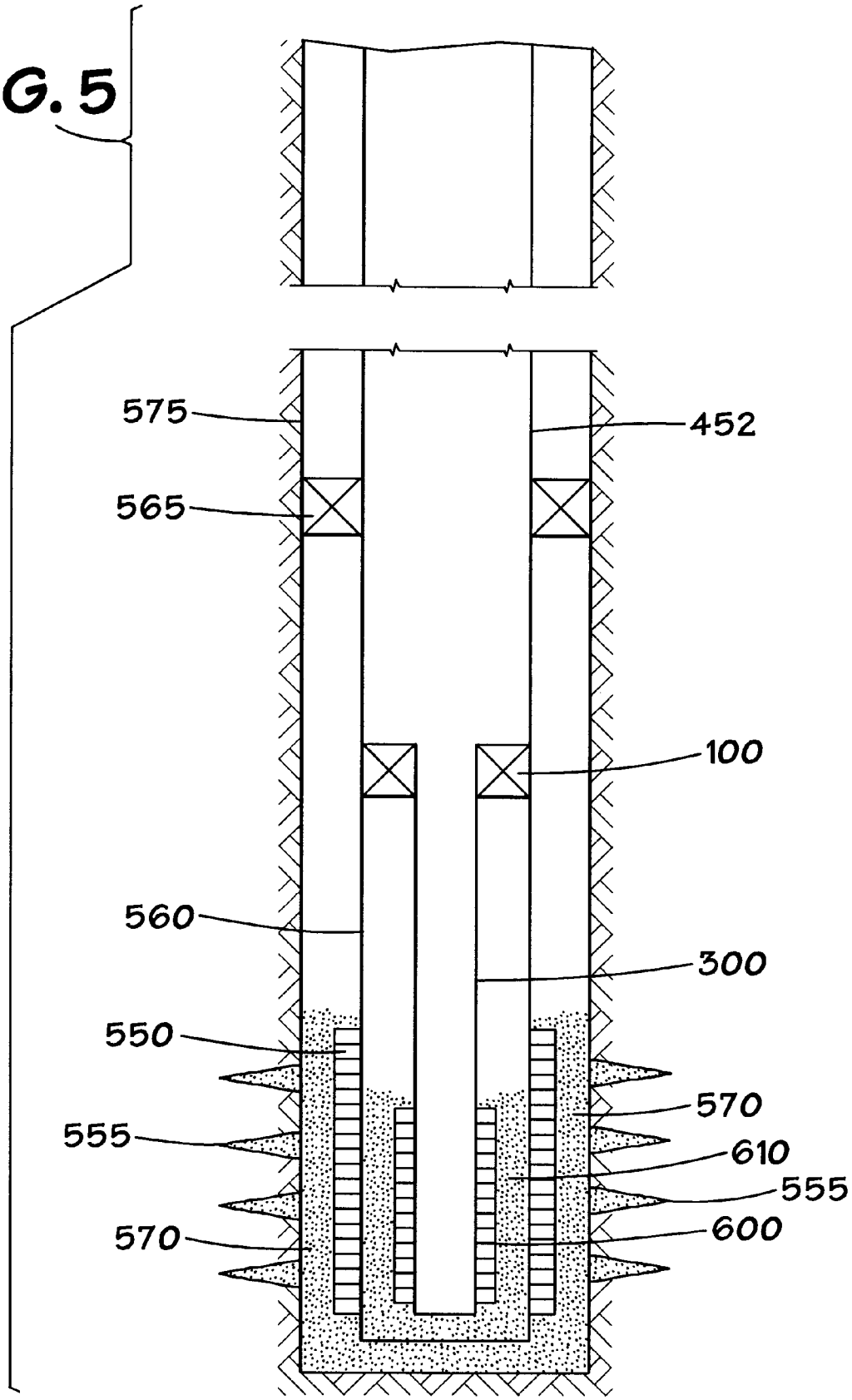
FIG. 5 illustrate a wellbore that has had its original gravel pack repaired by the through tubing gravel pack system of the present invention.

FIG. 5 illustrates how the through tubing gravel pack system of the present invention can repair an older, impaired gravel pack. As can be seen in the FIG. 5, original gravel pack screens 550 are positioned adjacent perforations 555. Perforations 555 extend through casing 575 and provide a means for allowing reservoir fluid, such as oil and gas, to flow into the wellbore from a subterranean formation. Gravel pack screens 550 extend from original gravel pack completion assembly 560 which included packer 565. Packer 565 sealed the annular space between casing 575 and production tubing 452. By way of example, casing 575 may be 7 inches in diameter and tubing 452 may be 3½ inches in diameter. The annulus between perforations 555 and slotted screens 550 was originally packed with gravel or sand 570.

Once the original gravel pack deteriorated to a point where it was no longer effective to prevent the production of formation sand below an acceptable level, the through tubing gravel pack procedure as previously described was performed. FIG. 5 represents the wellbore after the running tool and service assembly has been retrieved from the well. Packer 100 is shown set inside production tubing 452. Crossover sleeve and sliding sleeve valve assembly 300 extends below packer 100. Through tubing gravel pack screens 600 are positioned in close proximity to original screens 550. The annulus between screens 600 and screens 550 is packed with gravel or sand 610. Production fluid thus enters the wellbore through perforations 555 and flows through original screens 550, through gravel or sand 610, through screens 600, and into the bore of the crossover sleeve and sliding sleeve valve assembly 300 where it continues to the surface through the bore of packer 100 and the bore of production tubing 452.

Another embodiment of a through tubing gravel pack system is shown in FIGS. 6A through L, inclusive, which is also of substantial length necessitating that it be shown in thirteen longitudinally broken sectional views, viz FIGS. 6A through 6L. Like parts to those numbered in FIGS. 1A–F will be similarly numbered with the addition of suffixes "a". Each of the views is shown in longitudinal sections extending from the center line (represented by a dash line) of the through tubing gravel pack system 10*a* to the outer periphery thereof. The through tubing gravel pack assembly consists of running tool and service assembly 21, packer assembly 100*a*, and crossover sleeve and sliding sleeve valve assembly 425. FIGS. 6A–L (collectively FIG. 6) illustrate the through tubing gravel pack assembly in the running position.

Crossover sleeve and sliding sleeve valve assembly 425 of FIG. 6 includes upper adapter 450, gravel pack sleeve 455, lower adapter 525, seal sub 575, gravel pack screens 580, bull plug 585, crossover sleeve 480, isolation sleeve 510 and lock out collet 520. The upper end of upper adapter 450 is threadedly attached to the lower portion of bottom sub 150*a* of packer assembly 100*a*. An annular recess is cut in the outer diameter of the lower portion of bottom sub 150*a* which holds seal 302*a*. Seal 302*a*, preferably an elastomeric o-ring seal, provides a seal between the upper adapter 450 and bottom sub 150*a*. Gravel pack sleeve 455 is fixedly attached about the lower portion of upper adapter 450. A pair of seals 451 provide a seal between gravel pack sleeve 455 and upper adapter 450. Gravel pack sleeve 455 includes a plurality of longitudinally extending slots 465 spaced circumferentially about the upper portion of the sleeve. Slots 465 provide passageways through the tubular wall of gravel pack sleeve 455. Gravel pack sleeve 455 includes one or more radially extending pressure equalization ports 485 which prevents a pressure lock from developing between the annular space between gravel pack sleeve 455 and crossover sleeve 480 and between seals 477 and 487. Gravel pack sleeve 455 also includes a plurality of longitudinally extending slots 495 spaced circumferentially about the lower portion of the sleeve. Slots 495 also provide passageways through the tubular wall of gravel pack sleeve 455. Lower adapter 525 is fixedly attached about the lower portion of gravel pack sleeve 455. An annular recess is cut in the inner diameter of lower adapter 525 to maintain seal 527. Seal 527, preferably an elastomeric seal, seals the connection between the lower adapter and gravel pack sleeve.

Figure 6A:
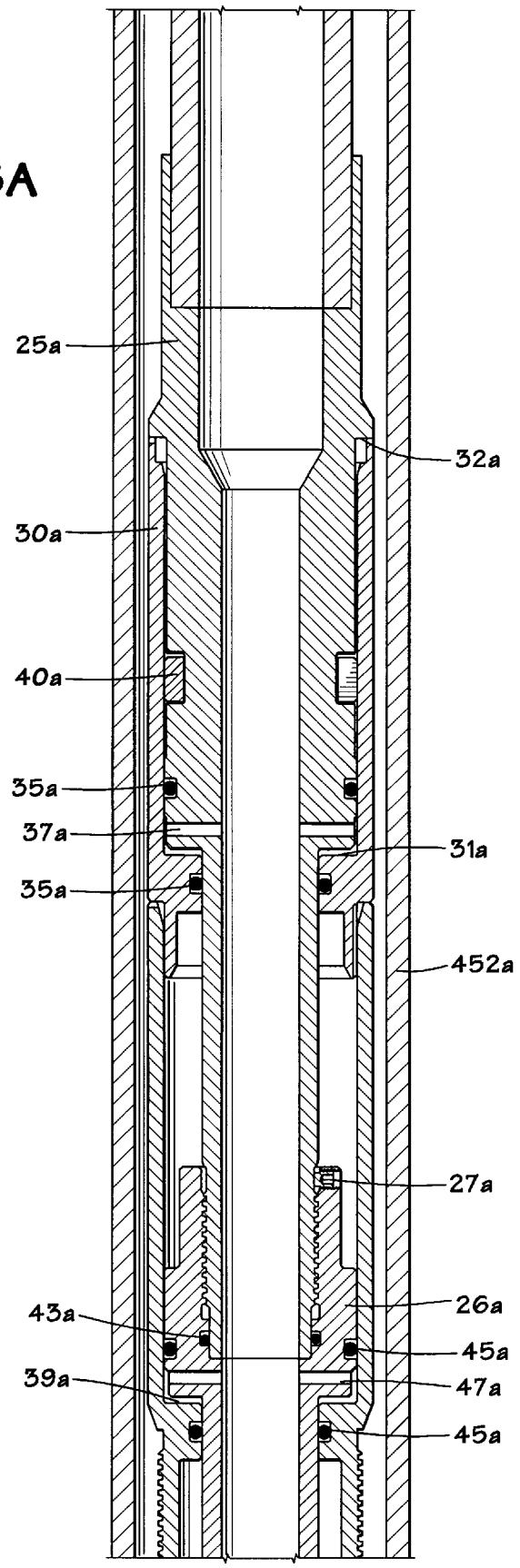
FIGS. 6A–L illustrate successive portions, in vertical sections, of a through tubing gravel pack system in the running position.
Figure 6B:
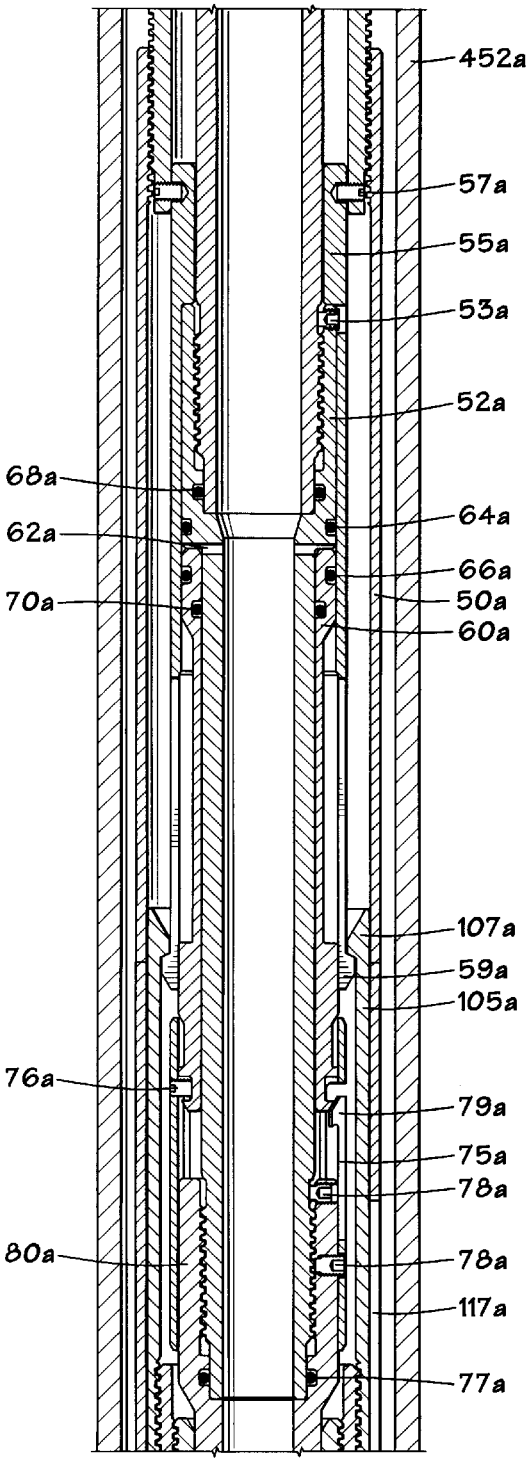
Figure 6C:
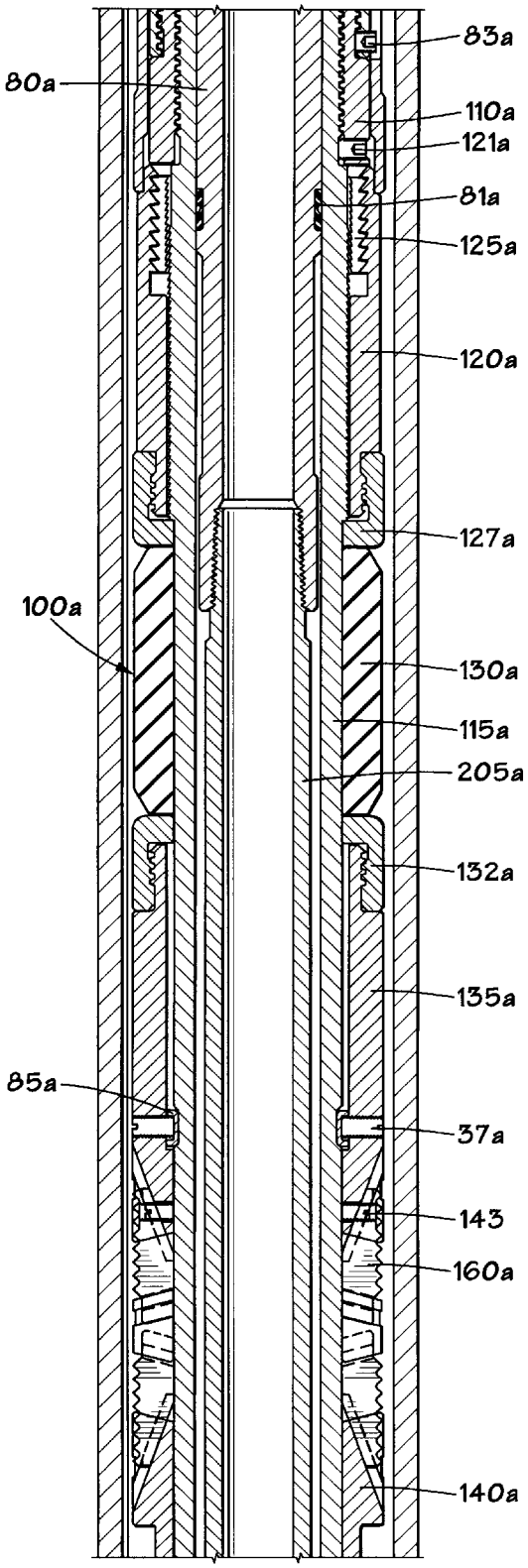
Figure 6D:
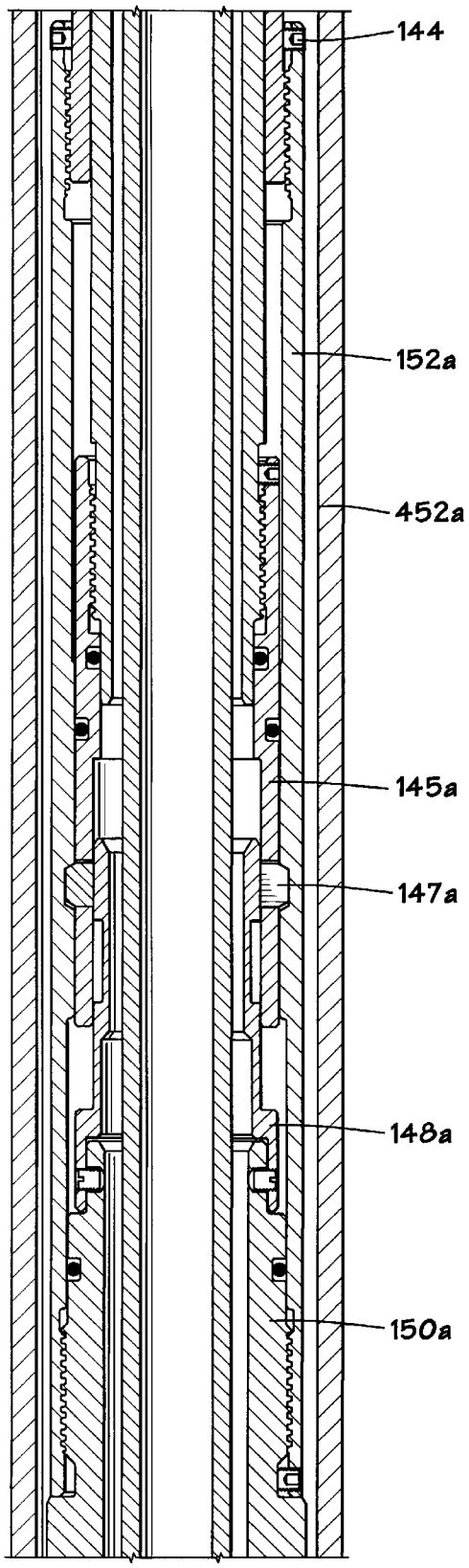
Figure 6E:
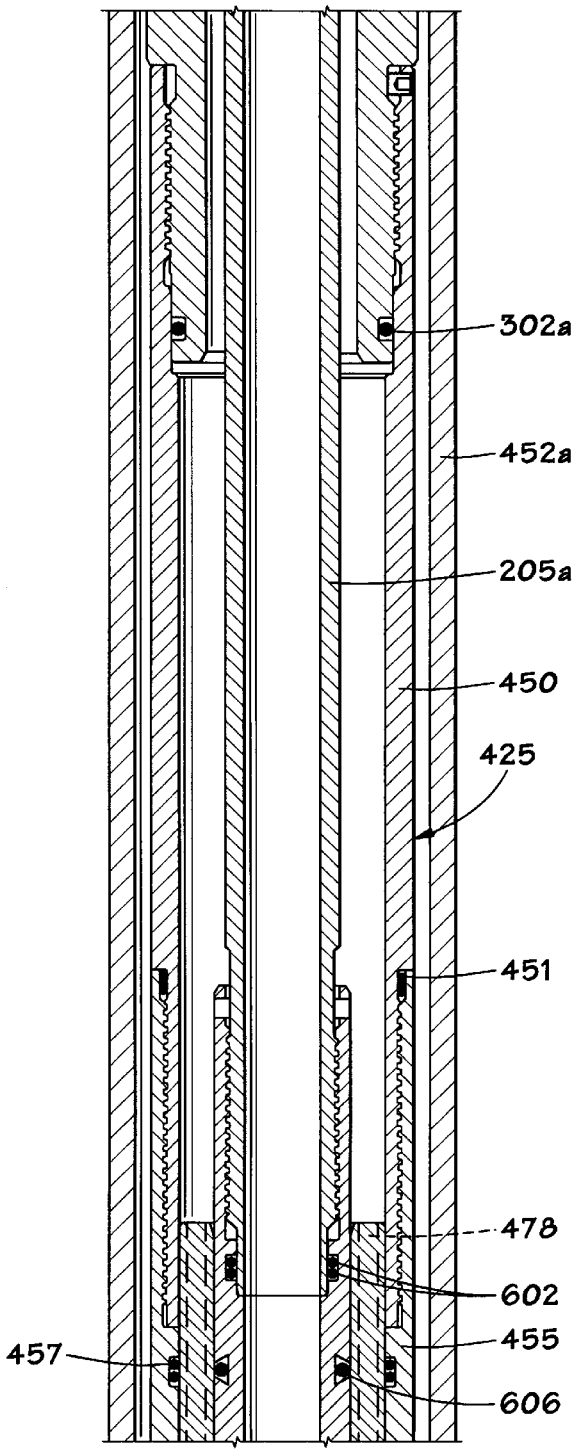
Figure 6F:
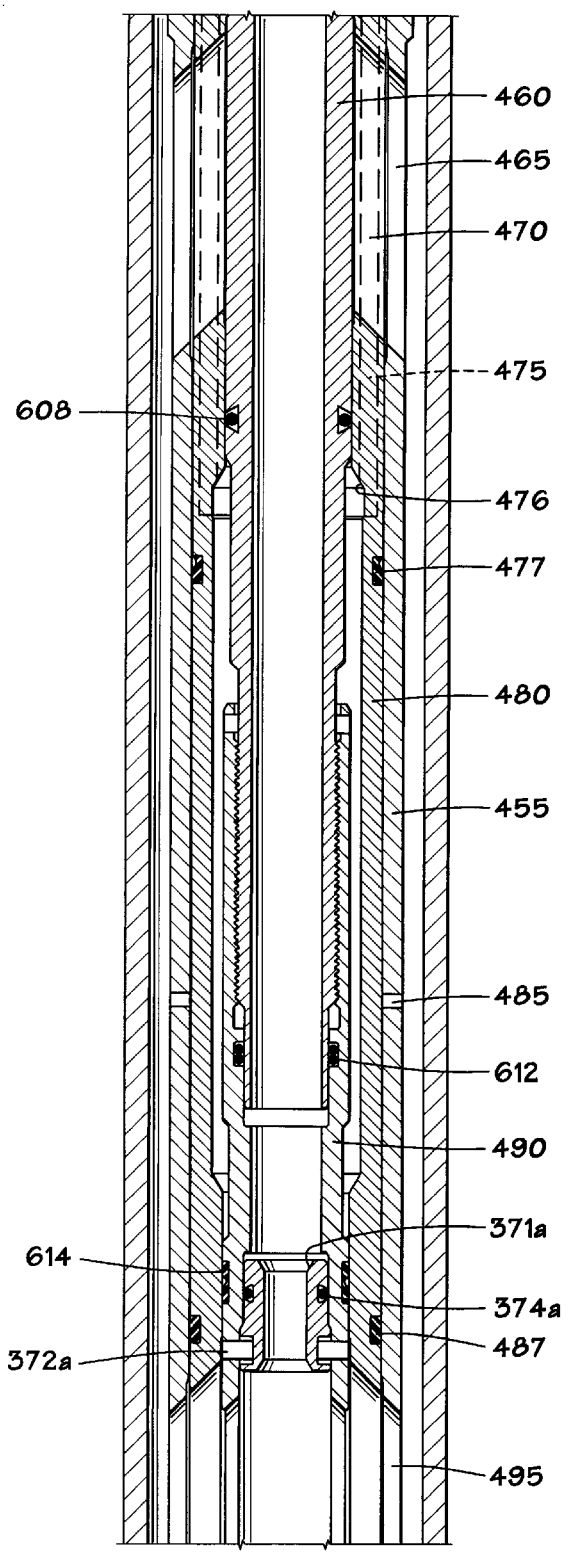
Figure 6G:
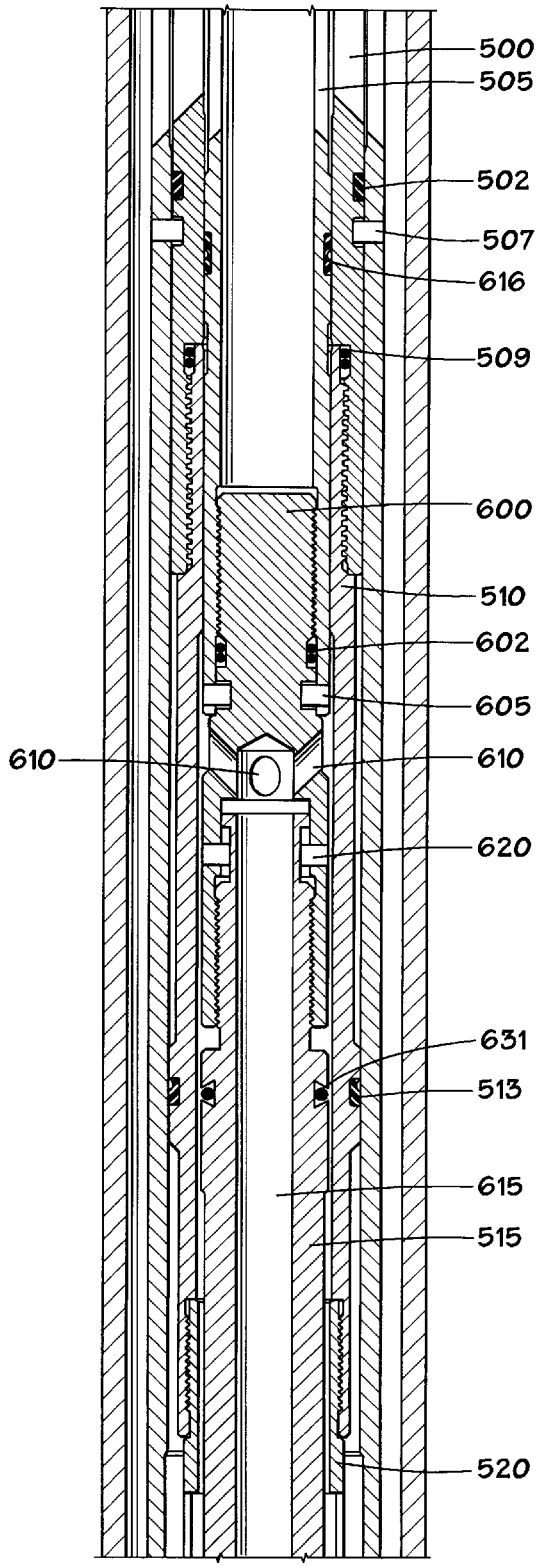
Figure 6H:
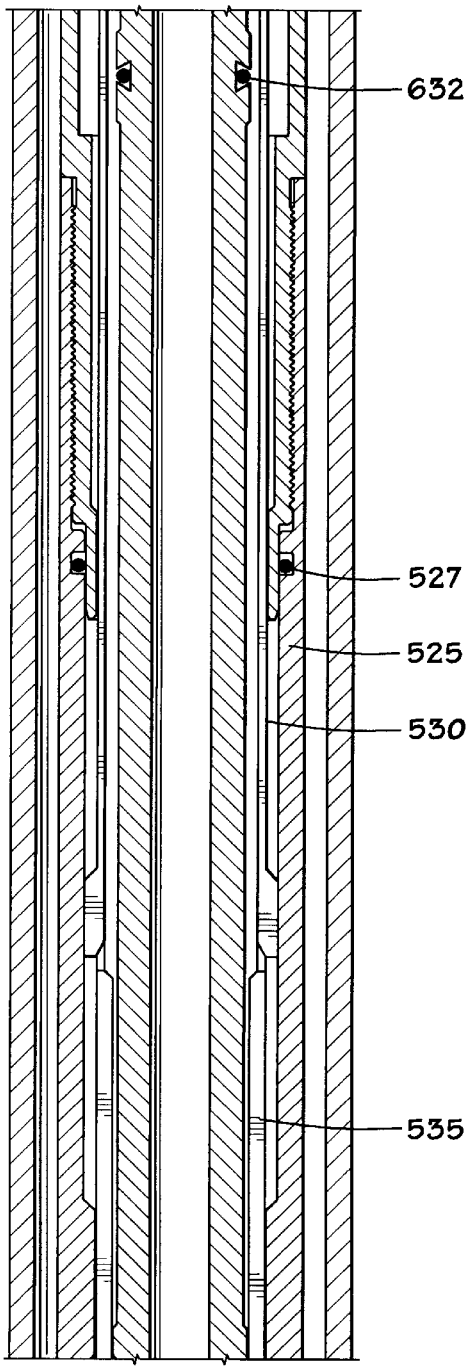
Figure 6I:
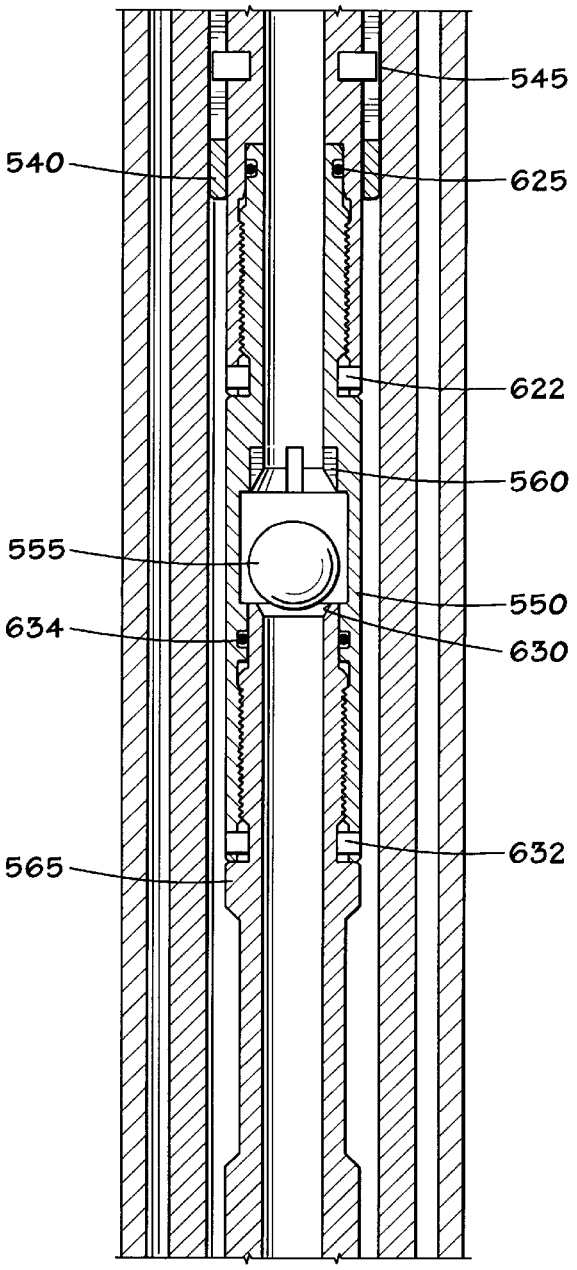
Figures 6J, 6K, 6L:
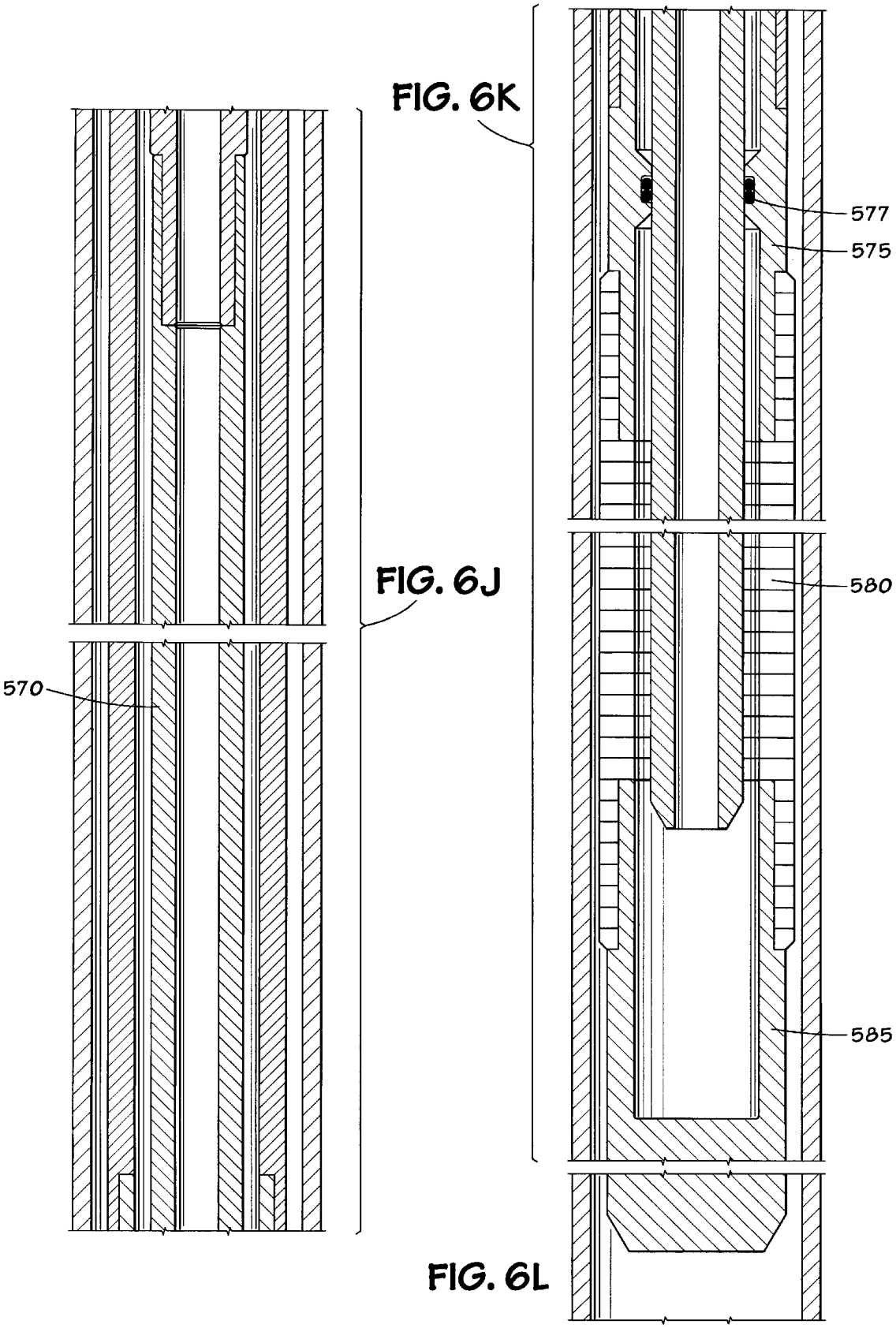

Seal sub 575, as shown in FIGS. 6J and 6K, is connected to the lower end of lower adapter 525. An annular recess on the inner diameter of seal sub 575 contains seals 577. Seals 577 seal against wash pipe 570. Gravel pack screens 580 extend longitudinally below seal sub 575. Bull plug 585 is connected to the lower portion of gravel pack screens 580.

Crossover sleeve 480, as shown in FIGS. 6E–6G, is coaxially arranged with and attached by a plurality of shear screws 507 to the inner diameter of gravel pack sleeve 455. Crossover sleeve 480 includes a plurality of longitudinally extending slots 470, which are spaced circumferentially about the crossover sleeve. Slots 470 provide passageways radially through the tubular wall of crossover sleeve 480 and preferably are aligned with slots 465 of gravel pack sleeve 455 in the circulating and squeeze positions. Crossover sleeve 480 also includes a plurality of passageways 475 which extend longitudinally through the upper portion of crossover sleeve 480 between openings 476 and 478. Passageways 475 are positioned between slots 470 as shown more clearly in FIG. 13. Seals 457 are located in an internal groove in the upper portion of gravel pack sleeve 455 and provide a seal between gravel pack sleeve 455 and crossover sleeve 480. Seals 457 are preferably elastomeric seals. Seals 477 and 487 are located in external grooves in crossover sleeve 480 and provide a seal between the crossover sleeve and gravel pack sleeve between slots 465 and 495 when the gravel pack system is in the running position.

Crossover sleeve 480 includes a plurality of longitudinally extending slots 500, which are spaced circumferentially about the lower portion of the crossover sleeve. Slots 500 provide passageways radially through the tubular wall of crossover sleeve 480 and preferably are aligned with slots 495 in gravel pack sleeve 455 in the circulating and squeeze positions. Seals 502 are located in an external groove in the lower portion of crossover sleeve 480 and provide a seal between the crossover sleeve and gravel pack sleeve below slots 495 and 500 when the gravel pack assembly is in the running position.

Isolation sleeve 510 is connected at its upper end to the lower end of crossover sleeve 480. Seals 509 seal the connection between crossover sleeve 480 and isolation sleeve 510. Isolation sleeve 510 is coaxially arranged within gravel pack sleeve 455. Seal 513 is provided in an external groove in a radially outwardly extending portion of isolation sleeve 510. Seal 513 seals the annular space between isolation sleeve 510 and gravel pack sleeve 455 above lockout collet 520. Lockout collet 520 is threadedly attached to the lower end of isolation sleeve 510. Lockout collet 520 is coaxially aligned with and extends through the lower portion of gravel pack sleeve 455 and the upper portion of lower adapter 525 as shown in FIGS. 6G–I. As more clearly shown in FIG. 14, lockout collet 520 includes a plurality of collet fingers 530 spaced circumferentially around the upper half of the lockout collet. The lower portion of lockout collet 520 includes a plurality of longitudinally extending slots 535 which extend radially through the tubular wall 540 of the lockout collet.

Running tool and service assembly 21 is adapted for coaxial telescoping longitudinal movement inside packer assembly 100*a* and crossover and sliding sleeve valve assembly 425. Running tool and service assembly 21 includes, among other components, top sub 25*a*, intermediate sub 26*a*, mandrel 52*a*, bottom sub 80*a*, spacer tube 205*a*, blanking sleeve 460, diverter sleeve 490, ball seat 371*a*, lock sleeve 600, extension 515, check valve 550, wash pipe adapter 565, wash pipe 570, upper piston 30*a*, lower piston 42*a*, adapter 50*a*, running collet 55*a*, support sub 60*a*, and retainer 75*a*. The upper end of blanking sleeve 460 is fixedly attached to the lower end of spacer tube 205*a*. Seals 602 seal the connection between spacer tube 205*a* and blanking sleeve 460. Blanking sleeve 460 is coaxially arranged and located adjacent to the internal diameter of the upper portion of crossover sleeve 480 when the gravel pack system is in the running position. Blanking sleeve 460 includes external grooves for retaining seals 606 and 608. In the running position, seal 606 and 608 seal the annular space along blanking sleeve 460 and cross over sleeve 480 above and below slots 470. The lower end of blanking sleeve 460 is fixedly attached to the upper end of diverter sleeve 490. A plurality of elastomeric seals 612 are provided in an internal groove in diverter sleeve 490 for sealing the connection between the diverter sleeve and blanking sleeve. Diverter sleeve 490 extends longitudinally from the end of blanking sleeve 460 and includes a plurality of longitudinally extending slots 505. Slots 505 extend radially through the tubular wall of diverter sleeve 490 and are spaced circumferentially about the diverter sleeve. Diverter sleeve 490 includes a pair of external grooves for holding seals 614 and 616. Seals 614 and 616 seal the annular space along crossover sleeve 480 and diverter sleeve 490 above and below slot 505 when the gravel pack system is in the running position. Ball seat 371*a* is connected by a plurality of shear pins 372*a* to the internal diameter of diverter sleeve 490 above slots 505. Ball seat 371*a* provides a seating surface for receiving a sealing ball. Passageway 15*a* will be closed when an appropriately sized ball lands on ball seat 371*a*.

Lock sleeve 600 is threadably attached to the lower portion of diverter sleeve 490. Set screws 605 rotationally secure the connection between lock sleeve 600 and diverter sleeve 490. Lock sleeve 600 includes an external ring groove for housing seals 602 which seal the connection between lock sleeve 600 and diverter sleeve 490. Lock sleeve 600 includes a plurality of radially extending ports 610 which communicate with central passageway 615. The upper portion of extension 515 is threadably attached to the lower portion of lock sleeve 600 Set screws 620 rotationally secure the connection between extension 515 and lock sleeve 600. Central passageway 615 extends longitudinally through extension 515 and washpipe 570. Extension 515 includes a plurality of shear screws 545 which radially extend from extension 515 for longitudinal movement within slots 535 of lockout collet 520. In the running position, extension 515 extends longitudinally within the lower portion of isolation sleeve 510 and lockout collet 520.

The upper portion of check valve 550 is threadably attached to the lower portion of extension 515 The connection between check valve 550 and extension 515 is rotationally secured by set screws 622. Seal 625 is located in an external groove in the upper portion of check valve 550 and provides a seal in the connection between check valve 550 and extension 515. Check valve 550 is a one-way valve that prevents fluids from passing downwardly and is designed to prevent fluids from falling down on top of the completed gravel pack when excess slurry is being reversed out of the running tool and service assembly. Check valve 550 includes ball 555 and fluid bypass slots 560. Fluid bypass slots 560 allow fluids to flow upwardly through the valve when ball 555 is displaced against slots 560. The lower portion of check valve 550 is threadably attached to the top end of wash pipe adapter 565. Set screws 632 rotationally secure the connections between check valve 550 and wash pipe adaptor 565. An elastomeric seal 634 is contained in an internal groove in check valve 550 and seals the connection between the check valve and wash pipe adapter 565. The upper end of wash pipe adapter 565 includes a ball seat 630 for receiving ball 555. The lower portion of wash pipe adapter 565 is threadedly connected to wash pipe 570. Wash pipe 570 is coaxially arranged within lower adapter 525 and seal sub 575 and extends inside gravel pack screens 580.

Figure 7A:
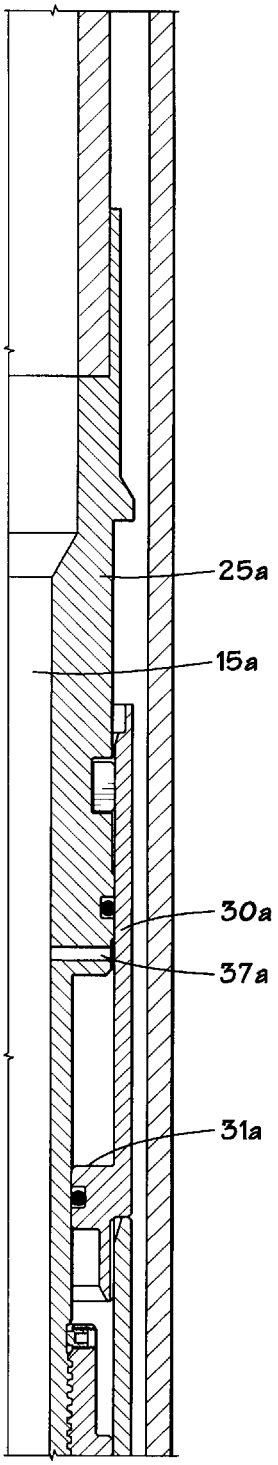
FIGS. 7A–K illustrate successive portions, in vertical sections, of the through tubing gravel pack system in the packer setting position.
Figure 7B:
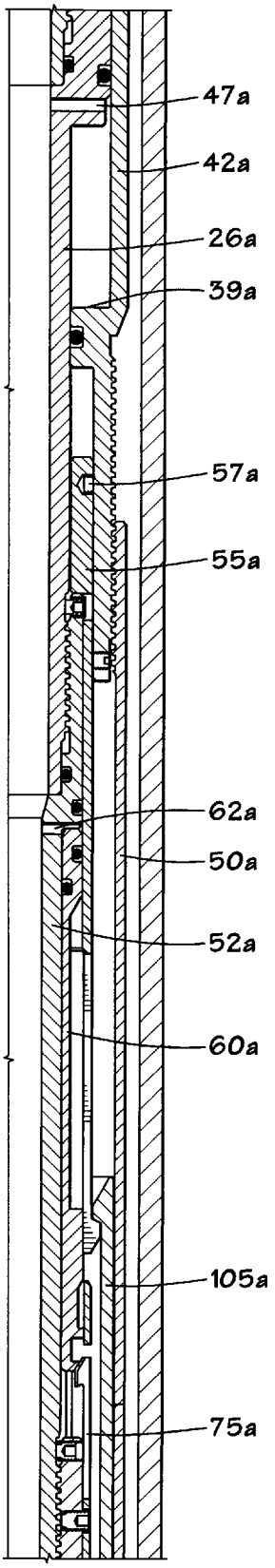
Figure 7C:
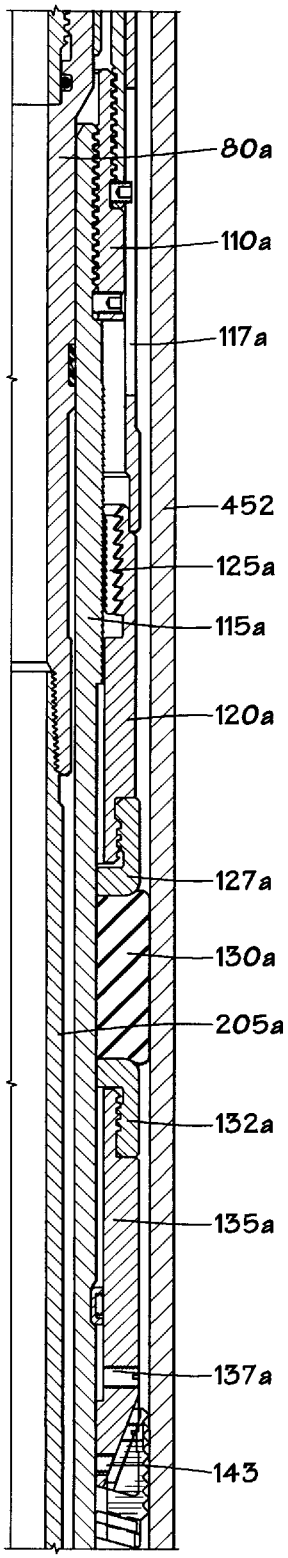
Figure 7D:
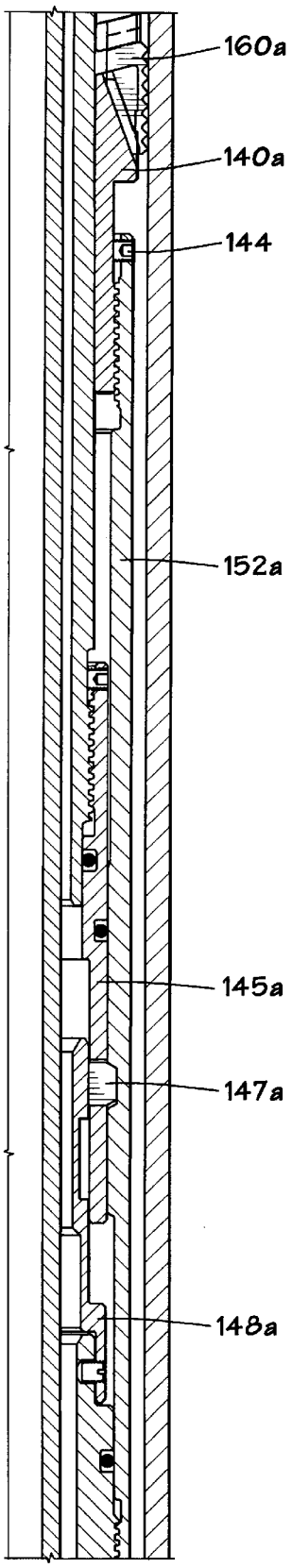
Figure 7E:
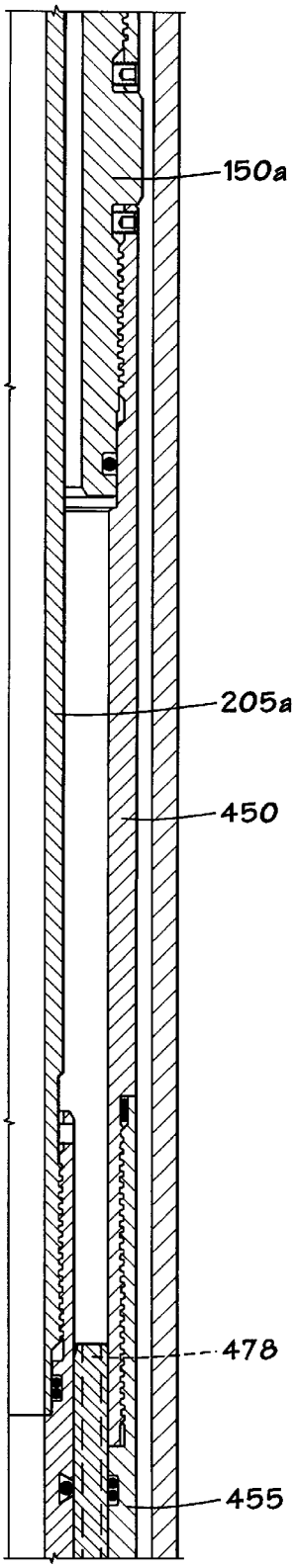
Figure 7F:
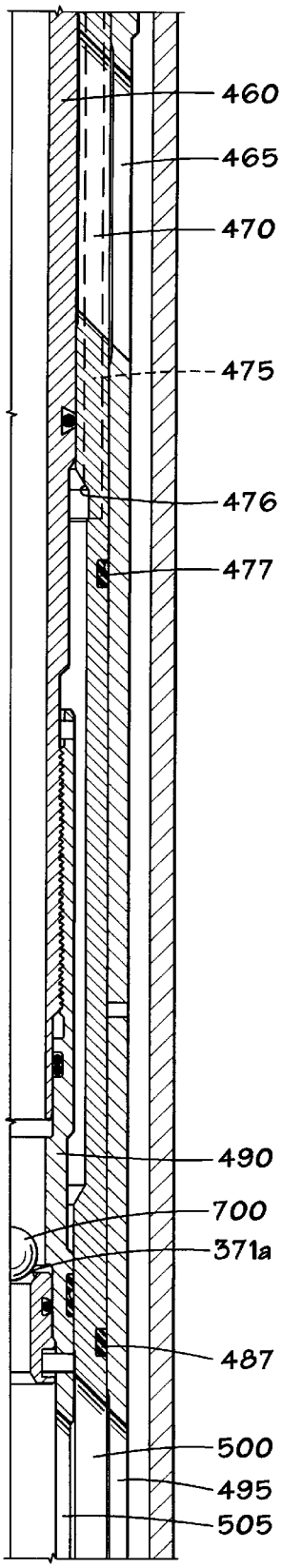
Figure 7G:
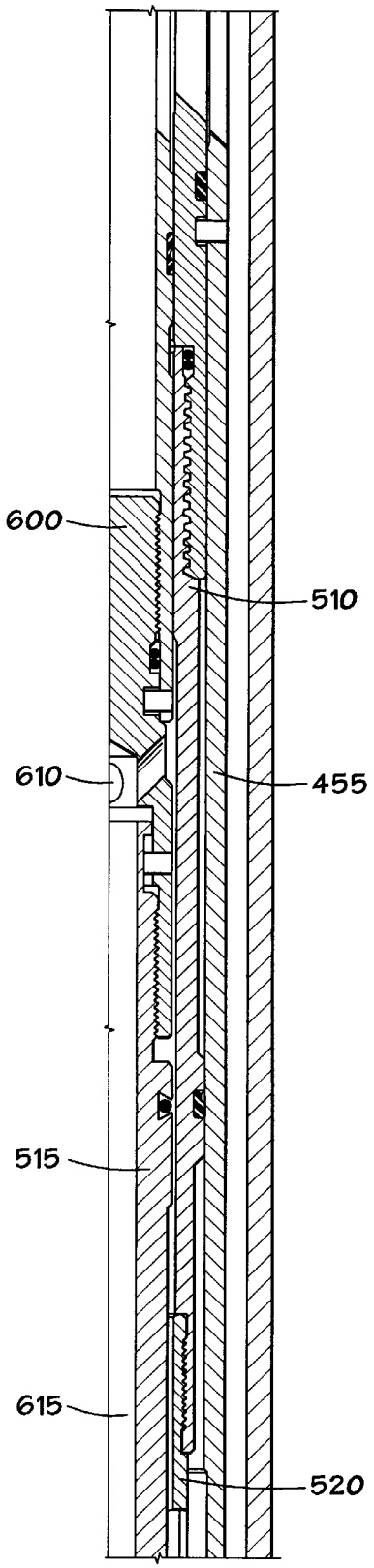
Figure 7H:
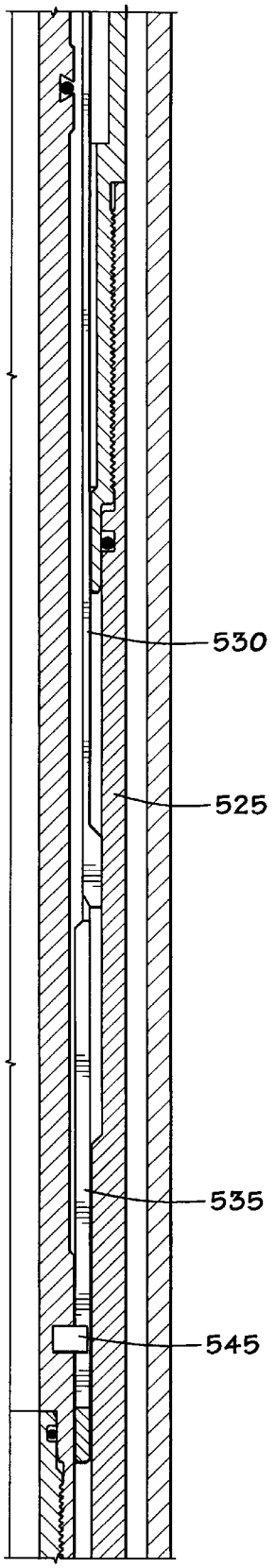
Figure 7I:
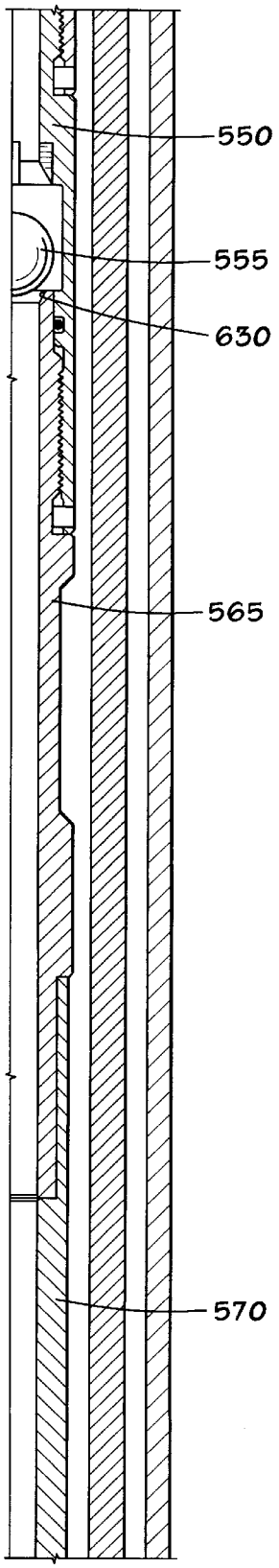
Figure 7J:
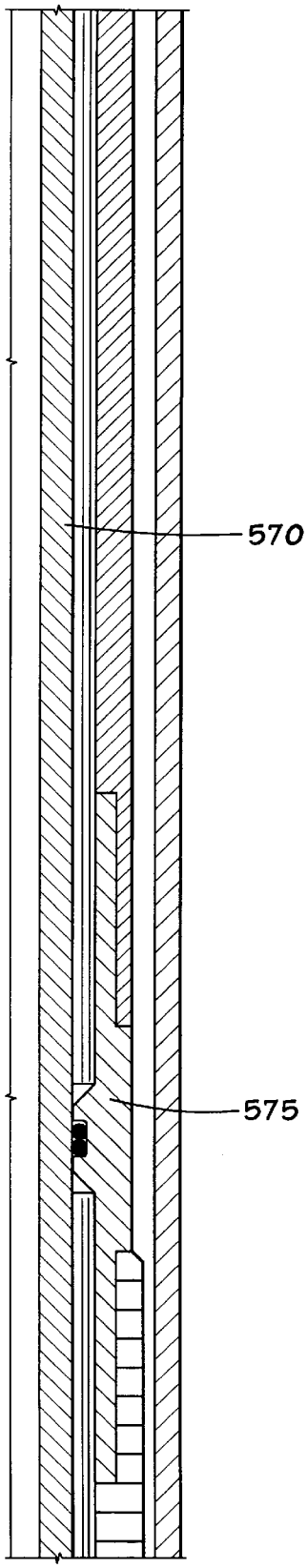
Figure 7K:
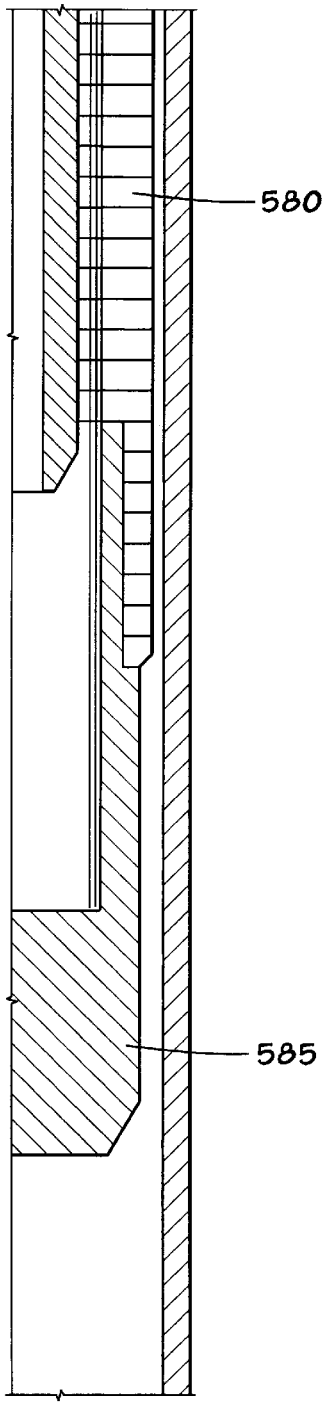

The gravel pack assembly of FIG. 6 is shown in the set position in FIGS. 7A–K. As can be seen in FIG. 7F, a ball has been dropped or displaced from the surface through the coiled tubing and into passageway 15*a* of the gravel pack assembly until the ball has landed on ball seat 371*a*. Once the ball seals passageway 15*a*, pressure was applied to the coiled tubing and passageway 15*a*. Internal pressure is communicated through pressure ports 37*a* and 47*a* until the force exerted on piston surfaces 31*a* and 39*a* of upper piston 30*a* and lower piston 42*a* shear screws 57*a*. After shear screws 57*a* are sheared, the force exerted by the upper and lower pistons is transferred through adapter 50*a*, packer setting sleeve 117*a*, lock ring housing 120*a*, the upper and lower gauge rings 127*a* and 132*a*, and upper cone 135*a* until the force exceeds the strength of shear screws 137*a*. After shear screws 137*a* shear the upper and lower pistons travel longitudinally downward along top sub 25*a* and intermediate sub 26*a*. This downward movement is transferred through adapter 50*a* to packer setting sleeve 117*a*, which in turn, moves lock ring housing 120*a* relative to packer mandrel 115*a*. This movement causes the inward facing surfaces of slips 160*a* to ride up the outward facing surfaces of upper cone 135*a* and lower cone 140*a* so that slips 160*a* radially extend and engage production tubing 452 as illustrated in FIG. 7C. The internal pressure is increased to cause lock ring housing 120*a* to continue its downward movement relative to mandrel 115*a* until packing element 130*a* is compressed and energized by gauge rings 127*a* and 132*a*. As seen in FIG. 7C, the fully energized packing element extends radially to the internal diameter of tubing 452, thereby packing off or sealing the annulus between tubing 452 and the gravel pack assembly.

Running tool and service assembly 20*a* is hydraulically released from packer 100*a* after the packer is set in the production tubing. Pressure applied to the passageway 15*a* communicates through pressure ports 62*a* and is exerted against the upper piston of support sub 60*a*. Pressure is increased until the force exerted on the upper piston of support sub 60*a* exceeds the shear strength of shear screws 76*a*. After shear screws 76*a* are sheared, support sub 60*a* moves downward relative to running collet 55*a* until shoulder 61*a* moves beyond fingers 69*a* of running collet 55*a*. This allows fingers 59*a* to move radially inward away from fishing neck 107*a* and top sub 105*a* of the packer. When support sub 60*a* moves towards bottom sub 80*a*, collet 79*a* of the retainer 75*a* engages the annular groove in the lower portion of support sub 60*a*. As a result, retainer 75*a* retains support sub 60*a* in this downward position thereby preventing fingers 59*a* of running collet 55*a* from re-engaging with fishing neck 107*a*. Once this occurs, the running tool and service assembly is no longer secured to the remainder of the gravel pack assembly. As a result, the running tool and service assembly 20*a* can be manipulated longitudinally within the packer assembly and the crossover sleeve and sliding sleeve valve assembly without re-engaging the running tool and service assembly to the packer.

Once the packer is set in the production tubing and the running tool and service assembly is disengaged from the packer assembly, an operator can cycle the running tool and service assembly between a circulating position and a squeeze position as desired by raising or lowering the coiled tubing string.

FIGS. 8A–I illustrate the circulating position of the gravel pack assembly shown in FIG. 6. To perform a circulating gravel pack, the operator raises the coiled tubing string at the surface which causes running tool and service assembly 20*a* to move upward relative to the packer assembly and the crossover and sliding sleeve valve assembly. The running tool and service assembly 20*a* is moved longitudinally upward until shear screws 545 contact the upper end of lock out collet slots 535. When shear screws 545 contact the upper end of lock out collet slots 535, slots 505 of diverter sleeve 490 will be positioned adjacent slots 470 of crossover sleeve 480 and slots 465 of gravel pack sleeve 455. Seals 614 and 616 seal the annular space between diverter sleeve 490 and crossover sleeve 480 above and below slot 505 when the gravel pack assembly is in the circulating position. Extension 515 closes slots 500 and 495 in crossover sleeve 480 and gravel pack sleeve 455. Elastomeric seals 631 and 632, located in external grooves in extension 515, seal the annular space between extension 515 and crossover sleeve 480, above and below slots 500.

Figure 8A:
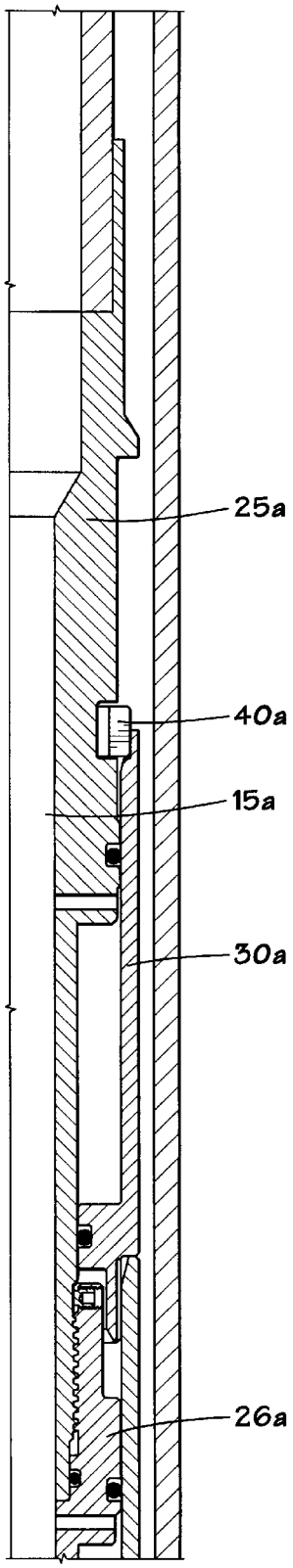
FIGS. 8A–I illustrate successive portions, in vertical sections, of the through tubing gravel pack system in the circulating position.
Figure 8B:
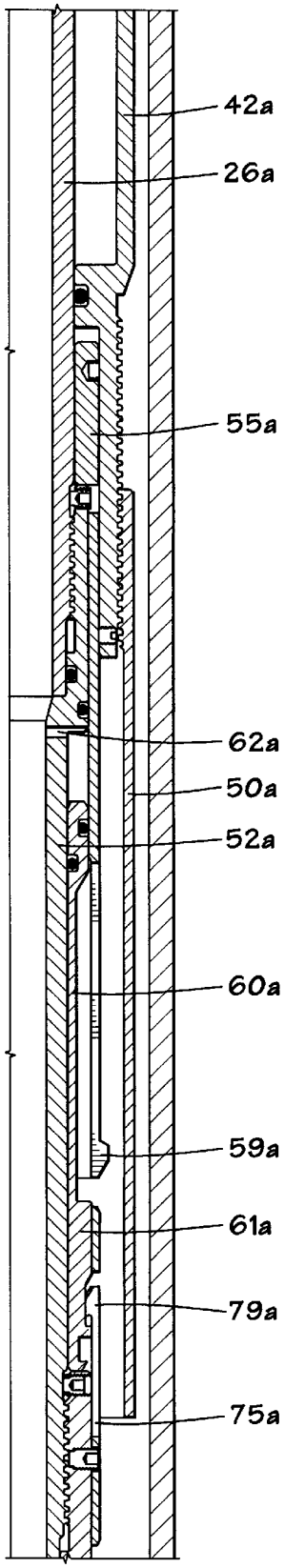
Figure 8C:
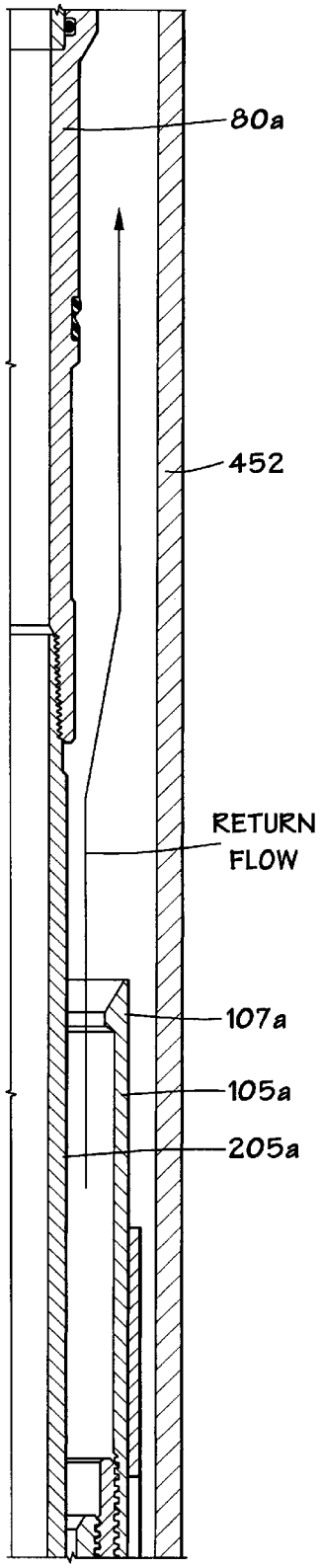
Figure 8D:
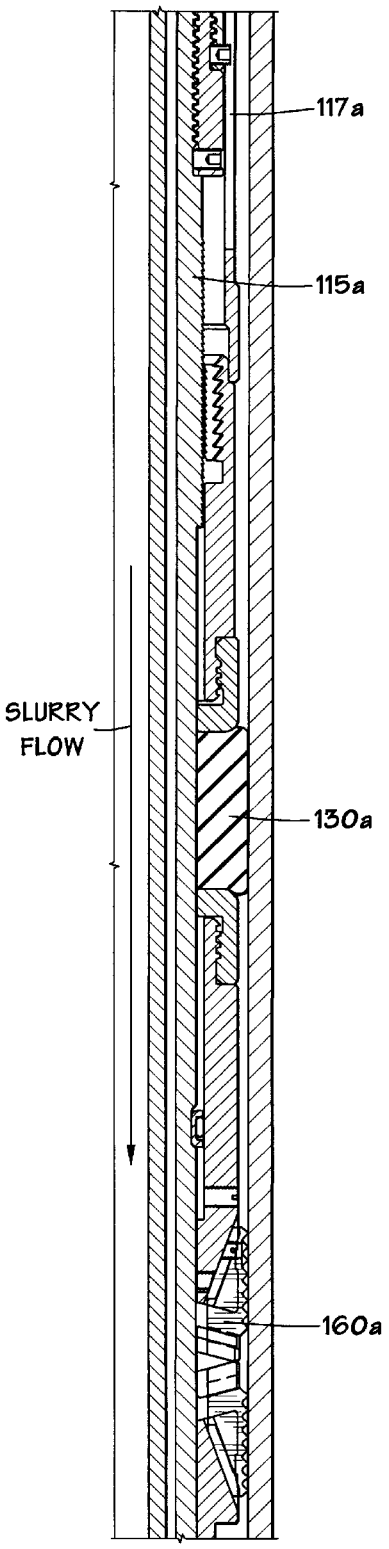
Figure 8E:
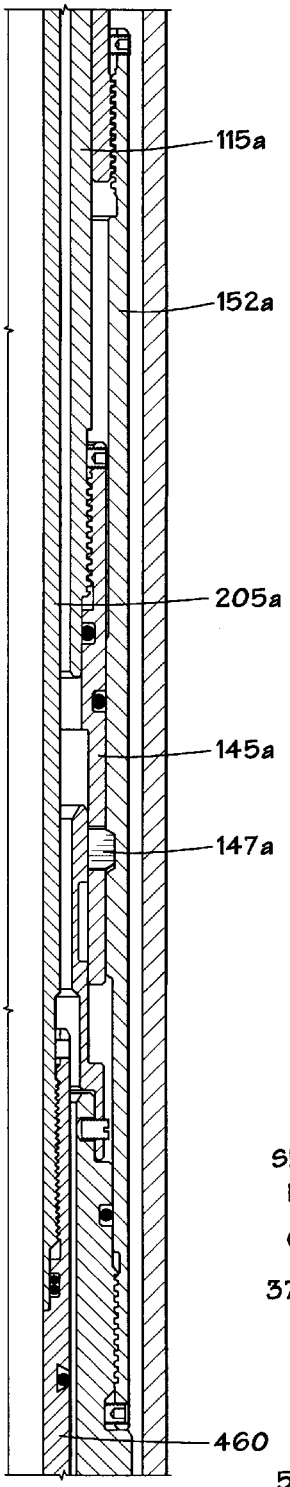
Figure 8F:
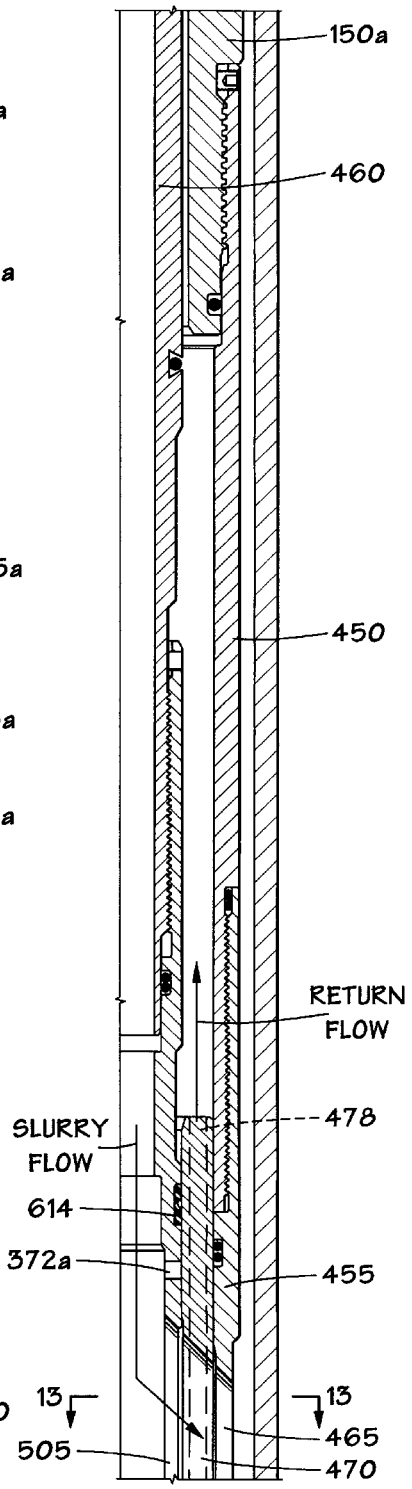
Figure 8G:
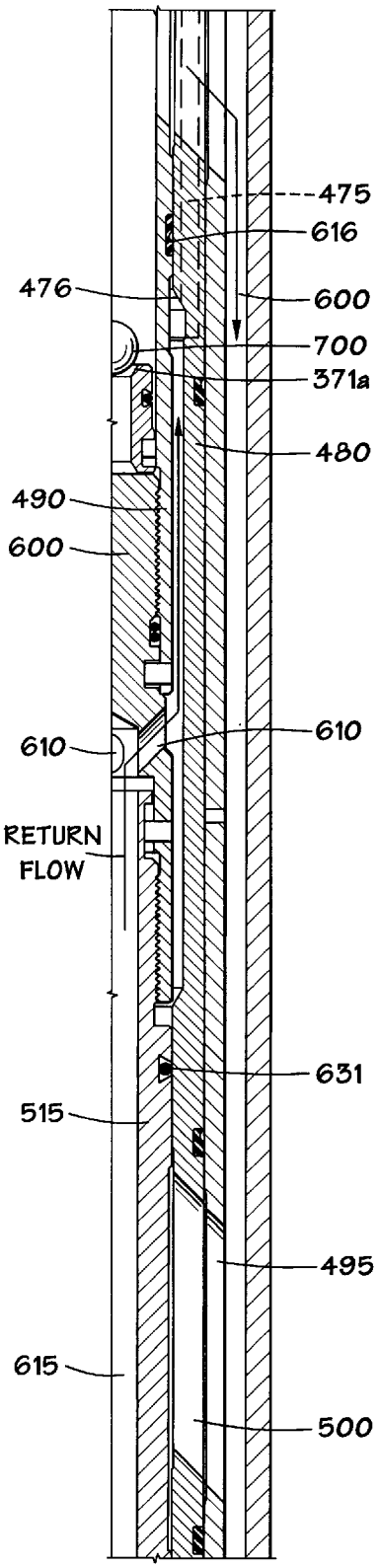
Figure 8H:
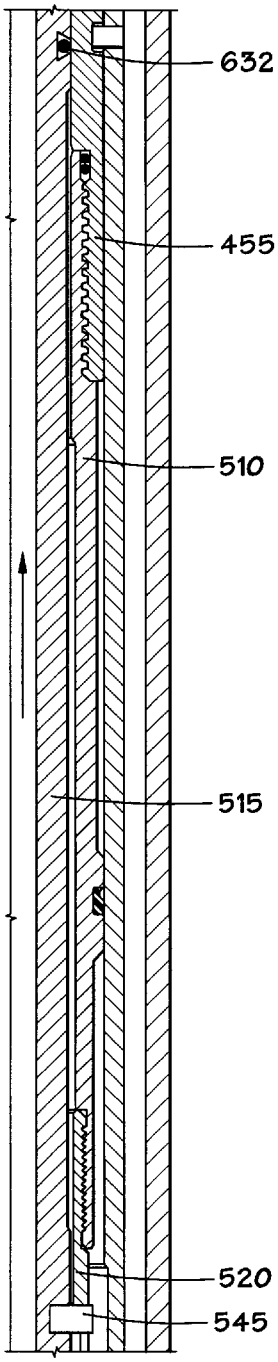
Figure 8I:
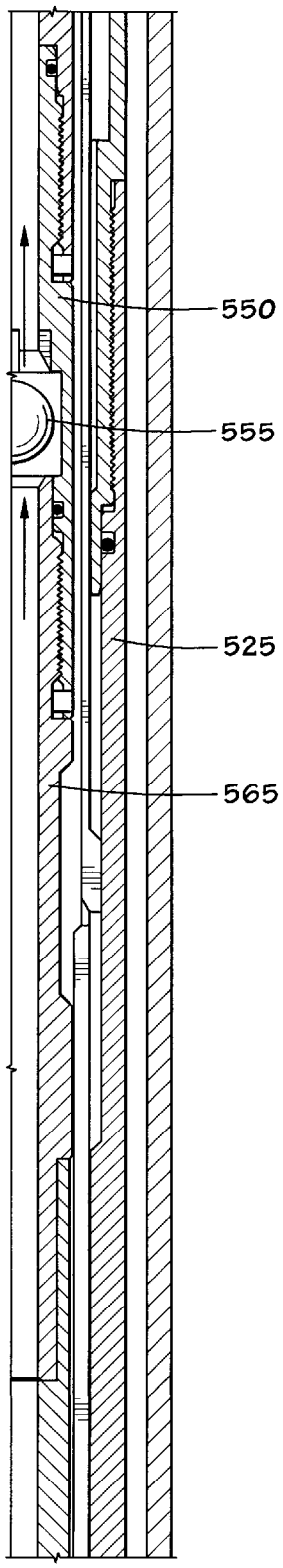
Figure 8J:
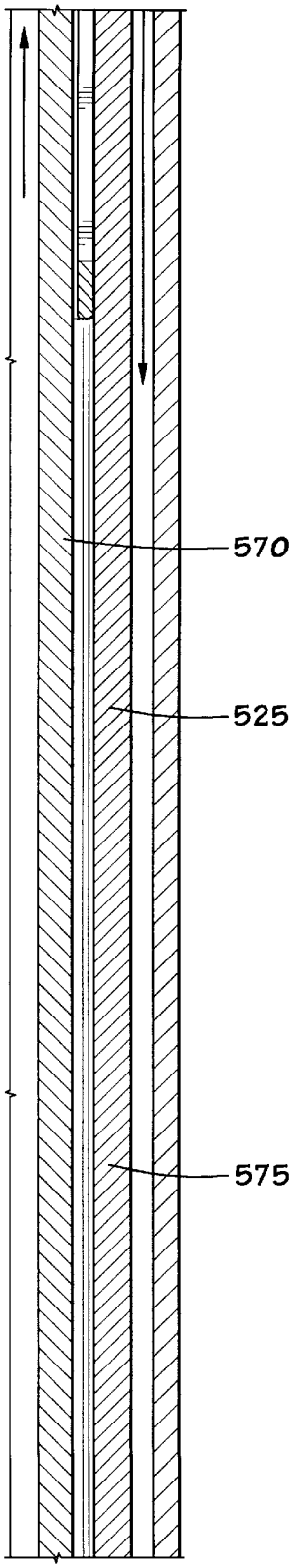
Figure 8K:
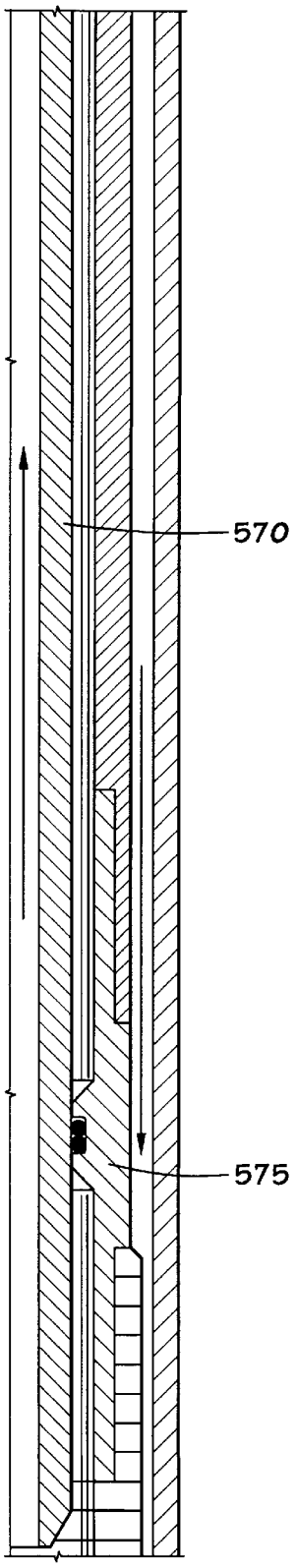
Figure 8L:
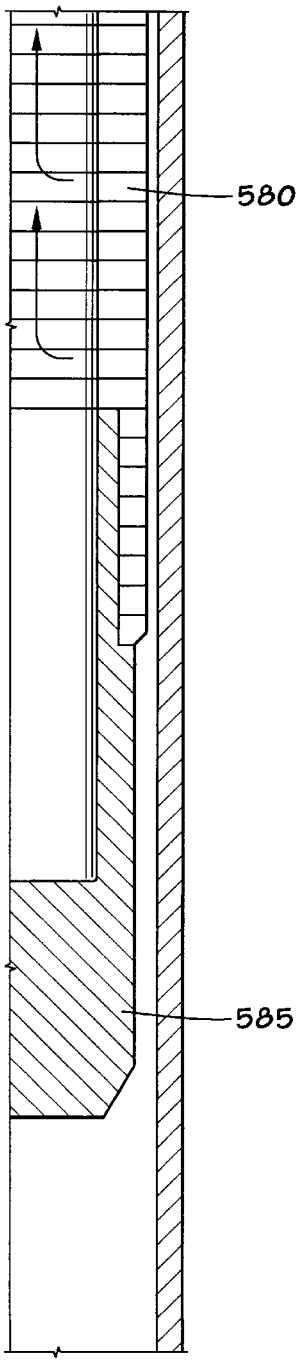
Figure 9A:
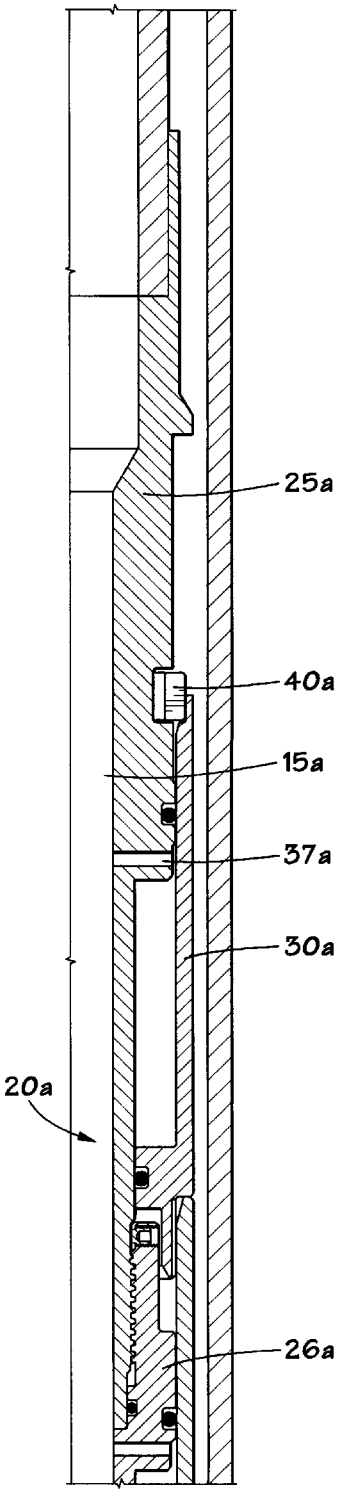
FIGS. 9A–K illustrate successive portions, in vertical sections, of the through tubing gravel pack system in the squeeze position.
Figure 9B:
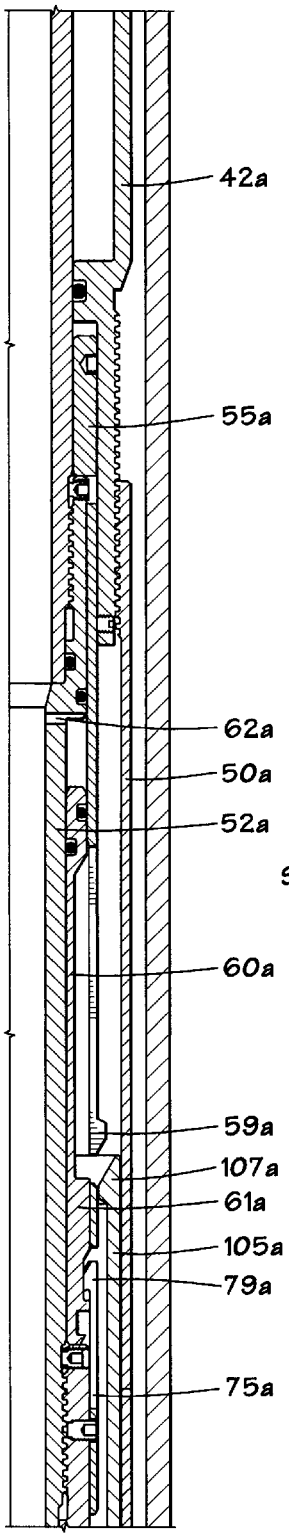
Figure 9C:
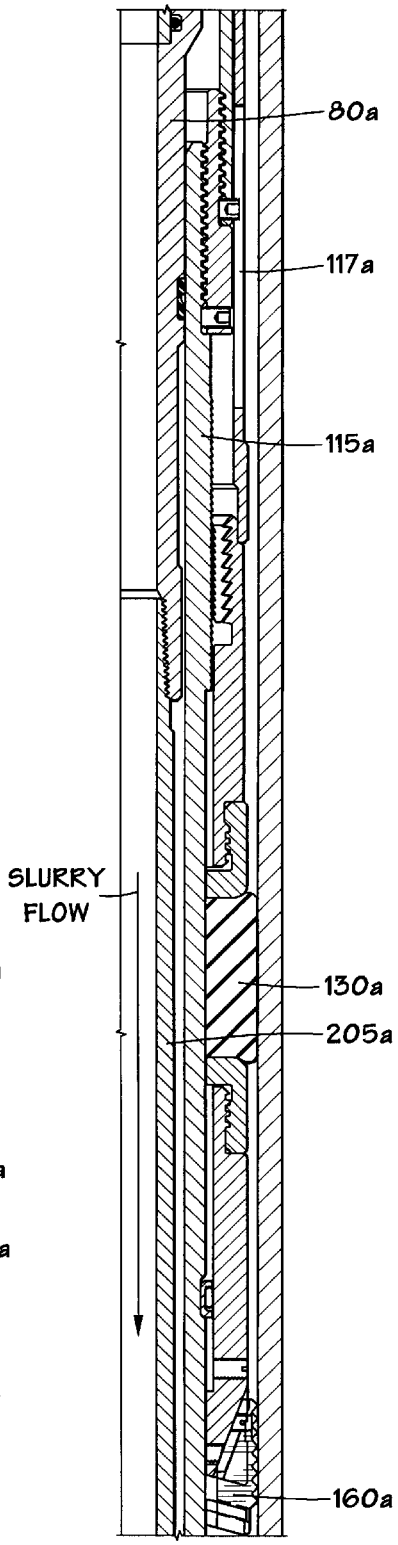
Figure 9D:
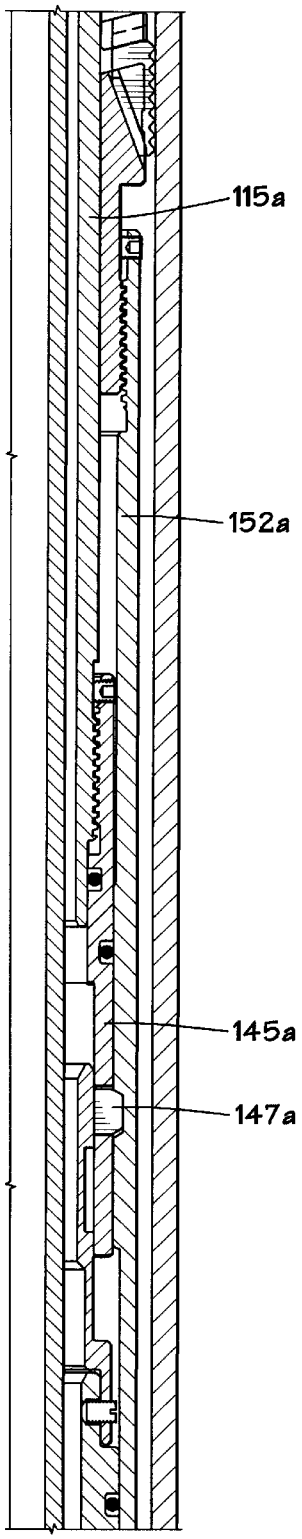
Figure 9E:
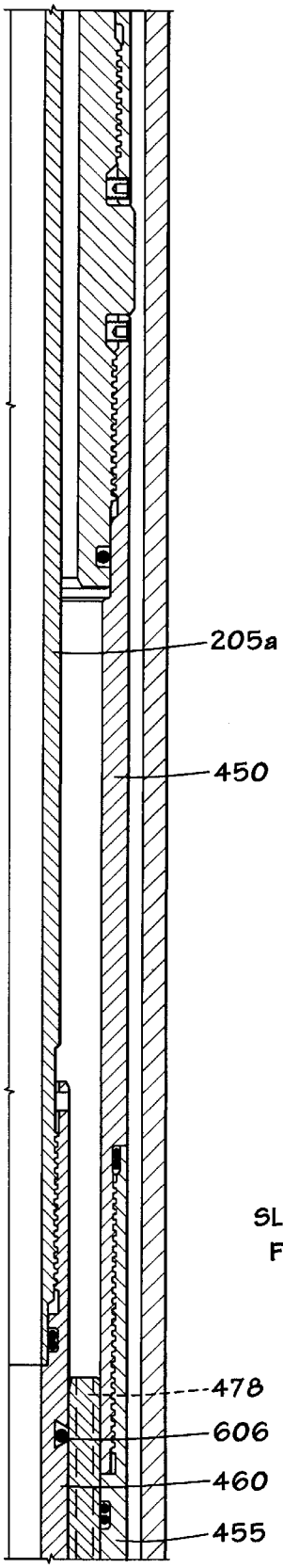
Figure 9F:
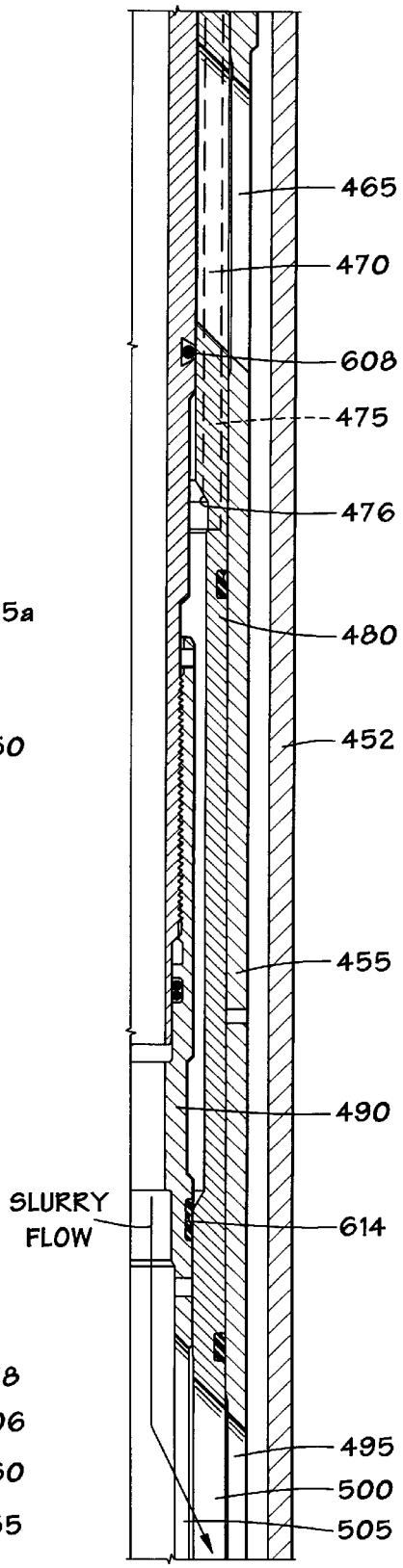
Figure 9G:
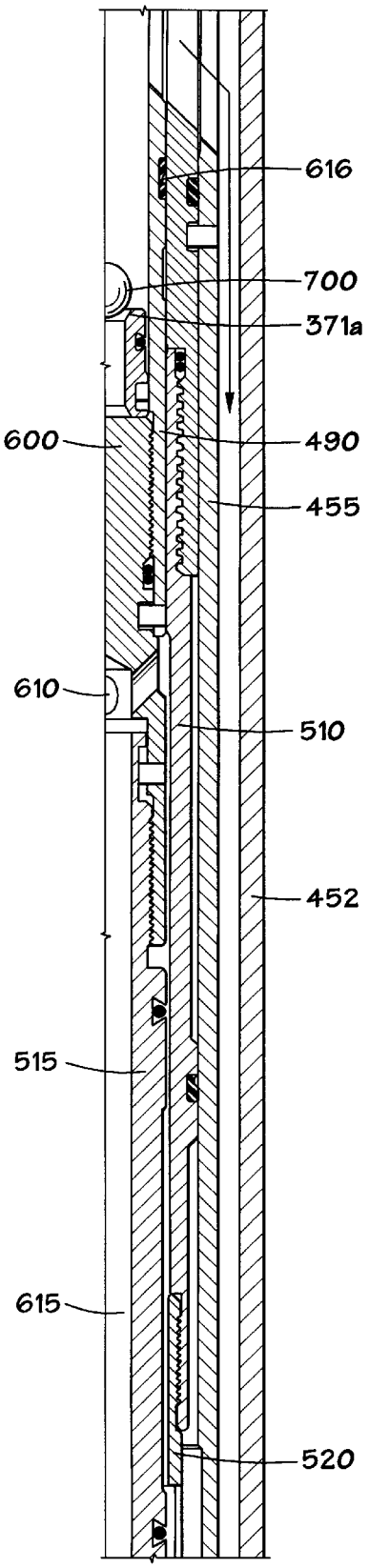
Figure 9H:
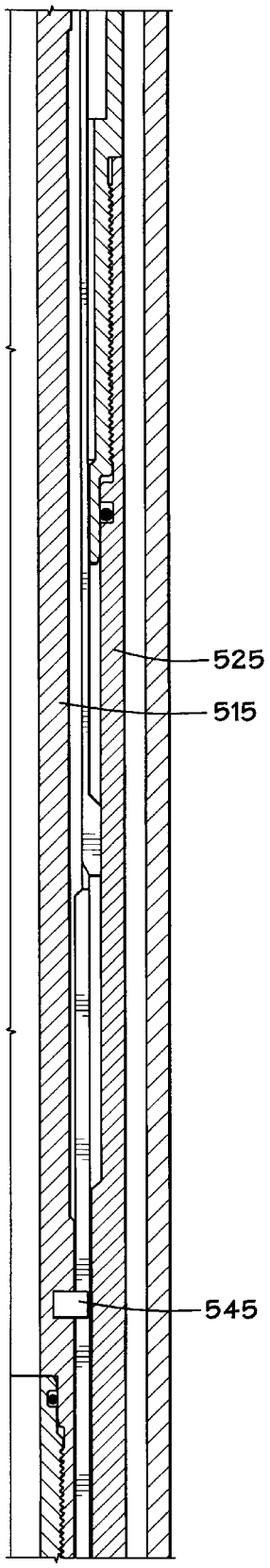
Figure 9I:
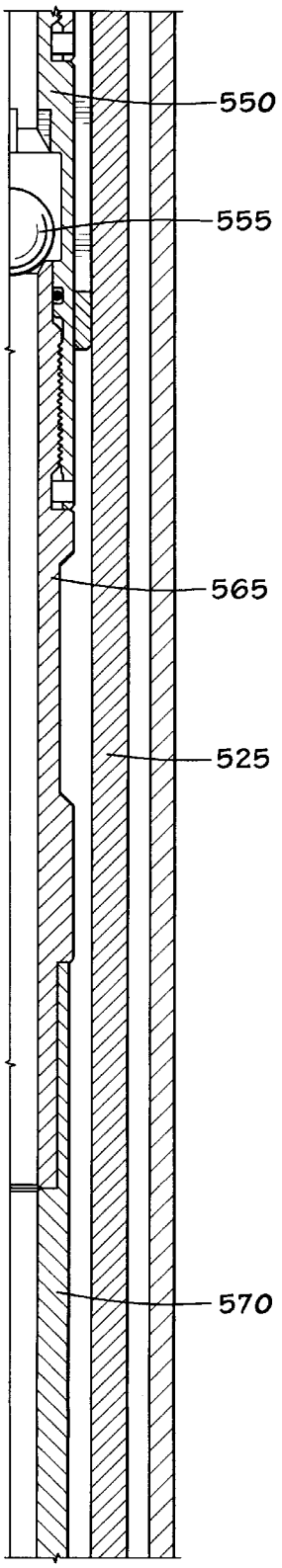
Figure 9J:
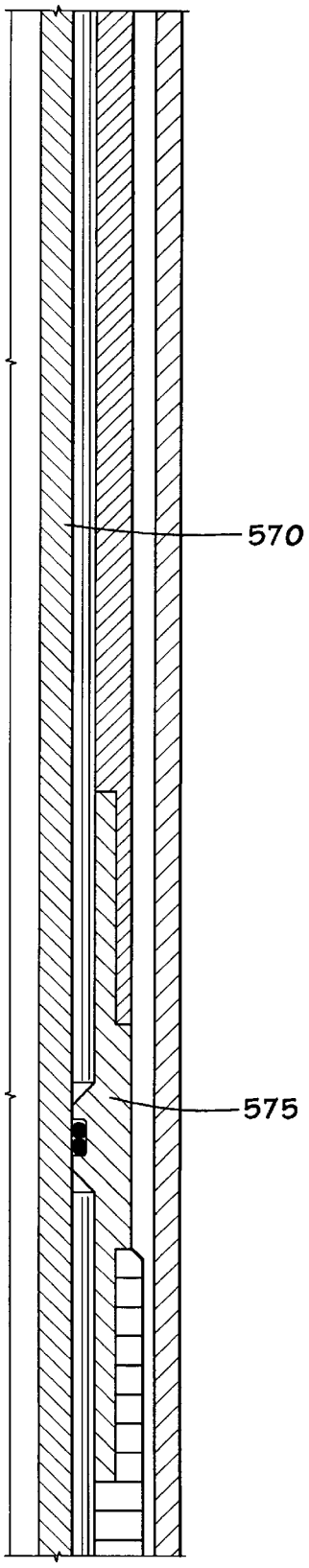
Figure 9K:
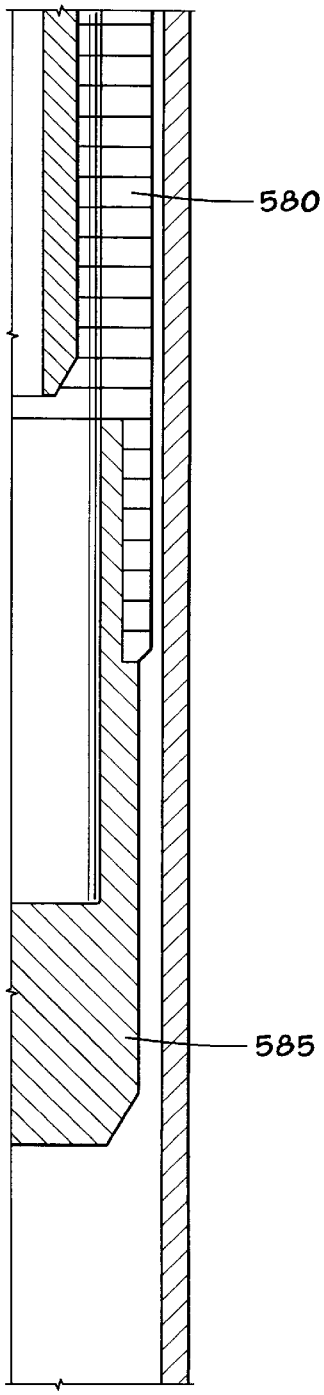
Figure 10A:
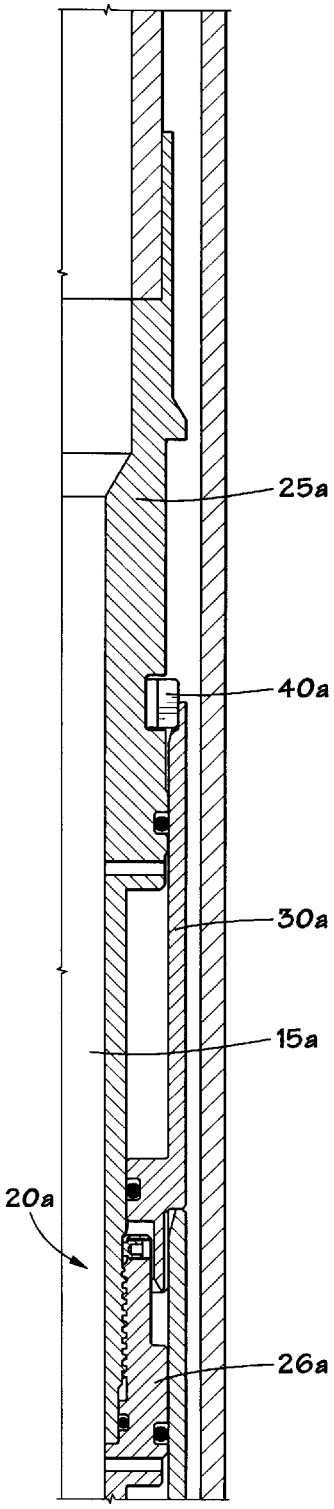
FIGS. 10A–M illustrate successive portions, in vertical sections, of the through tubing gravel pack system with the gravel pack sleeve closed.
Figure 10B:
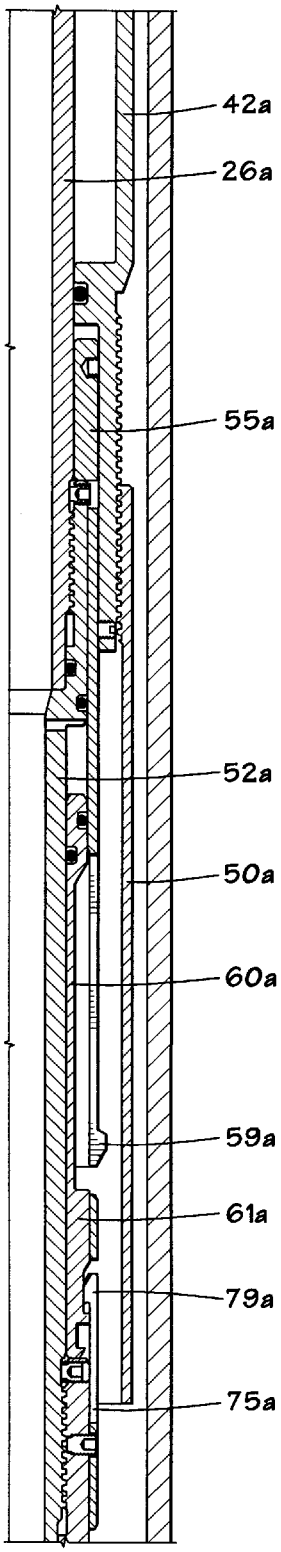
Figure 10C:
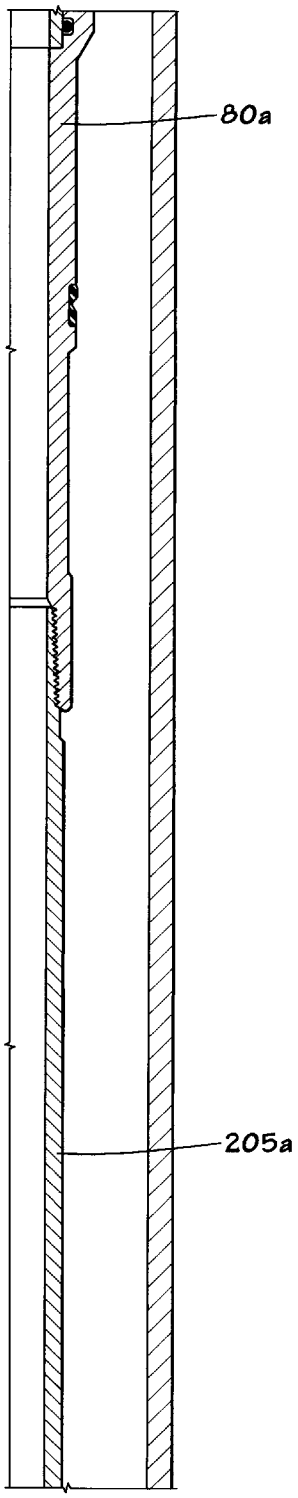
Figure 10D:
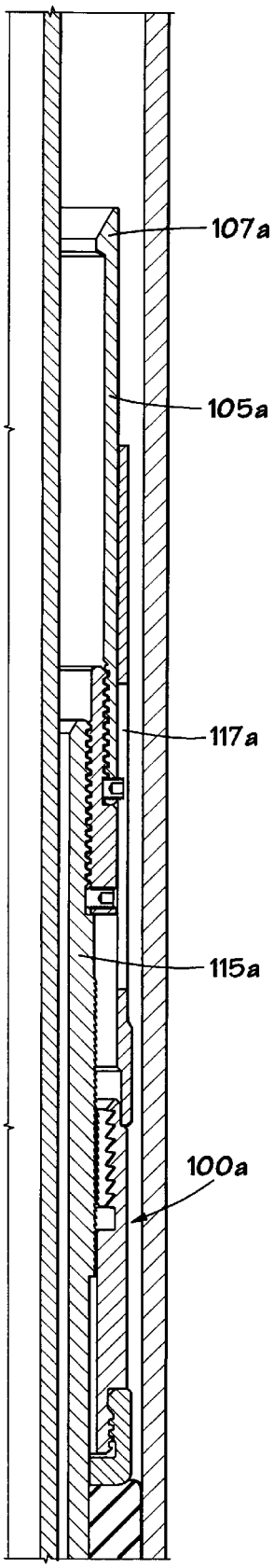
Figure 10E:
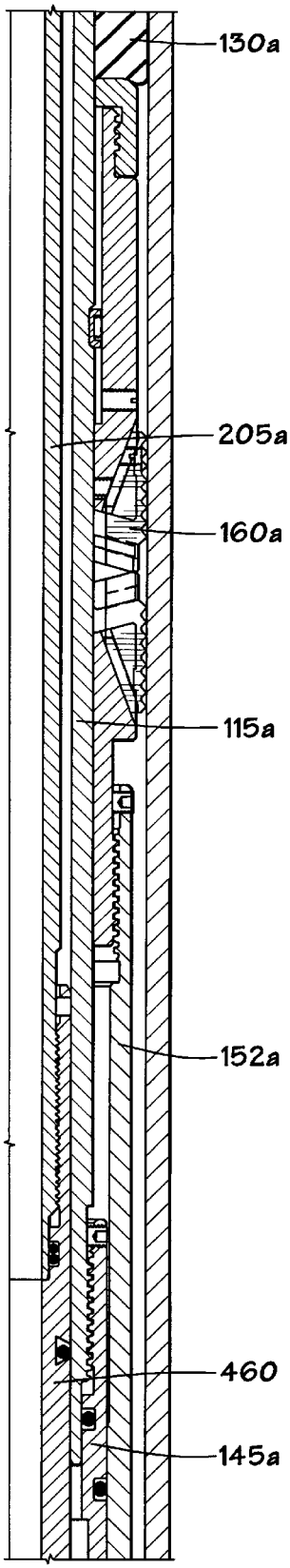
Figure 10F:
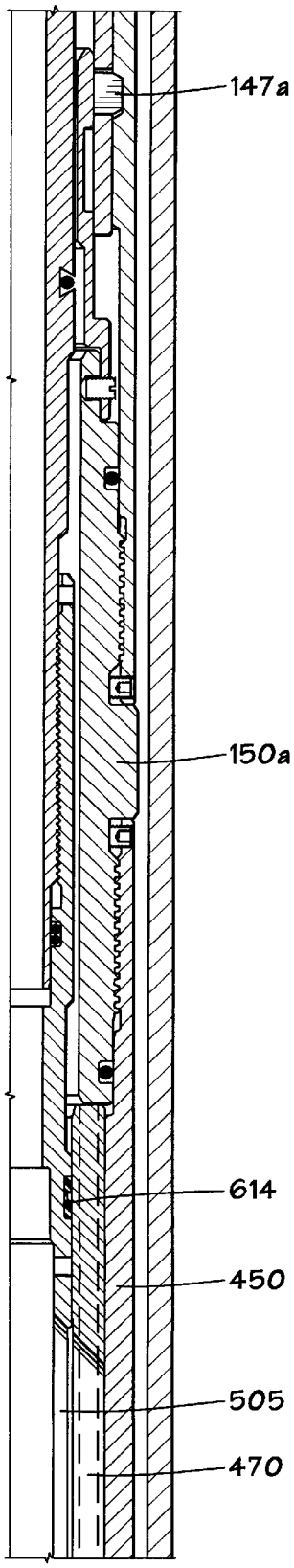
Figure 10G:
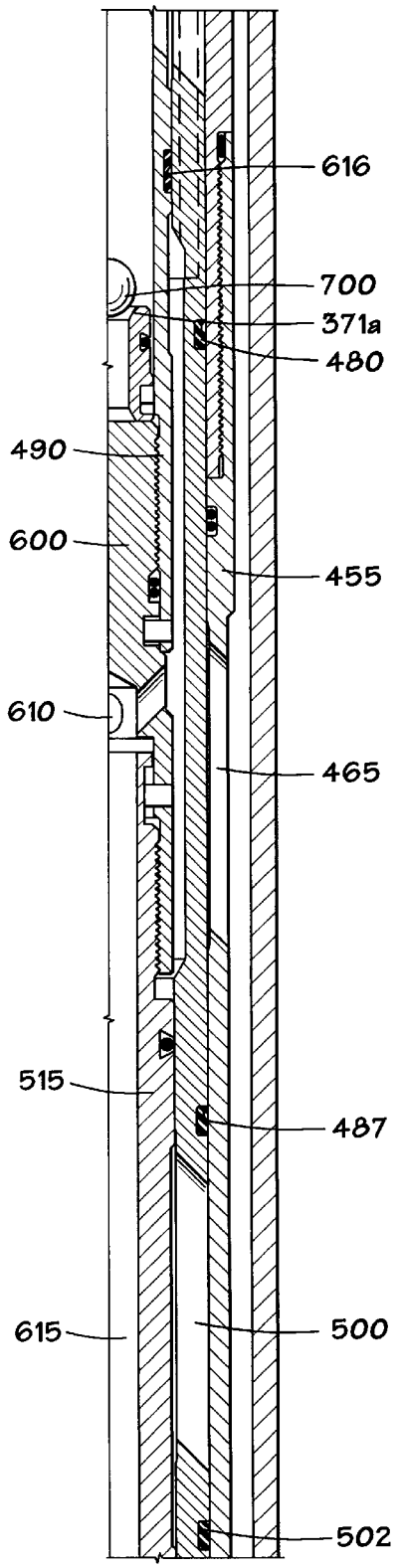
Figure 10H:
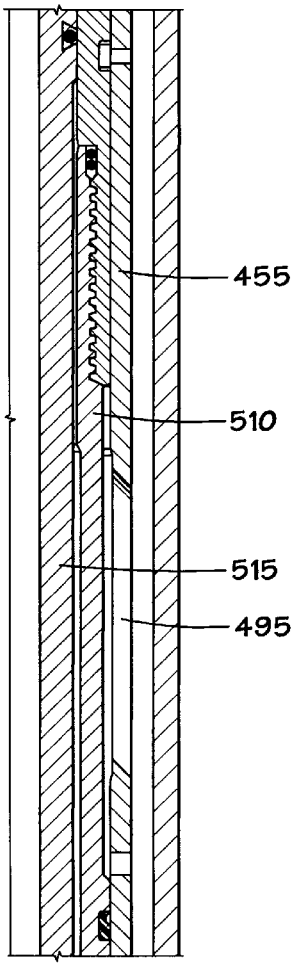
Figure 10I:
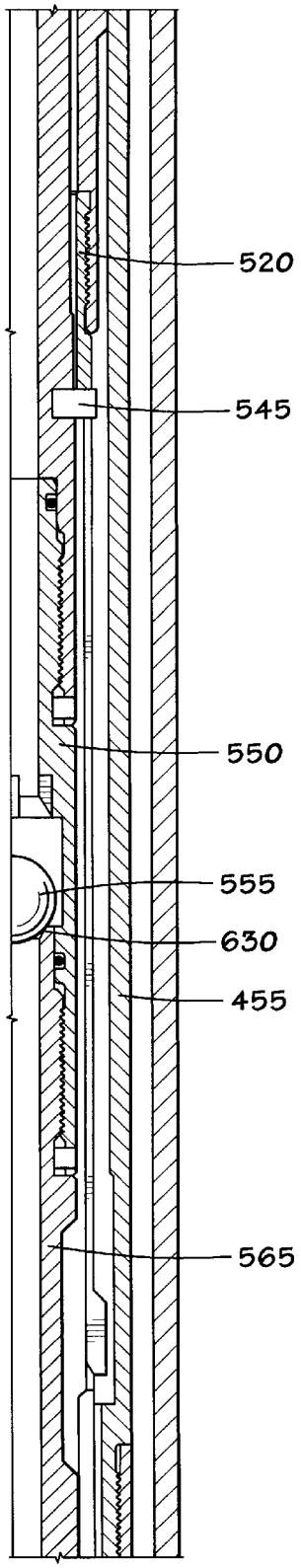
Figure 10J:
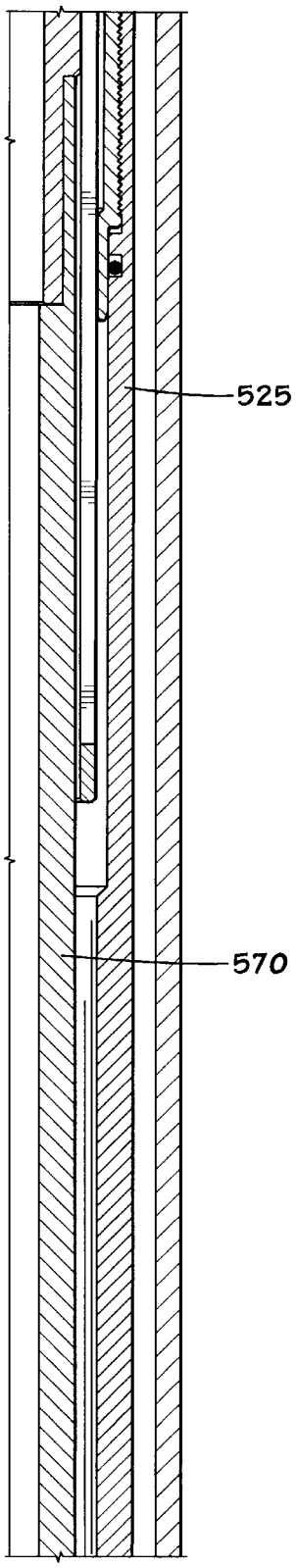
Figure 10K:
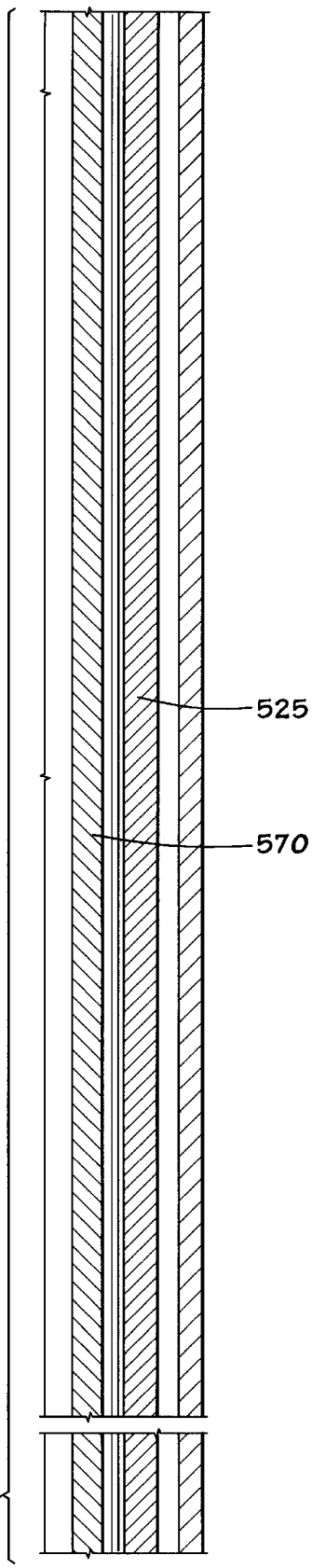
Figure 10L:
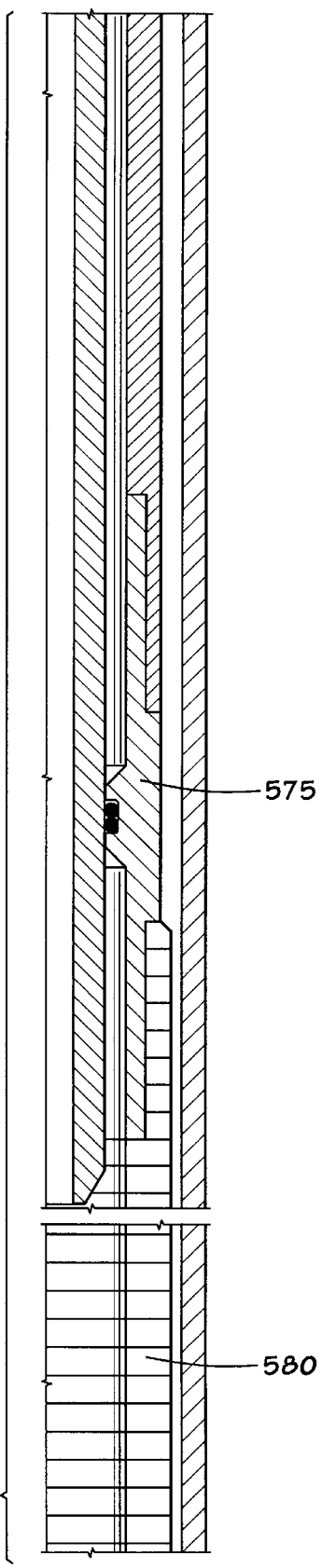
Figure 10M:
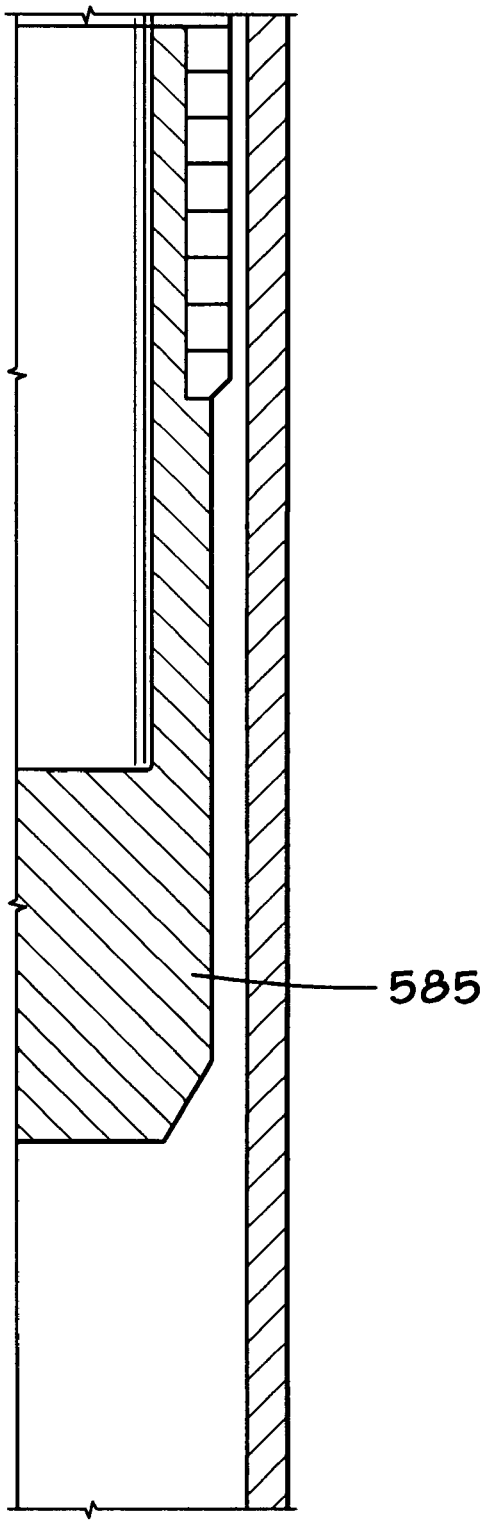
Figure 11A:
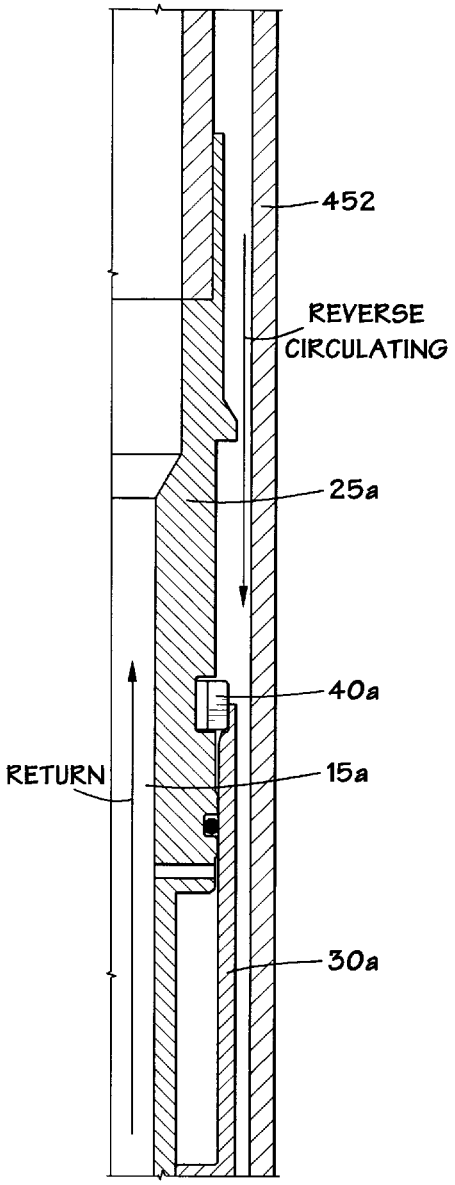
FIGS. 11A–P illustrate successive portions, in vertical sections, of the through tubing gravel pack system in the reversing position.
Figure 11B:
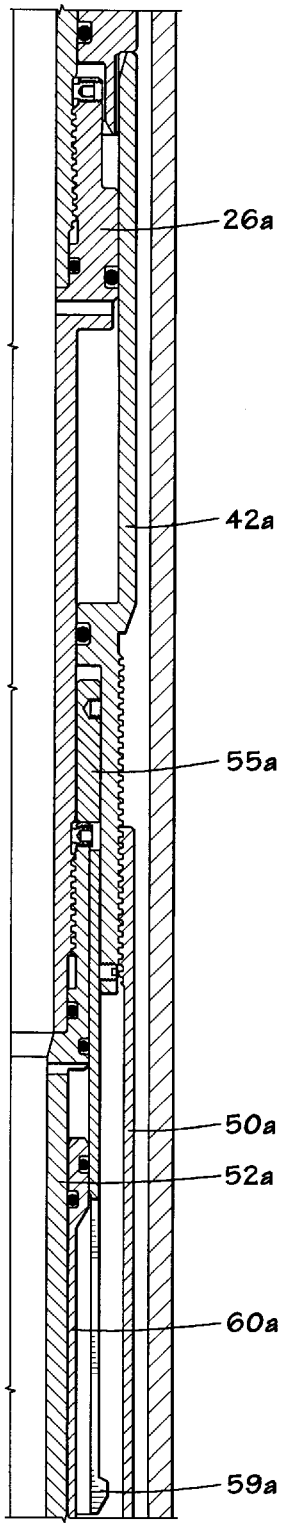
Figure 11C:
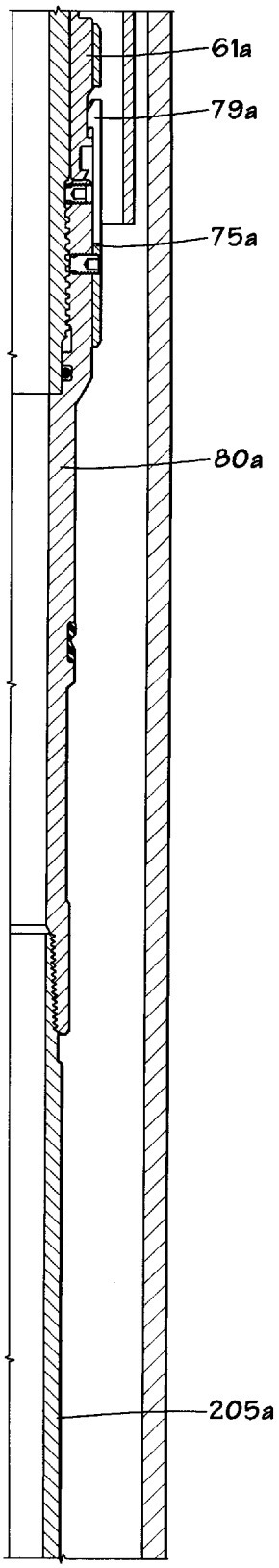
Figure 11D:
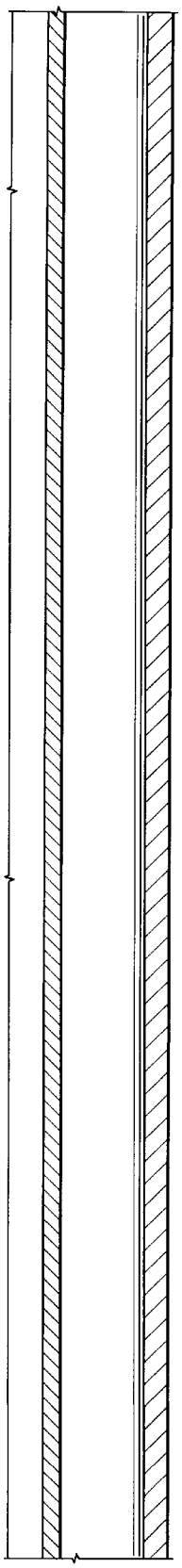
Figure 11E:
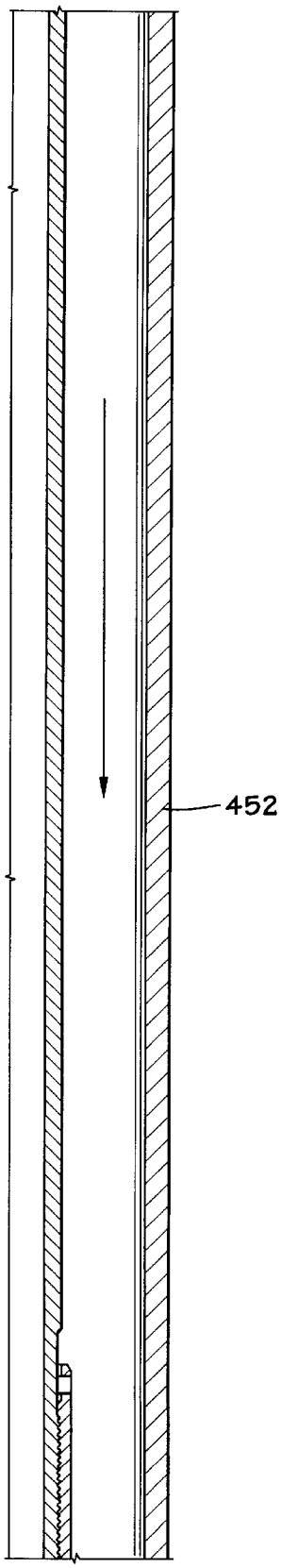
Figure 11F:
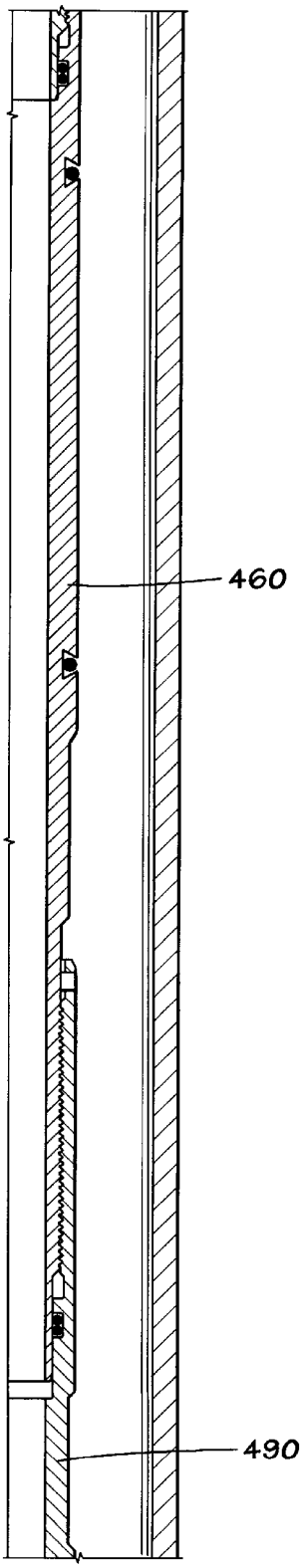
Figure 11G:
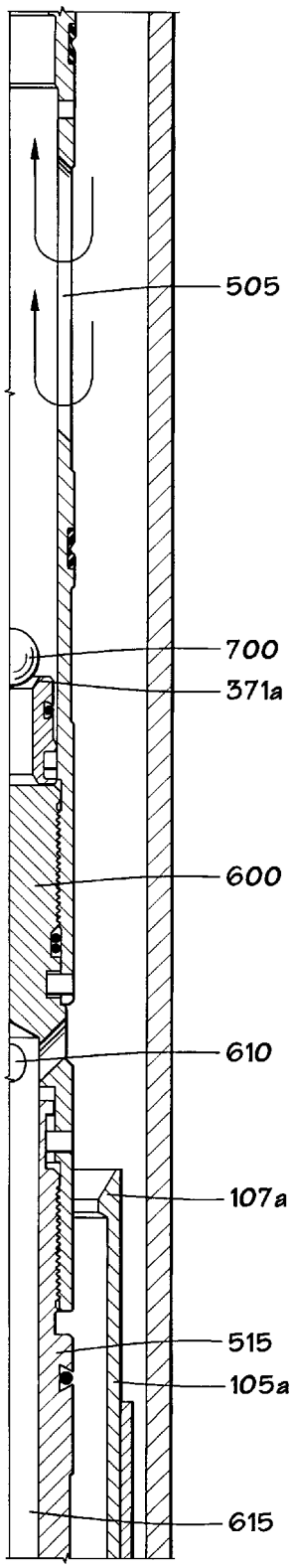
Figure 11H:
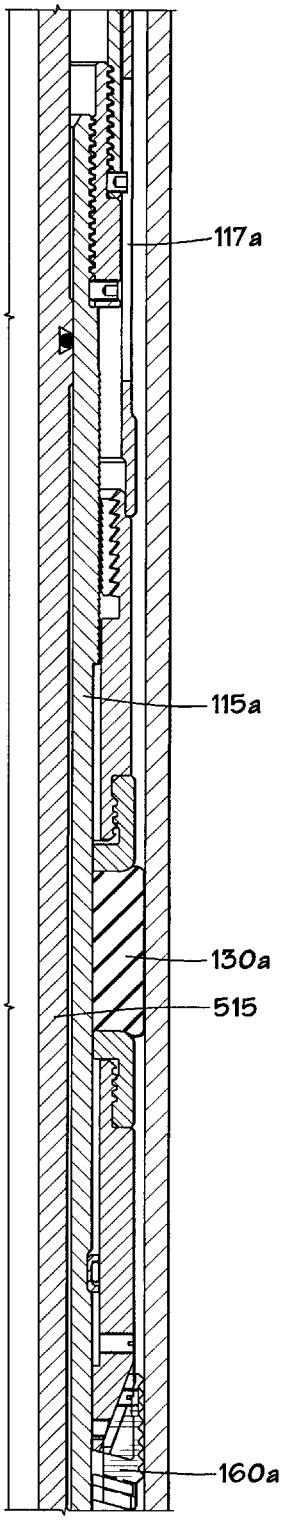
Figure 11I:
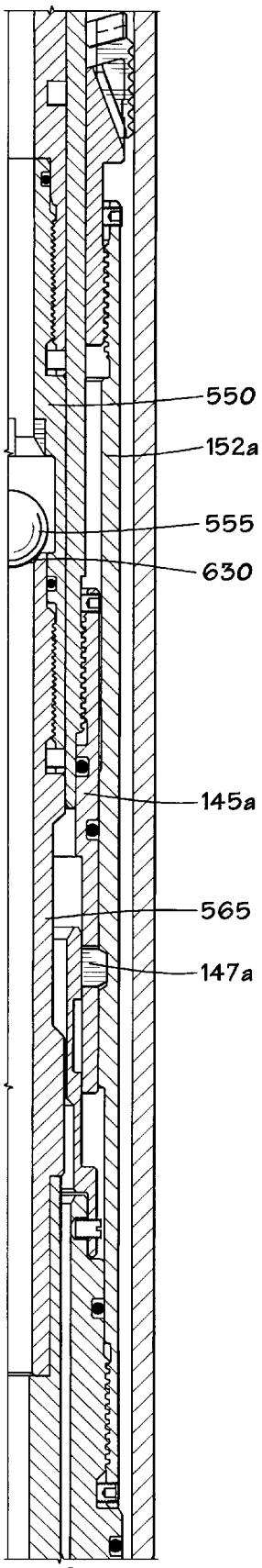
Figure 11J:
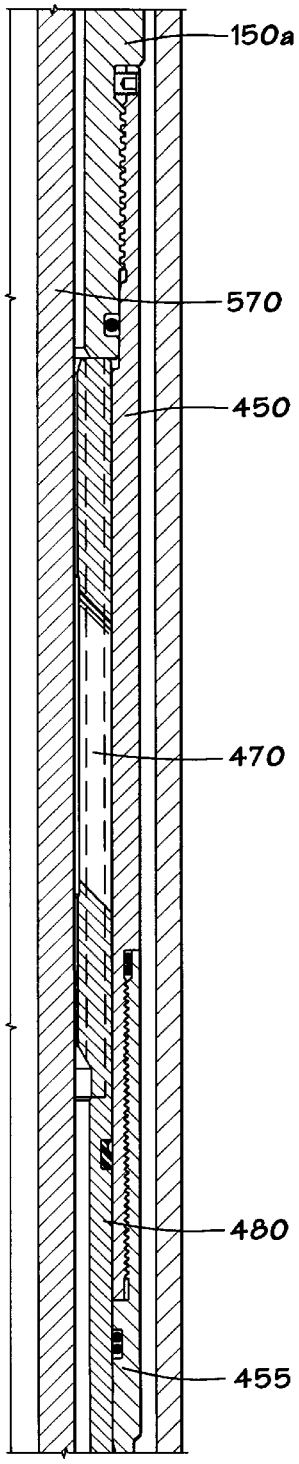
Figure 11K:
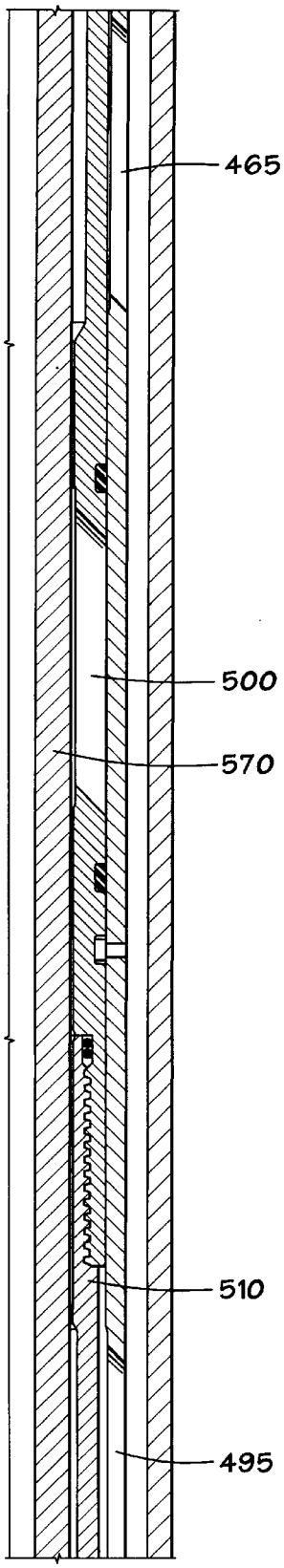
Figure 11L:
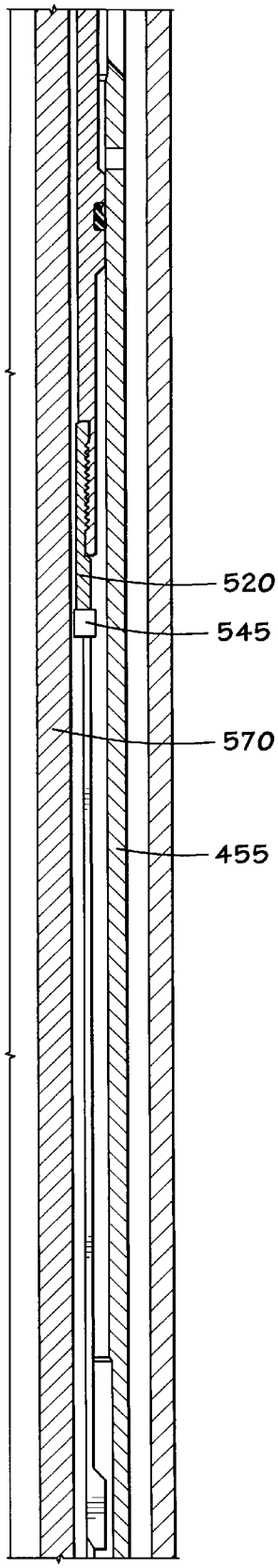
Figure 11M:
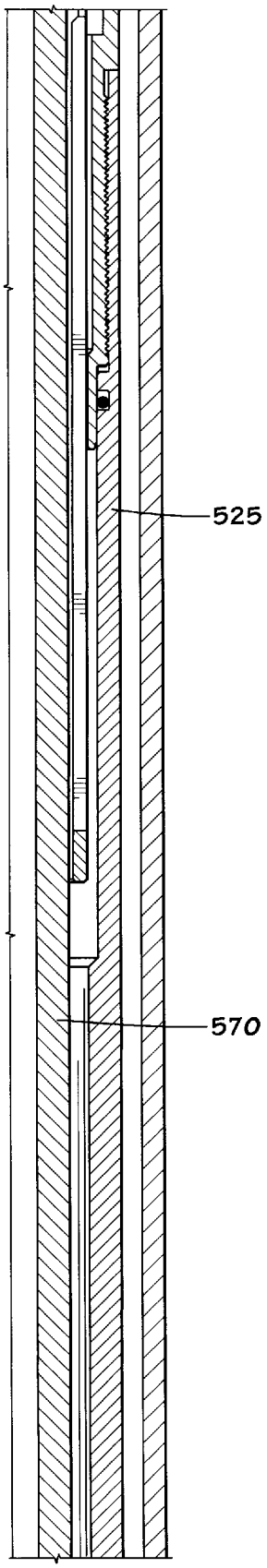
Figure 11N:
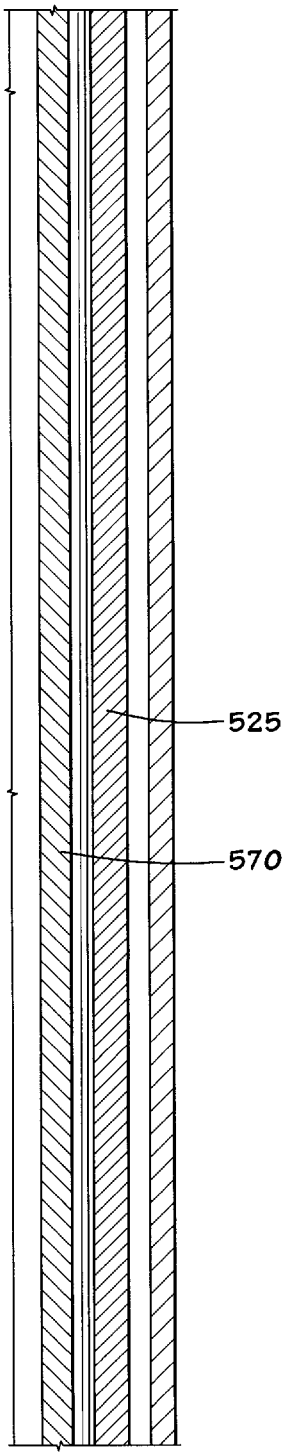
Figure 110:
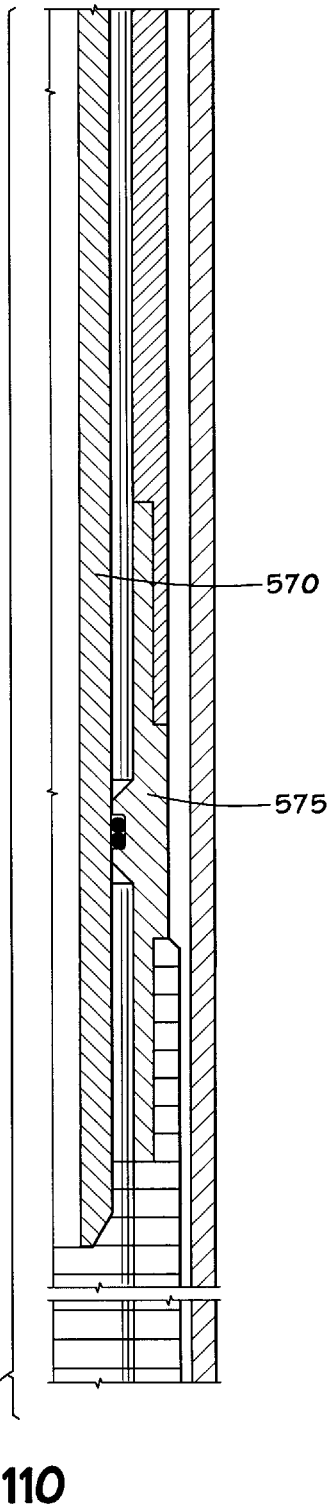
Figure 11P:
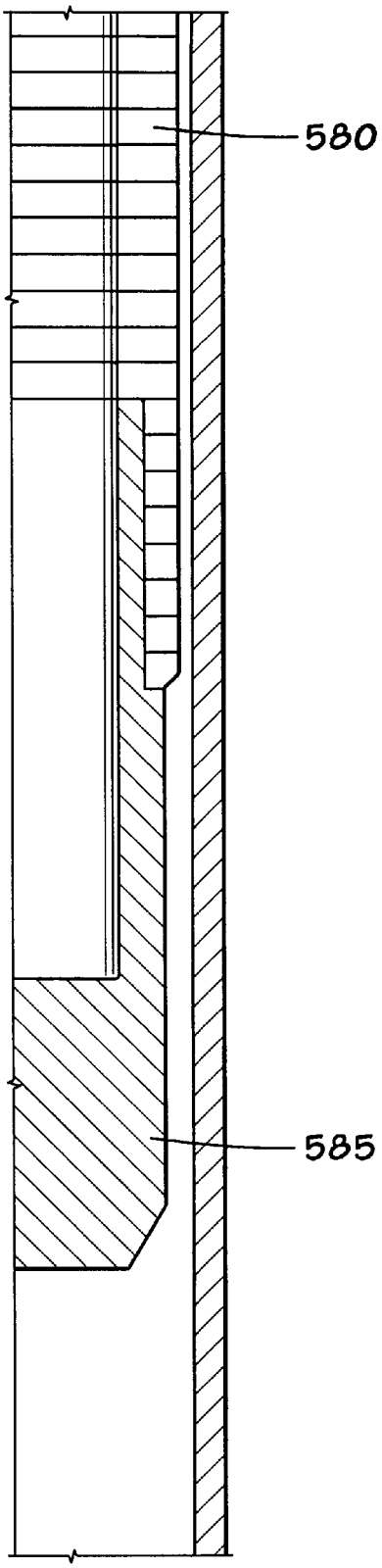
Figure 12A:
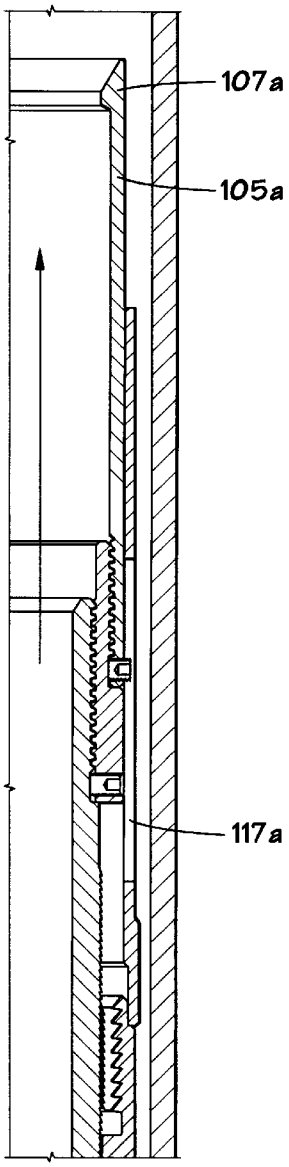
Figure 12B:
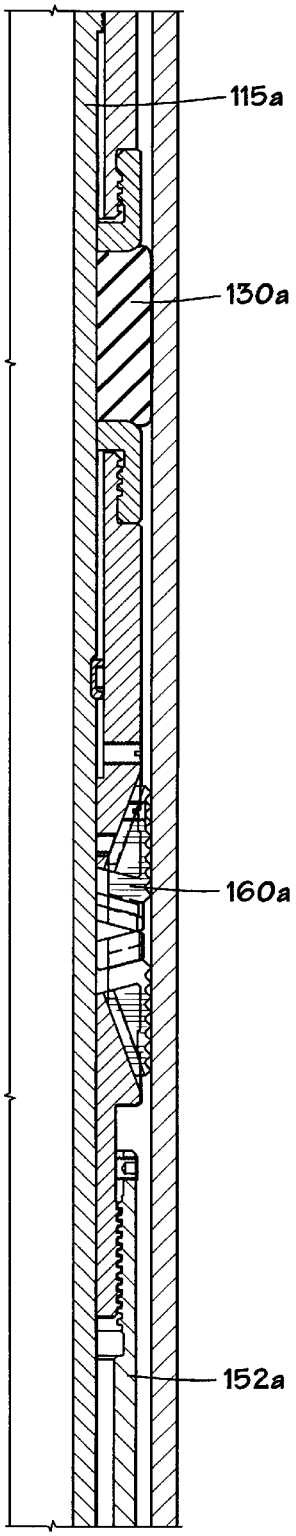
Figure 12C:
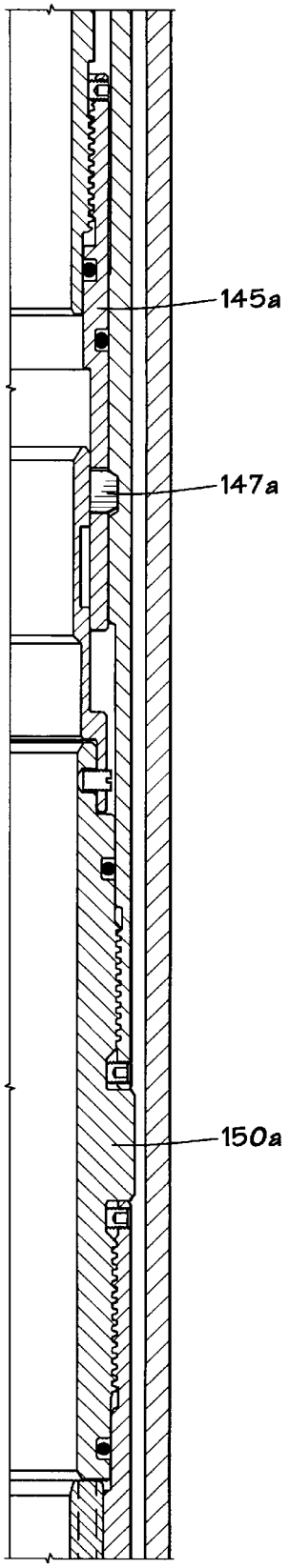
Figure 12D:
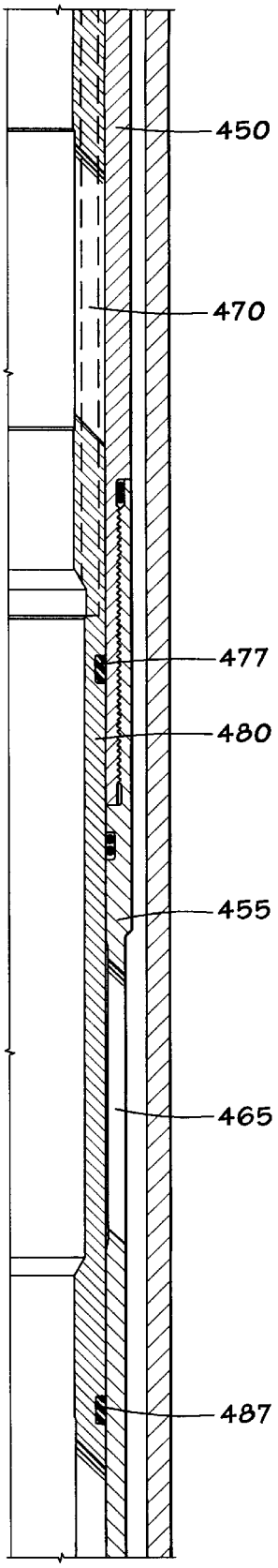
Figure 12E:
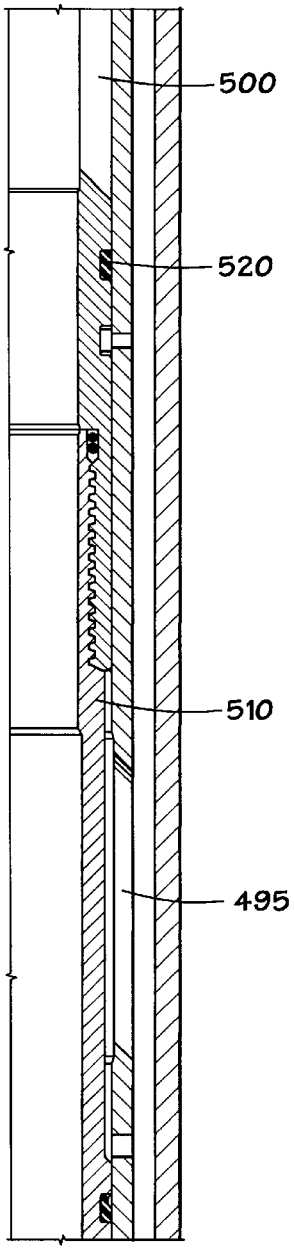
Figure 12F:
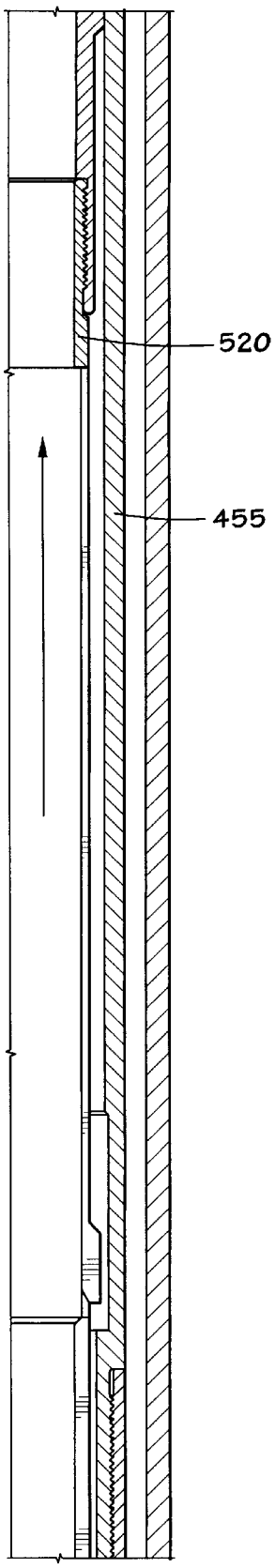

Once in the circulating position, the gravel pack slurry is displaced down the coiled tubing string, through passageway 15*a* of the gravel pack assembly and into the bore of blanking sleeve 460 and diverter sleeve 490. From there, the slurry passes through slots 505 of diverter sleeve 490, through slots 470 of crossover sleeve 480, through slots 465 of gravel pack sleeve 455 and down the annular space 650 between the internal diameter of production tubing 452 and the outer diameter of gravel pack sleeve 455 as shown in FIGS. 8F–G. Slurry continues down the annular space past lower adapter 525 and seal sub 575 to gravel pack screens 580. As the slurry reaches the screens, the sand carried by the gravel pack slurry will be deposited about the outer diameter of the screens and the carrier fluid of the slurry will pass through the screens and return up the internal passageway of wash pipe 570, into the bore of wash pipe adapter 565, around ball 555 of check valve 550 via fluid bypass slots 560 (not shown), through passageway 615 and out ports 610 of lock sleeve 600 as shown by the arrows in FIGS. 8G–I.

The carrier fluid will continue through the annular space between crossover sleeve 480 and the lower portion of diverter sleeve 490. The carrier fluid will enter opening 476 of the longitudinal passageways 475 of crossover sleeve 480, as illustrated in FIG. 8G. After passing through the longitudinal passageways of the crossover sleeves and exiting through opening 478, the carrier fluid will travel up the annular passageway between blanking sleeve 460/spacer tube 205*a* and the internal diameter of packer mandrel 115*a*. Thus, the through tubing gravel pack system uses the packer mandrel 115*a* as a conduit for the return flow of the carrier fluid. Once the carrier fluid clears the packer, the carrier fluid will return up the annular space between the running tool/coiled tubing and production tubing 452 until it reaches the surface.

To perform a squeeze pack, the operator will lower the coiled tubing string at the surface, thereby lowering the running tool and service assembly 20*a* into the squeeze position as shown in FIGS. 9A–K. In this embodiment, lowering the running tool and service assembly to the squeeze position will shift diverter sleeve 490 downward so that slots 505 are adjacent slots 500 of crossover sleeve 480 and slots 495 of gravel pack sleeve 455. The gravel pack slurry is displaced down the coiled tubing, through passageway 15*a* until it reaches the bore of diverter sleeve 490. The slurry will pass through slots 505 of the diverter sleeve, through slots 500 of crossover sleeve 480, through slots 495 of gravel pack sleeve 455, and will continue down the annular space between tubing 452 and gravel pack sleeve 455 and lower adapter 525 until it reaches the gravel pack screens. As the slurry reaches the gravel pack screens 580, the sand or gravel of the slurry is deposited about the screens. In the squeeze position, seals 616 seal the annular space between diverter sleeve 490 and crossover sleeve 480 thereby preventing the carrier fluid from exiting lock sleeve 600 through ports 610 and entering passageways 475 of the crossover sleeve. Since the carrier fluid does not have a passageway back up through the gravel pack assembly, the carrier fluid is displaced or squeezed through the perforations and into the formation after the sand or gravel is deposited about the gravel pack screens. As with the previously described embodiment, the squeeze pack is continued until the operator cycles the running tool and service assembly back to the circulating position or the displacement or squeeze pressure reaches a predetermined upper limit.

To close the gravel pack sleeve, the operator raises the coiled tubing string at the surface, thereby raising the running tool and service assembly 20*a* relative to packer assembly 100*a* as shown in FIGS. 10A–M. Raising the running tool and service assembly to the closed position will cause crossover sleeve 480 to shift upwards relative to gravel pack sleeve 455 so that slots 470 and 500 in the crossover sleeve are no longer adjacent slots 465 or 495 of the gravel pack sleeve. Seals 487 and 502 seal the annular space between gravel pack sleeve 455 and crossover sleeve 480 above and below slot 500. Seals 477 and 487 seal the annular space between upper adapter 450/gravel pack sleeve 455 and crossover sleeve 480 above and below slots 470. In the closed position, crossover sleeve 480 abuts against the bottom of bottom sub 150*a* of packer assembly 100*a* and slots 465 and 495 in the gravel pack sleeve 455 are isolated from the fluids inside the crossover sleeve and sliding sleeve valve assembly. Furthermore, fluids inside the assembly cannot fall on the formation because of check valve 550. More particularly, the weight of the column of fluid inside the gravel pack assembly forces ball 555 against check valve seat 630 thereby preventing fluids from passing downwardly past check valve 550.

Once the gravel pack is complete and the crossover sleeve and sliding sleeve valve assembly is in the closed position, it is desirable to remove any excess slurry still in bore 15*a* above slots 505 of diverter sleeve 490. To reverse out the excess slurry, the operator needs to clear slots 505 of the packer assembly. This is accomplished by lifting the coiled tubing string at the surface until shear screws 545 shear. Once shear screws 545 shear, the running tool and service assembly 20*a* is raised a sufficient distance until slots 505 clear packer assembly 100*a*. The operator can then reverse circulate by circulating down the annular space between tubing 452 and the coiled tubing/running tool and service assembly 20*a*. The fluid will circulate down the annular space and into slots 505 and up to the surface as shown in FIGS. 11A–I. Check valve 550 prevents fluid from being circulated down to the formation through passageway 15*a*.

To produce the well through the new gravel pack, running tool and service assembly 20*a* is removed from the well. Production fluids flow through gravel pack screens 580 and into the wellbore as shown in FIGS. 12A–J.

Packer assembly 100*a* and crossover sleeve and sliding sleeve valve assembly 425 can be retrieved from the wellbore with retrieving assembly 650 as shown in FIGS. 15A–K. Retrieving assembly 650 includes, among other things, top sub 652, mandrel 655, retrieving collet 670, flexible fingers 675, piston 680, spacer 685, shear sub 690, release collet 695, flexible fingers 705, shear sleeve 710, and bottom sub 715.

The uphole end of top sub 652 is adapted to be connected to a work string. The work string may be coiled tubing or jointed pipe. The lower end of top sub 652 includes no go surface 654. Mandrel 655 is coaxially arranged within and extends from top sub 652. The upper end of mandrel 655 is connected to the internal diameter of top sub 652. Retrieving collet 670 is coaxially arranged for a longitudinal movement in the annular space between mandrel 655 and top sub 652. Retrieving collet 670 includes a plurality of longitudinally extending flexible fingers 675. The leading edges of fingers 675 are tapered to allow the fingers to move downward past fishing neck 107*a* on the packer assembly. The uphole shoulders on fingers 675 are configured to abut against the downhole shoulder on fishing neck 107*a*, as shown in FIG. 15B.

Figure 15A:
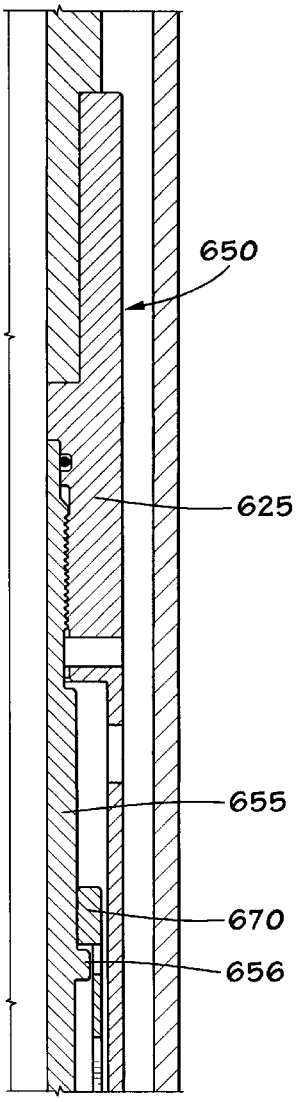
FIGS. 15A–K illustrate successive portions, in vertical sections, of the through tubing gravel pack system in the retrieving position.
Figure 15B:
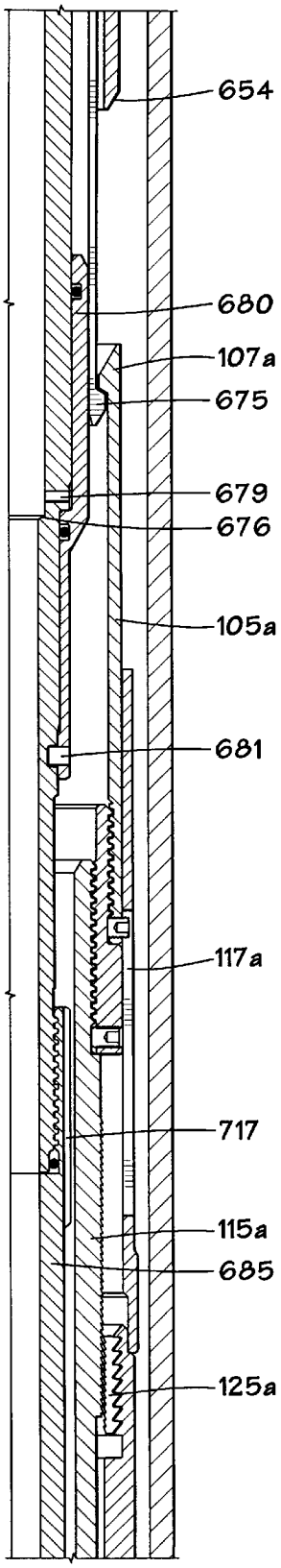
Figure 15C:
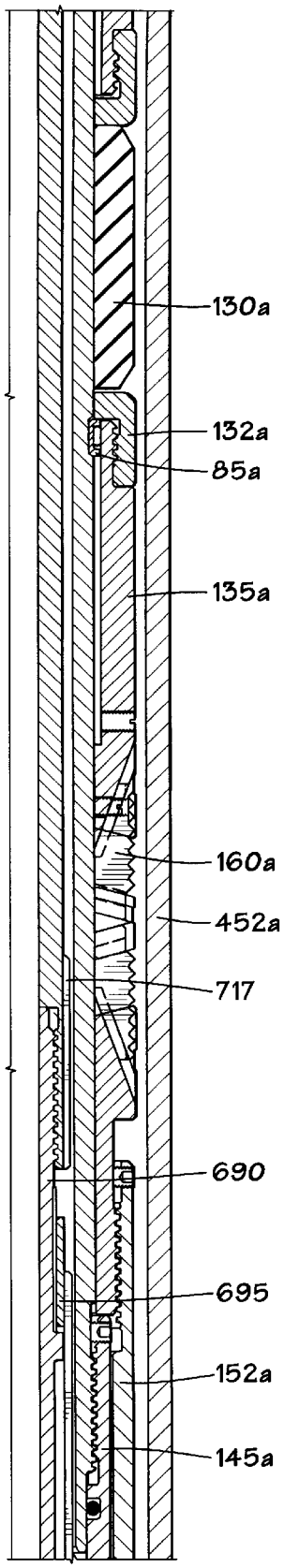
Figure 15D:
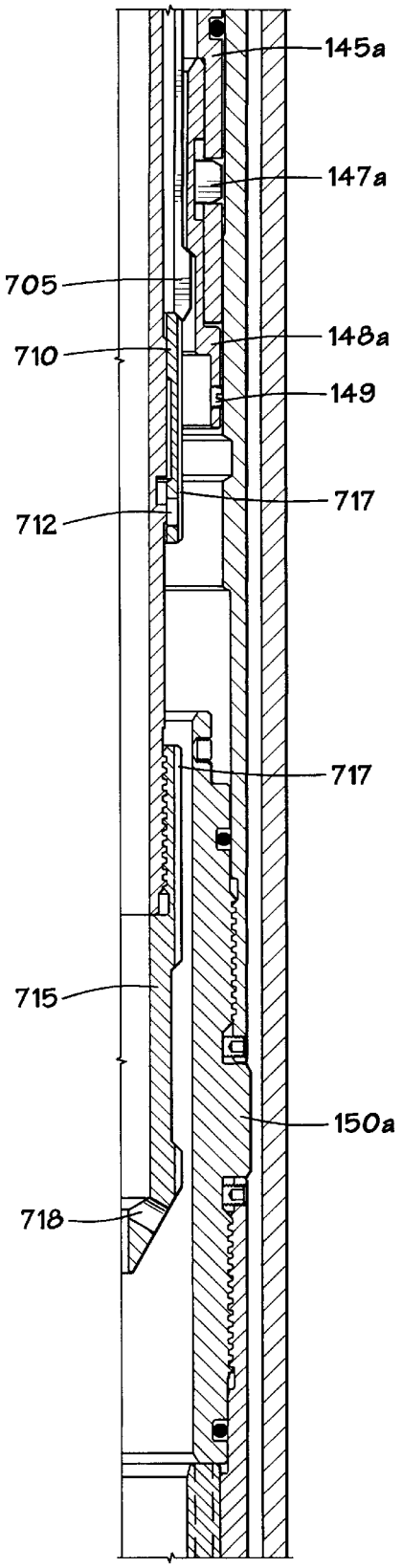
Figure 15E:
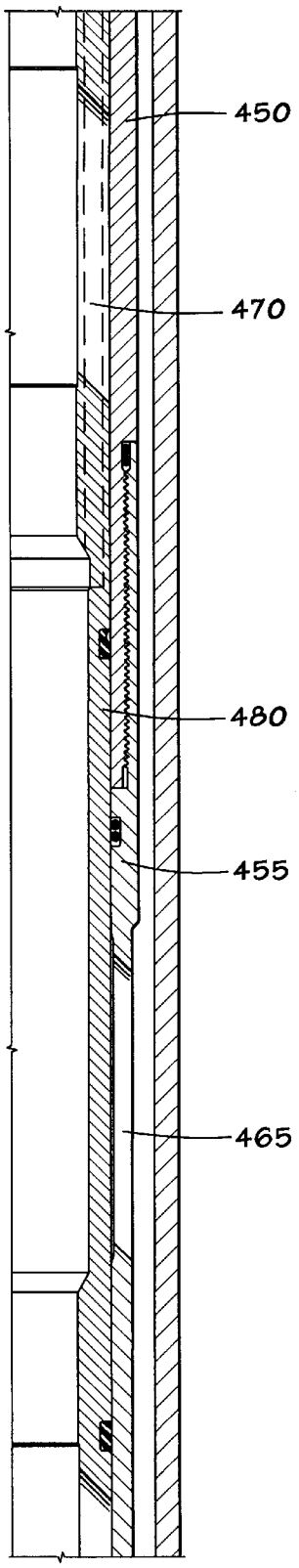
Figure 15F:
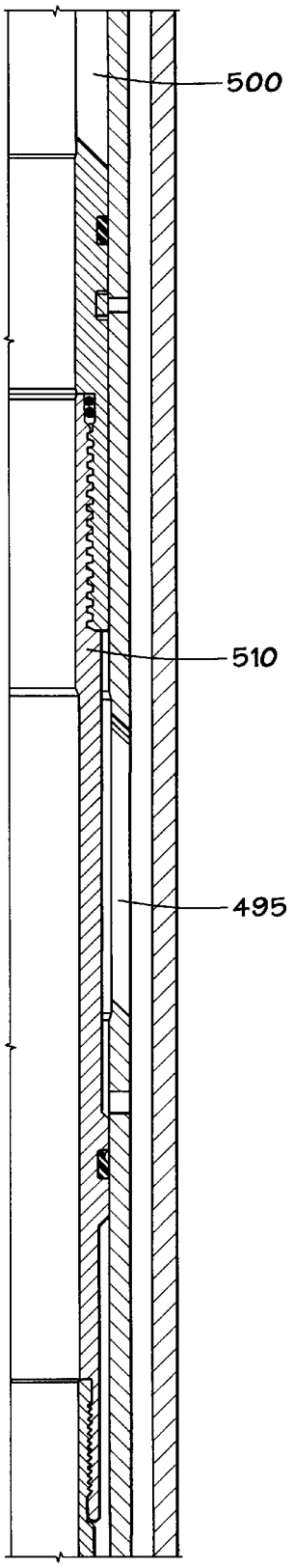
Figure 15G:
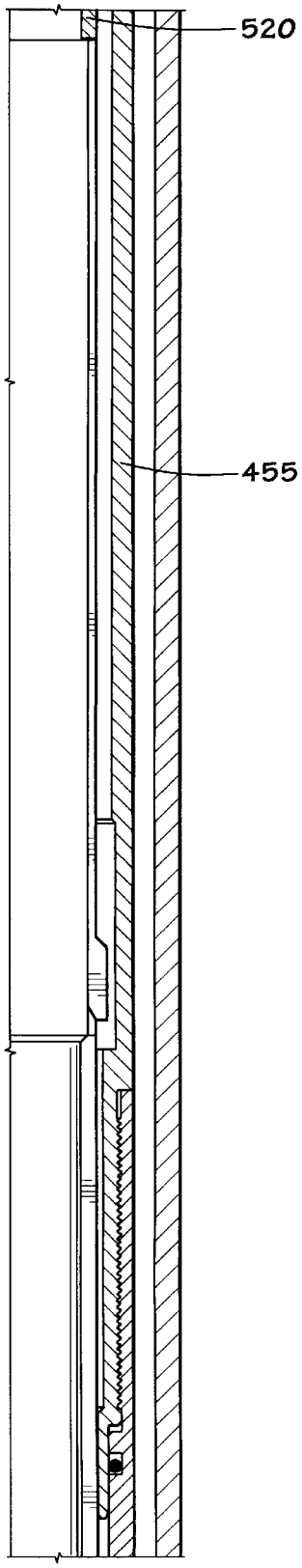
Figure 15H:
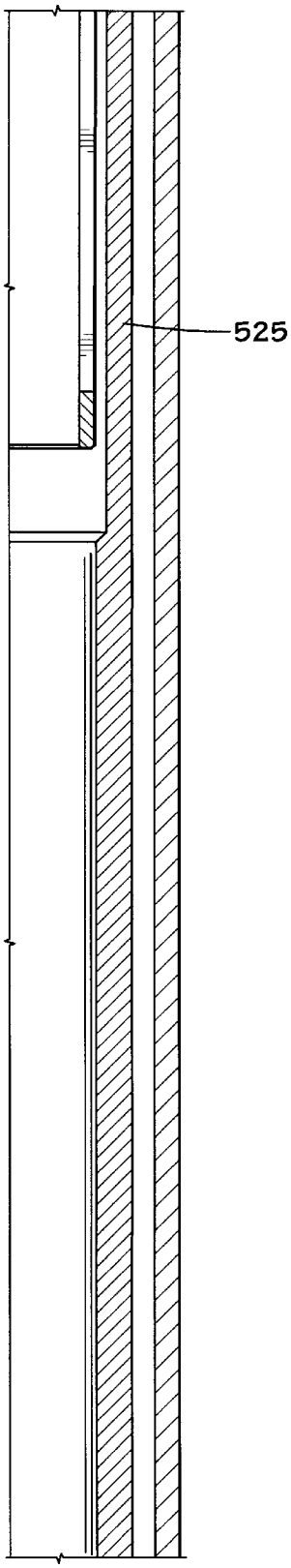
Figure 15I:
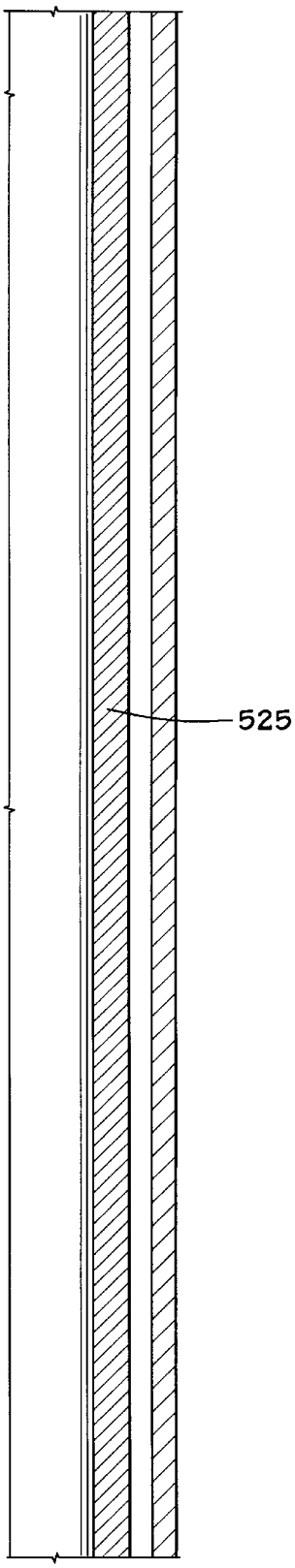
Figure 15J:
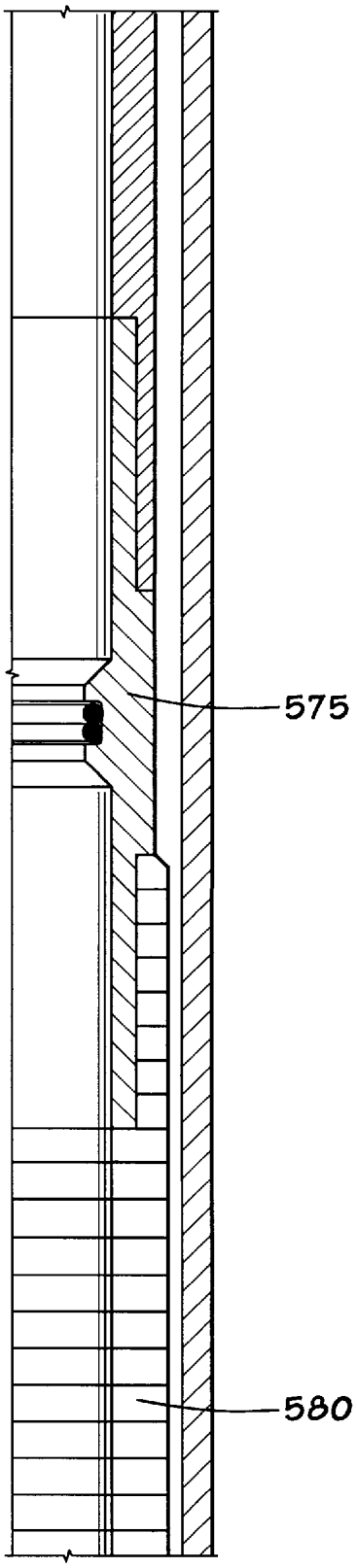
Figure 15K:
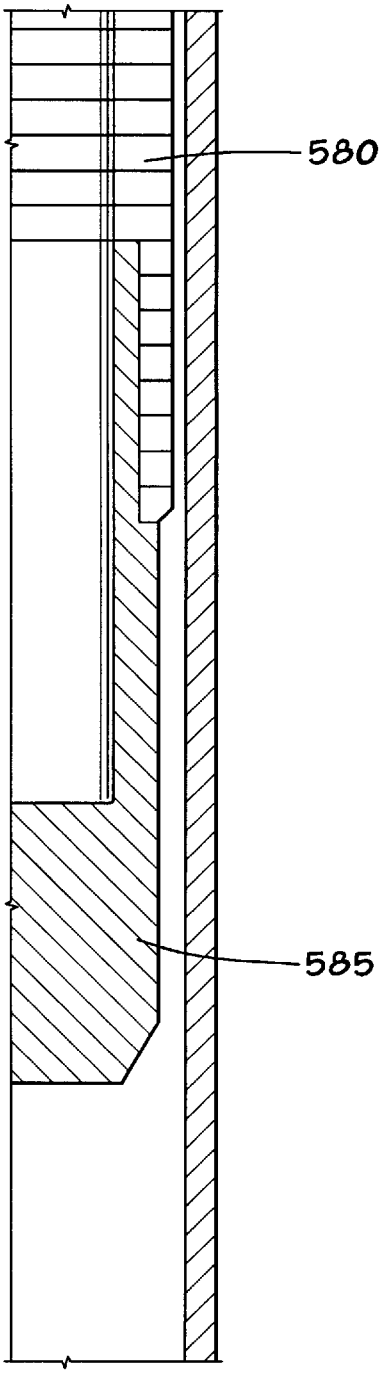

Piston 680 is coaxially arranged about and connected to mandrel 655 by one or more shear screws 681 as shown in FIG. 15B. Piston 680 supports fingers 675 when fingers 675 have engaged fishing neck 107*a*. Spacer 685 is threadedly connected to the lower end of mandrel 655. Shear sub 690 is threadedly connected to the lower end of spacer 685. Release collet 695 is coaxially arranged about shear sub 690 and includes a plurality of longitudinally extending flexible fingers 705. Shear sleeve 710 is coaxially arranged about and connected to shear sub 690 by one or more shear screws 712. Bottom sub 715 is threadedly connected to the lower end of shear sub 690. Bottom sub 715 includes a plurality of wash ports 718 which allows an operator to circulate down the retrieving assembly when stinging into the packer assembly. Bottom sub 715, shear sleeve 710 and spacer 685 include respective circulation slots 717 to provide a circulation path when washing out the interior of packer assembly 100*a*. The circulation flow path also includes the slots between the collet fingers on release collet 695 and retrieving collet 670.

To retrieve packer assembly 100*a* and crossover sleeve and sliding sleeve valve assembly 425, retrieving assembly 650 is run into the production tubing and stung into the bore of packer assembly 100*a*. Fingers 675 of retrieving collet 670 snap under fishing neck 107*a* when retrieving assembly 650 is stung into the packer assembly. The downward movement of retrieving assembly 650 also causes flexible fingers 705 of release collet 695 to find the recess in the internal diameter of release sleeve 148*a*. When the retrieving assembly is stabbed into the packer assembly, release sleeve 148*a* is still attached to bottom sub 150*a* of the packer assembly by shear screws 149. Retrieving assembly 650 is spaced out so that fingers 705 are positioned within the recess on the internal surface of release sub 148*a* and fingers 675 of retrieving collet 670 are positioned beneath fishing neck 107*a* when no go shoulder 674 of top sub 652 bottoms out against fishing neck 107*a*. An operator can then pick up and apply tension to the work string until shear screws 149 shear thereby releasing release sleeve 148*a* from bottom sub 150*a*. The tension is applied from the work string to top sub 652, mandrel 655, spacer 685, shear sub 690, through shear screws 712 to shear sleeve 710 which abuts against the lower end of fingers 705 of release collet 695. Fingers 705 are biased radially outward by the upper end of shear sleeve 710 keeping fingers 705 extended into the internal recess of release sleeve 148*a*. Prior to when shear sleeve 710 abuts and radially biases fingers 705, piston 680 moves up and beneath fingers 675 of retrieving collet 670, supporting them in the internal recess of top sub 105*a*.

Once shear screws 149 shear, the continued upward force on retrieving assembly 650 will slide release sleeve 148*a* upwardly until the recess in its external diameter is positioned adjacent locking dogs 147*a*. This allows locking dogs 147*a* to be collapsed into the external recess of release sleeve 148*a*. Continuing the upward tensile force will move lock sub 145*a* and lock ring 125*a* and packer mandrel 115*a* relative to slips 160*a* until pickup rings 85*a* abut against the lower gauge ring 132*a*. Upper cone 135*a* will then move from beneath slips 160*a*, thereby stretching the slip assembly 160*a* out of engagement with the internal diameter of production tubing 452*a*. The upward movement of mandrel 115*a* and lock ring 125*a* also de-energizes the packing element 130*a*. Once the packing element and slip assembly have been de-energized, further upward movement will cause shear screws 712 to shear, thereby allowing shoulder 656 of mandrel 655 to abut against retrieving collet 670, causing fingers 675 to engage fishing neck 170*a* as shown in FIG. 15B. At this point, packer assembly 100*a* and crossover sleeve and sliding sleeve valve assembly 425 may be pulled out of the hole.

In the event that the packer assembly and the sliding sleeve and crossover valve assembly can not be pulled out of the hole, retrieving assembly 650 includes an emergency release mechanism which allows the retrieving assembly to be released from the packer assembly. A ball is dropped or circulated down the work string and into the retrieving assembly and lands on no go shoulder 676 of mandrel 655. Pressure is then applied down the work string and mandrel 655 and out ports 679 to piston 680. The pressure on piston 680 is increased until shear screws 681 shear. Once shear screws 681 shear, piston 680 moves downward relative to mandrel 655 and away from fingers 675 of retrieving collet 670. The downward movement of piston 680 removes the support for fingers 675 thereby allowing fingers 675 to collapse radially inwardly out of engagement with fishing neck 107*a*. An upward tensile force applied to the work string will cause shear sleeve 710 to drop downwardly on top of bottom sub 715. Once shear sleeve 710 drops, support for fingers 705 of release collet 695 is removed thereby allowing fingers 705 to collapse radially inwardly releasing retrieving assembly 650 from packer assembly 100*a*. At that point, the work string and retrieving assembly can be pulled out of the hole.

Although the retrieving assembly 650 has been described with the second embodiment of the through tubing gravel pack system, retrieving assembly 650 will similarly work with the embodiment of the through tubing gravel pack assembly shown in FIGS. 3A–E.

Although particular detailed embodiments of the invention have been described herein, it should be understood that the invention is not restricted to the details of the preferred embodiments, and any changes in design, configuration, and dimensions are possible without departing from the spirit and scope of the invention.

What is claimed is:

1. A through tubing gravel pack assembly comprising:

a packer assembly;

a crossover sleeve and sliding sleeve valve assembly extending coaxially beneath said packer assembly, said sliding sleeve valve comprising a completion sleeve having one or more fluid passageways extending laterally therethrough and a closing sleeve coaxially arranged for longitudinal movement within said completion sleeve for closing said laterally extending fluid passageways of said completion sleeve, said crossover sleeve having one or more longitudinally extending fluid passageways and one or more laterally extending fluid passageways, wherein said crossover sleeve is coaxially arranged within said completion sleeve and moveable between an open position where said laterally extending fluid passageways of said crossover sleeve are aligned with said laterally extending fluid passageways of said completion sleeve for fluid flow therethrough and a closed position where said laterally extending fluid passageways of said crossover sleeve are not aligned with said laterally extending fluid passageways of said completion sleeve;

a retrievable running tool and service assembly releasably connected to said packer assembly and adapted for setting said packer, said retrievable running tool and service assembly further adapted for reciprocating longitudinal movement within said packer assembly and said crossover sleeve and sliding sleeve valve assembly after releasing from said packer assembly between a circulating position and a squeeze position; and gravel pack screens extending coaxially beneath said crossover sleeve and sliding sleeve valve assembly.

2. The through tubing gravel pack assembly of claim 1 wherein the annular space between the outer diameter of said running tool and service assembly and the inner diameter of said packer assembly provides a conduit for fluid passage.

3. The through tubing gravel pack assembly of claim 2 wherein said annular space between the outer diameter of said running tool and service assembly and the inner diameter of said packer assembly provide a conduit for the return flow of the carrier fluid for a gravel pack slurry.

4. The through tubing gravel pack assembly of claim 1 wherein, said running tool and service assembly has a first and second set of laterally extending fluid passageways, wherein said first set of fluid passageways are aligned with said laterally extending fluid passageways of said crossover sleeve and said completion sleeve when said running tool and service assembly is in said squeeze position and wherein said second set of fluid passageways are aligned with said laterally extending fluid passageways of said crossover sleeve and completion sleeve when said running tool and service assembly is in said circulating position.

5. The through tubing gravel pack assembly of claim 4 wherein said running tool and service assembly further comprises a one way check valve positioned beneath said first and second set of laterally extending fluid passageways, said check valve preventing fluids from passing beneath said valve.

6. The through tubing gravel pack assembly of claim 1 wherein said packer assembly is hydraulically set.

7. The through tubing gravel pack assembly of claim 1 wherein the uphole end of said running tool and service assembly is adapted to be connected to a coiled tubing string.

8. The through tubing gravel pack assembly of claim 1 wherein said running tool and service assembly is adapted to move said crossover sleeve from said open position to said closed position.

9. The through tubing gravel pack assembly of claim 1 wherein said running tool and service assembly further comprises a lock sleeve adapted to engage said closing sleeve and move said closing sleeve across said laterally extending fluid passageways of said completion sleeve.

10. The through tubing gravel pack assembly of claim 9 wherein said closing sleeve is adapted to move said crossover sleeve to said closed position when said lock sleeve moves said closing sleeve across said laterally extending fluid passageways of said completion sleeve.

11. A through tubing gravel pack assembly comprising:

a packer assembly;

a crossover assembly extending beneath said packer assembly, said crossover assembly comprising a completion sleeve having one or more radially extending fluid ports;

a crossover sleeve having one or more longitudinally extending fluid passageways and one or more radially extending fluid ports, whereby said fluid ports in said crossover sleeve and said completion sleeve may be selectively aligned for fluid communication therethrough;

a running tool and service assembly extending within said packer assembly and said crossover assembly, said running tool and service assembly being selectively shiftable between a circulating position and a squeeze position; and gravel pack screens extending beneath said crossover assembly.

12. The through tubing gravel pack assembly of claim 11 wherein the annular space between the outer diameter of said running tool and service assembly and the inner diameter of said packer assembly provides a conduit for fluid passage.

13. The through tubing gravel pack assembly of claim 12 wherein said annular space between the outer diameter of said running tool and service assembly and said inner diameter of said packer assembly provides a conduit for the return flow of the carrier fluid for a gravel pack slurry.

14. The through tubing gravel pack assembly of claim 11 wherein said running tool and service assembly includes a first and second set of radially extending fluid ports wherein said first set of fluid ports are aligned with said fluid ports of said completion sleeve and said crossover sleeve when said running tool and service assembly is in said squeeze position and wherein said second set of fluid ports are aligned with said fluid ports of said completion sleeve and crossover sleeve when said running tool and service assembly is in said circulating position.

15. The through tubing gravel pack assembly of claim 11 wherein the uphole end of said running tool and service assembly is adapted to be connected to a coiled tubing string.

16. The through tubing gravel pack assembly of claim 11 wherein said running tool and service assembly is adapted to move said crossover sleeve relative to said completion sleeve to prevent fluid communication between said fluid ports of said crossover sleeve and completion sleeve.

17. The through tubing gravel pack assembly of claim 11 wherein said crossover assembly includes a closing sleeve for selectively closing said fluid ports of said completion sleeve.

18. The through tubing gravel pack assembly of claim 17 wherein said running tool and service assembly further comprises a lock sleeve adapted to engage said closing sleeve and move said closing sleeve across said fluid ports in said completion sleeve.

19. The through tubing gravel pack assembly of claim 18 wherein said closing sleeve is adapted to move said crossover sleeve to a closed position when said lock sleeve moves said closing sleeve, thereby preventing fluid communication between said fluid ports of said crossover sleeve and said completion sleeve.

20. The through tubing gravel pack assembly of claim 11 wherein said running tool and service assembly further comprises a one way check valve which prevents fluids from passing beneath said valve.

21. A through tubing gravel pack assembly comprising:

a packer assembly;

a crossover sleeve and sliding sleeve valve assembly extending coaxially beneath said packer assembly, said sliding sleeve valve comprising a gravel pack sleeve having a first and second set of radially extending fluid ports, said crossover sleeve having one or more longitudinally extending passageways and a first and second set of radially extending fluid ports, wherein said crossover sleeve is coaxially arranged within said gravel pack sleeve and moveable between an open position where said first and second set of fluid ports of said crossover sleeve are aligned with said respective first and second set of fluid ports in said gravel pack sleeve for fluid flow therethrough and a closed position where said fluid ports of said crossover sleeve are not aligned with said respective fluid ports of said gravel pack sleeve;

a retrievable running tool and service assembly releasably connected to said packer assembly and adapted for setting said packer, said retrievable running tool and service assembly further adapted for reciprocating longitudinal movement within said packer assembly and said crossover sleeve and sliding sleeve valve assembly after releasing from said packer assembly between a circulating position and a squeeze position; and gravel pack screens extending coaxially beneath said crossover sleeve and sliding sleeve valve assembly.

22. The through tubing gravel pack assembly of claim 21 wherein the annular space between the outer diameter of said running tool and service assembly and the inner diameter of said packer assembly provides a conduit for fluid passage.

23. The through tubing gravel pack assembly of claim 22 wherein said annular space between the outer diameter of said running tool and service assembly and the inner diameter of said packer assembly provide a conduit for the return flow of the carrier fluid for a gravel pack slurry.

24. The through tubing gravel pack assembly of claim 21 wherein said packer assembly is hydraulically set.

25. The through tubing gravel pack assembly of claim 21 wherein said running tool and service assembly has one or more laterally extending fluid ports, wherein said laterally extending fluid ports are aligned with said first set of fluid ports of said crossover sleeve and gravel pack sleeve when said running tool and service assembly is in said circulating position and wherein said laterally extending fluid ports are aligned with said second set of fluid ports of said crossover tool and gravel pack sleeve when said running tool and service assembly is in said squeeze position.

26. The through tubing gravel pack assembly of claim 25 wherein said running tool and service assembly includes a one way check valve positioned beneath said laterally extending fluid ports, said check valve preventing fluids from passing beneath said valve.

27. The through tubing gravel pack assembly of claim 21 wherein said gravel pack assembly is adapted to be connected to a coiled tubing string.

28. The through tubing gravel pack assembly of claim 21 wherein said running tool and service assembly is adapted to move said crossover sleeve from said open position to said closed position.

29. The through tubing gravel pack assembly of claim 21 wherein said sliding sleeve valve further comprises an isolation sleeve coaxially arranged for longitudinal movement within said gravel pack sleeve and adapted to close said second set of fluid ports in said gravel pack sleeve.

30. The through tubing gravel pack assembly of claim 29 wherein said running tool and service assembly includes a lock sleeve adapted to engage said isolation sleeve and move said isolation sleeve across said second set of fluid ports of said gravel pack sleeve.

31. The through tubing gravel pack assembly of claim 30 wherein said crossover sleeve is adapted to move to said closed position when said locked sleeve moves said isolation sleeve across said second set of fluid ports of said gravel pack sleeve.

32. A method of gravel packing a wellbore through a production tubing string comprising the steps of:

(a) running a through tubing gravel pack assembly inside said production tubing to a desired depth, said gravel pack assembly comprising a packer, a crossover sleeve and sliding sleeve valve assembly extending coaxially beneath said packer, a running tool and service assembly releasably connected to said packer, said running tool and service assembly adapted for reciprocating longitudinal movement within said packer and said crossover sleeve and sliding sleeve valve assembly, and a slotted gravel pack screen;

(b) setting said packer;

(c) releasing said running tool and service assembly from said packer;

(d) reciprocating said running tool and service assembly relative to said packer and said crossover sleeve and sliding sleeve valve assembly in one longitudinal direction to a circulating position;

(e) displacing a gravel pack slurry to said gravel pack assembly and through ports in said crossover sleeve and sliding sleeve valve assembly to said slotted screen;

(f) circulating the carrier fluid of a portion of said slurry through said slotted screen and up through longitudinally extending passageways in said crossover sleeve;

(g) reciprocating said running tool and service assembly relative to said packer and crossover sleeve and sliding sleeve valve assembly in another longitudinal direction to a squeeze position;

(h) squeezing the carrier fluid from a subsequent portion of said slurry into a subterranean formation;

(i) closing said sliding sleeve valve assembly; and (j) retrieving said running tool and service assembly tool from said gravel pack assembly.

33. The method of claim 32 wherein following said squeezing step, steps (d) through (f) are repeated.

34. The method of claim 33 wherein after steps (d) through (f) are repeated, steps (g) and (h) are repeated.

35. The method of claim 32 wherein step (f) further comprises circulating said carrier fluid through the annular space between the inner diameter of said packer and the outer diameter of said running tool and service assembly.

36. The method of claim 32 further comprising placing a one way check valve in said running tool and service assembly to prevent fluid from falling through said running tool and service assembly.

37. The method of claim 32 further comprising reversing excess slurry out of said gravel pack assembly prior to retrieving said running tool and service assembly tool.

38. The method of claim 32 further comprising retrieving said packer and said crossover sleeve and sliding sleeve valve assembly.

39. A method of rehabilitating a deteriorated gravel pack comprising the steps of:

(a) running a gravel pack assembly down to said deteriorated gravel pack, said gravel pack assembly comprising a packer, a crossover sleeve and sliding sleeve valve assembly, a releasable running tool and service assembly, said running tool and service assembly being selectively shiftable between a circulating position and a squeeze position, and a slotted screen;

(b) setting said packer;

(c) releasing said running tool and service assembly from said gravel pack assembly;

(d) shifting said running tool and service assembly to said circulating position;

(e) displacing a gravel pack slurry to said gravel pack assembly and through ports in said crossover sleeve and sliding sleeve valve assembly to said slotted screen;

(f) circulating the carrier fluid of said slurry up through longitudinally extending passageways in said crossover sleeve;

(g) shifting said running tool and service assembly to a said squeeze position; and (h) squeezing a subsequent portion of said carrier fluid into a subterranean formation.

40. The method of claim 39 further comprising the steps of repeating steps (d) through (f).

41. The method of claim 40 further comprising the steps of repeating steps (g) through (h).

42. The method of claim 39 wherein step (f) further comprises circulating said carrier fluid through the annular space between the inner diameter of said packer and the outer diameter of said running tool and service assembly.

43. The method of claim 39 further comprising placing a oneway check valve in said running tool and service assembly to prevent fluid from falling through said running tool and service assembly.

* * * * *